US010487846B2

(12) United States Patent
Kumon et al.

(10) Patent No.: US 10,487,846 B2
(45) Date of Patent: Nov. 26, 2019

(54) PROPELLER FAN, FLUID FEEDER, AND MOLDING DIE

(71) Applicant: Sharp Kabushiki Kaisha, Sakai, Osaka (JP)

(72) Inventors: Yui Kumon, Sakai (JP); Masaki Ohtsuka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 210 days.

(21) Appl. No.: 15/724,582

(22) Filed: Oct. 4, 2017

(65) Prior Publication Data

US 2018/0038384 A1 Feb. 8, 2018

Related U.S. Application Data

(63) Continuation of application No. 14/391,414, filed as application No. PCT/JP2013/060710 on Apr. 9, 2013, now Pat. No. 9,816,521.

(30) Foreign Application Priority Data

Apr. 10, 2012 (JP) ..... 2012-089282
Apr. 10, 2012 (JP) ..... 2012-089285

(51) Int. Cl.
*F04D 29/38* (2006.01)
*F04D 29/68* (2006.01)

(52) U.S. Cl.
CPC ..... *F04D 29/384* (2013.01); *F04D 29/681* (2013.01)

(58) Field of Classification Search
CPC ..... F04D 29/325; F04D 19/002; F04D 25/08; F04D 29/384; F05D 2240/307
USPC ..... 416/223 R
See application file for complete search history.

(56) References Cited

U.S. PATENT DOCUMENTS

2010/0266428 A1 10/2010 Nakagawa et al.

FOREIGN PATENT DOCUMENTS

| | | | |
|---|---|---|---|
| JP | 01-247797 | A | 10/1989 |
| JP | 2000-192898 | A | 7/2000 |
| JP | 2009-185803 | A | 8/2009 |

OTHER PUBLICATIONS

Kumon et al., "Propeller Fan, Fluid Feeder, and Molding Die", U.S. Appl. No. 14/391,414, filed Oct. 9, 2014.
Kumon et al., "Propeller Fan, Fluid Feeder, Electric Fan, and Molding Die", U.S. Appl. No. 15/628,896, filed Jun. 21, 2017.

*Primary Examiner* — Aaron R Eastman
(74) *Attorney, Agent, or Firm* — Keating & Bennett, LLP

(57) ABSTRACT

A blade of a propeller fan includes a blade root portion, a front edge portion, a blade tip end portion, a rear edge portion, a blade rear edge portion, and an outer edge portion. A blade surface of the blade has an inner region including the blade root portion, an outer region including the blade rear end portion, and a coupling portion extending from a front end portion located close to the blade tip end portion to a rear end portion located close to the rear edge portion and coupling the inner region and the outer region to each other such that a side of a positive pressure surface of the blade surface is projecting and a side of a negative pressure surface of the blade surface is recessed.

19 Claims, 49 Drawing Sheets

PROPELLER FAN, FLUID FEEDER, AND MOLDING DIE

TECHNICAL FIELD

This invention generally relates to a propeller fan, a fluid feeder, and a molding die, and more particularly to a propeller fan for sending a fluid, a fluid feeder such as an electric fan, a circulator, an air-conditioner, an air cleaner, a humidifier, a dehumidifier, a fan heater, a cooling apparatus, or a ventilator including such a propeller fan, and a molding die used for molding such a propeller fan with a resin.

BACKGROUND ART

As disclosed in Japanese Patent Laying-Open No. 2003-206894 (PTD 1), Japanese Patent Laying-Open No. 2011-058449 (PTD 2), Japanese Patent Laying-Open No. 2004-293528 (PTD 3), and Japanese Patent Laying-Open No. 2000-054992 (PTD 4), a propeller fan has been improved for the purpose of improvement in blowing performance, lowering in noise, energy saving, or design for resource saving.

CITATION LIST

Patent Document

PTD 1: Japanese Patent Laying-Open No. 2003-206894
PTD 2: Japanese Patent Laying-Open No. 2011-058449
PTD 3: Japanese Patent Laying-Open No. 2004-293528
PTD 4: Japanese Patent Laying-Open No. 2000-054992

SUMMARY OF INVENTION

Technical Problem

A first object of the present invention is to provide a propeller fan capable of lowering noise generated during rotation and power consumption required during rotation while enhancing efficiency by increasing a quantity of wind, a molding die used for manufacturing of the propeller fan, and a fluid feeder including the propeller fan.

A second object of the present invention is to provide a propeller fan capable of preventing separation of a flow of air by making air flow in at an appropriate inflow angle with respect to a blade surface over substantially the entire region in a direction of radius, a molding die used for manufacturing of the propeller fan, and a fluid feeder including the propeller fan.

Solution to Problem

A propeller fan based on a first aspect of the present invention includes a rotation shaft portion rotating around a virtual central axis in a prescribed direction of rotation and a blade extending outward from an outer surface of the rotation shaft portion in a direction of radius of the central axis. The blade includes a blade root portion arranged between the blade and the outer surface of the rotation shaft portion, a peripheral portion continuing to the blade root portion and forming a periphery of the blade together with the blade root portion, and a blade surface formed in a region surrounded by the blade root portion and the peripheral portion. The peripheral portion has a front edge portion arranged upstream in the direction of rotation, a blade tip end portion arranged on an outer side in the direction of radius, in the front edge portion, a rear edge portion arranged downstream in the direction of rotation, a blade rear end portion arranged on the outer side in the direction of radius, in the rear edge portion, and an outer edge portion extending in a circumferential direction around the central axis and connecting the blade tip end portion and the blade rear end portion to each other. The blade surface has an inner region including the blade root portion and located on the inner side in the direction of radius, an outer region including the blade rear end portion and located on the outer side in the direction of radius, and a coupling portion extending from a front end portion located close to the front edge portion, the blade tip end portion, or the outer edge portion to a rear end portion located close to the rear edge portion and coupling the inner region and the outer region to each other such that a side of a positive pressure surface of the blade surface is projecting and a side of a negative pressure surface of the blade surface is recessed. The blade surface is formed such that a stagger angle in a portion on the inner side in the direction of radius relative to the coupling portion in the blade surface is smaller than a stagger angle in a portion on the outer side in the direction of radius relative to the coupling portion in the blade surface.

Preferably, when a virtual concentric circle passing through a central position in the coupling portion in the direction of rotation and centered around the central axis is drawn, the front end portion of the coupling portion is located on an outer side in the direction of radius of the concentric circle and the rear end portion of the coupling portion is located on an inner side in the direction of radius of the concentric circle. Preferably, the coupling portion is formed such that an interior angle formed on the side of the negative pressure surface of the coupling portion is smallest around a center of the coupling portion in the direction of rotation, and the blade surface located around each of the front end portion and the rear end portion is formed at 180° in a cross-sectional view along the direction of radius, which passes through each of the front end portion and the rear end portion.

Preferably, the coupling portion is formed along a flow of a blade tip end vortex generated over the blade surface with rotation of the blade. Preferably, the blade surface is formed such that a stagger angle in a portion on the inner side in the direction of radius relative to the coupling portion in the blade surface is smaller toward the rotation shaft portion.

Preferably, the blade surface is formed such that an area of the blade in a portion on the inner side in the direction of radius relative to the coupling portion in the blade surface is equal to or greater than an area of the blade in a portion on the outer side in the direction of radius relative to the coupling portion in the blade surface. Preferably, the coupling portion is provided from a portion located in midway between the blade tip end portion and the blade rear end portion to the rear edge portion.

Preferably, the coupling portion is provided from a side downstream in the direction of rotation, of a portion where a thickness of the blade surface is greatest. Preferably, the coupling portion is provided as being curved from the inner region toward the outer region. Preferably, the coupling portion is provided as being bent from the inner region toward the outer region.

Preferably, a dimensionless position $\eta$ obtained from an equation Ra/r1 satisfies a condition of $0.4 \leq \eta \leq 1$, where Ra represents a length dimension along the direction of radius from the outer surface of the rotation shaft portion to the front end portion of the coupling portion and r1 represents a length dimension along the direction of radius from the outer surface of the rotation shaft portion to the outer edge portion.

Preferably, a dimensionless position $\xi$ obtained from an equation Rb/r1 satisfies a condition of $0.3 \leq \xi \leq 0.7$, where Rb represents a length dimension along the direction of radius from the outer surface of the rotation shaft portion to the rear end portion of the coupling portion and r1 represents a length dimension along the direction of radius from the outer surface of the rotation shaft portion to the outer edge portion.

Preferably, the front end portion of the coupling portion is located close to the outer edge portion, and a dimensionless position $\kappa$ obtained from an equation Rc/C satisfies a condition of $0 \leq \kappa \leq 0.5$, where C represents a cord length dimension of the outer edge portion and Rc represents a length dimension from the blade tip end portion to the front end portion of the coupling portion.

Preferably, a dimensionless position $\eta$ is obtained from an equation Ra/r1, where Ra represents a length dimension along the direction of radius from the outer surface of the rotation shaft portion to the front end portion of the coupling portion and r1 represents a length dimension along the direction of radius from the outer surface of the rotation shaft portion to the outer edge portion, a dimensionless position $\xi$ is obtained from an equation Rb/r1, where Rb represents a length dimension along the direction of radius from the outer surface of the rotation shaft portion to the rear end portion of the coupling portion and r1 represents a length dimension along the direction of radius from the outer surface of the rotation shaft portion to the outer edge portion, and a condition of $0.80 \leq \eta \leq 1.0$ is satisfied and a condition of $0.40 \leq \xi \leq 0.65$ is satisfied.

Preferably, the front end portion of the coupling portion is located close to the outer edge portion, a dimensionless position $\xi$ is obtained from an equation Rb/r1, where Rb represents a length dimension along the direction of radius from the outer surface of the rotation shaft portion to the rear end portion of the coupling portion and r1 represents a length dimension along the direction of radius from the outer surface of the rotation shaft portion to the outer edge portion, a dimensionless position $\kappa$ is obtained from an equation Rc/C, where C represents a cord length dimension of the outer edge portion and Rc represents a length dimension from the blade tip end portion to the front end portion of the coupling portion, and a condition of $0.40 \leq \xi \leq 0.70$ is satisfied and a condition of $0 \leq \kappa \leq 0.3$ is satisfied.

Preferably, a region lying from the front edge portion to a portion of the outer edge portion close to the blade tip end portion has a constant height in an axial direction of the central axis. Preferably, the front edge portion has a constant height in an axial direction of the central axis between the rotation shaft portion and a position distant from the rotation shaft portion outward in the direction of radius.

Preferably, the blade root portion of the blade surface has a warped shape such that the side of the positive pressure surface of the blade surface is projecting and the side of the negative pressure surface of the blade surface is recessed, and the blade is formed such that a direction of warpage of the blade root portion and a direction of warpage of the outer edge portion are opposite to each other. Preferably, the outer edge portion has a front outer edge portion located on a side of the front edge portion, a rear outer edge portion located on a side of the rear edge portion, and a connection portion connecting the front outer edge portion and the rear outer edge portion to each other. The connection portion is a site where the front outer edge portion and the rear outer edge portion different in maximum radius are connected to each other, and it desirably smoothly connects the front outer edge portion and the rear outer edge portion to each other. Alternatively, desirably, the connection portion connects the front outer edge portion and the rear outer edge portion to each other substantially at an acute angle, for example, in a state having a cut. Alternatively, desirably, the connection portion connects the front outer edge portion and the rear outer edge portion to each other substantially at an obtuse angle, for example, in a state having a height difference. Alternatively, desirably, the connection portion is in a shape recessed toward the central axis. Preferably, formed from a resin molded product.

A fluid feeder based on the first aspect of the present invention includes the propeller fan based on the first aspect of the present invention. A molding die based on the first aspect of the present invention is used for molding the propeller fan based on the first aspect of the present invention.

A propeller fan based on a second aspect of the present invention includes a rotation shaft portion rotating around a virtual central axis in a prescribed direction of rotation and a blade extending outward from an outer surface of the rotation shaft portion in a direction of radius of the central axis. The blade includes a blade root portion arranged between the blade and the outer surface of the rotation shaft portion, a peripheral portion continuing to the blade root portion and forming a periphery of the blade together with the blade root portion, and a blade surface formed in a region surrounded by the blade root portion and the peripheral portion. The peripheral portion has a front edge portion arranged upstream in the direction of rotation, a blade tip end portion arranged on an outer side in the direction of radius, in the front edge portion, a rear edge portion arranged downstream in the direction of rotation, a blade rear end portion arranged on the outer side in the direction of radius, in the rear edge portion, and an outer edge portion extending in a circumferential direction around the central axis and connecting the blade tip end portion and the blade rear end portion to each other. A stagger angle in the blade root portion is smaller than a stagger angle in the outer edge portion. The blade root portion of the blade surface has a warped shape such that a side of a positive pressure surface of the blade surface is projecting and a side of a negative pressure surface of the blade surface is recessed. The blade is formed such that a direction of warpage of the blade root portion and a direction of warpage of the outer edge portion are opposite to each other.

A propeller fan based on another aspect of the second aspect of the present invention includes a rotation shaft portion rotating around a virtual central axis in a prescribed direction of rotation and a blade extending outward from an outer surface of the rotation shaft portion in a direction of radius of the central axis. The blade includes a blade root portion arranged between the blade and the outer surface of the rotation shaft portion, a peripheral portion continuing to the blade root portion and forming a periphery of the blade together with the blade root portion, and a blade surface formed in a region surrounded by the blade root portion and the peripheral portion. The peripheral portion has a front edge portion arranged upstream in the direction of rotation, a blade tip end portion arranged on an outer side in the direction of radius, in the front edge portion, a rear edge portion arranged downstream in the direction of rotation, a blade rear end portion arranged on the outer side in the direction of radius, in the rear edge portion, and an outer edge portion extending in a circumferential direction around the central axis and connecting the blade tip end portion and the blade rear end portion to each other. A stagger angle in the blade root portion is smaller than a stagger angle in the outer edge portion. The blade root portion of the blade surface is formed such that a cross-sectional view along the circumferential direction exhibits an S shape.

Preferably, the front edge portion has a constant height in an axial direction of the central axis between the rotation shaft portion and a position distant from the rotation shaft portion outward in the direction of radius. Preferably, the blade surface has an inner region including the blade root portion and located on the inner side in the direction of radius, an outer region including the blade rear end portion and located on the outer side in the direction of radius, and a coupling portion extending from a front end portion located close to the front edge portion, the blade tip end portion, or the outer edge portion to a rear end portion located close to the rear edge portion and coupling the inner region and the outer region to each other such that the side of the positive pressure surface of the blade surface is projecting and the side of the negative pressure surface of the blade surface is recessed.

Preferably, when a virtual plane orthogonal to the central axis is assumed on a burst side of the blade and a length in an axial direction of the central axis from that virtual plane is defined as a height, the rear edge portion has a substantially constant height in a region on an outer circumferential side around the central axis. Preferably, the blade surface is formed such that a stagger angle in a portion on the inner side in the direction of radius in the blade surface decreases toward the rotation shaft portion.

Preferably, when a virtual concentric circle passing through a central position in the coupling portion in the direction of rotation and centered around the central axis is drawn, the front end portion of the coupling portion is located on an outer side in the direction of radius of the concentric circle and the rear end portion of the coupling portion is located on an inner side in the direction of radius of the concentric circle. Preferably, the blade surface is formed such that an area of the blade in a portion on the inner side in the direction of radius relative to the coupling portion in the blade surface is equal to or greater than an area of the blade in a portion on the outer side in the direction of radius relative to the coupling portion in the blade surface. Preferably, formed from a resin molded product.

A fluid feeder based on the second aspect of the present invention includes the propeller fan based on the second aspect of the present invention. A molding die based on the second aspect of the present invention is used for molding the propeller fan based on the second object of the present invention.

Advantageous Effects of Invention

According to the first aspect of the present invention, a propeller fan capable of lowering noise generated during rotation and power consumption required during rotation while enhancing efficiency by increasing a quantity of wind, a molding die used for manufacturing of the propeller fan, and a fluid feeder including the propeller fan can be obtained.

According to the second aspect of the present invention, a propeller fan capable of preventing separation of a flow of air by making air flow in at an appropriate inflow angle with respect to a blade surface over substantially the entire region in a direction of radius, a molding die used for manufacturing of the propeller fan, and a fluid feeder including the propeller fan can be obtained.

DESCRIPTION OF EMBODIMENTS

Figure 1:
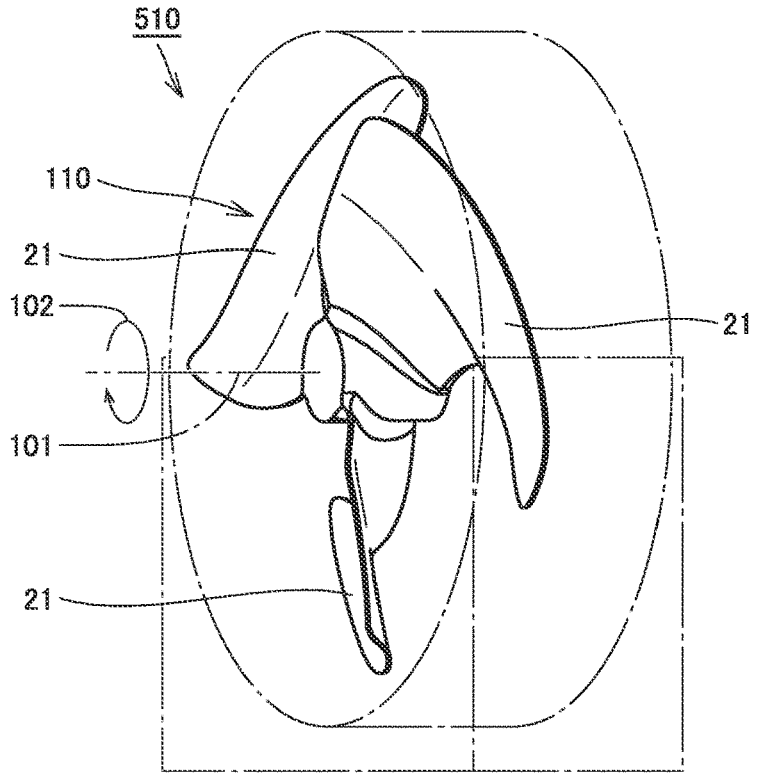
FIG. 1 is a perspective view showing a fluid feeder in a first embodiment.

Each embodiment based on the present invention will be described hereinafter with reference to the drawings. When the number, a quantity or the like is mentioned in the description of each embodiment, the scope of the present invention is not necessarily limited to the number, the quantity or the like, unless otherwise specified. In the description of each embodiment, the same or corresponding elements have the same reference characters allotted and redundant description may not be repeated. Combination for use of features shown in each embodiment as appropriate is originally intended, unless otherwise restricted.

First Embodiment (Fluid Feeder 510)

A fluid feeder 510 in the present embodiment will be described with reference to FIG. 1. Fluid feeder 510 in the present embodiment can be used, for example, as a circulator. Fluid feeder 510 has a propeller fan 110 and a drive motor (not shown). Fluid feeder 510 serving as a circulator is used, for example, for agitating cold air sent from an air-conditioner in a large room.

(Propeller Fan 110)

Propeller fan 110 in the present embodiment has three blades 21. Propeller fan 110 rotates in a direction shown with an arrow 102 around a central axis 101 as it is driven by a drive motor (not shown). Rotation of blade 21 generates wind so that fluid feeder 510 can send wind.

Propeller fan 110 may have a plurality of blades 21 other than three or may have only a single blade 21. When propeller fan 110 has only one blade 21, a weight serving as a balancer is desirably provided on a side opposite to blade 21 with respect to central axis 101. Propeller fan 110 is not limited to fluid feeder 510 as a circulator, and it may be employed in various fluid feeders such as an electric fan, an air-conditioner, an air cleaner, a humidifier, a dehumidifier, a fan heater, a cooling apparatus, or a ventilator.

Figure 2:
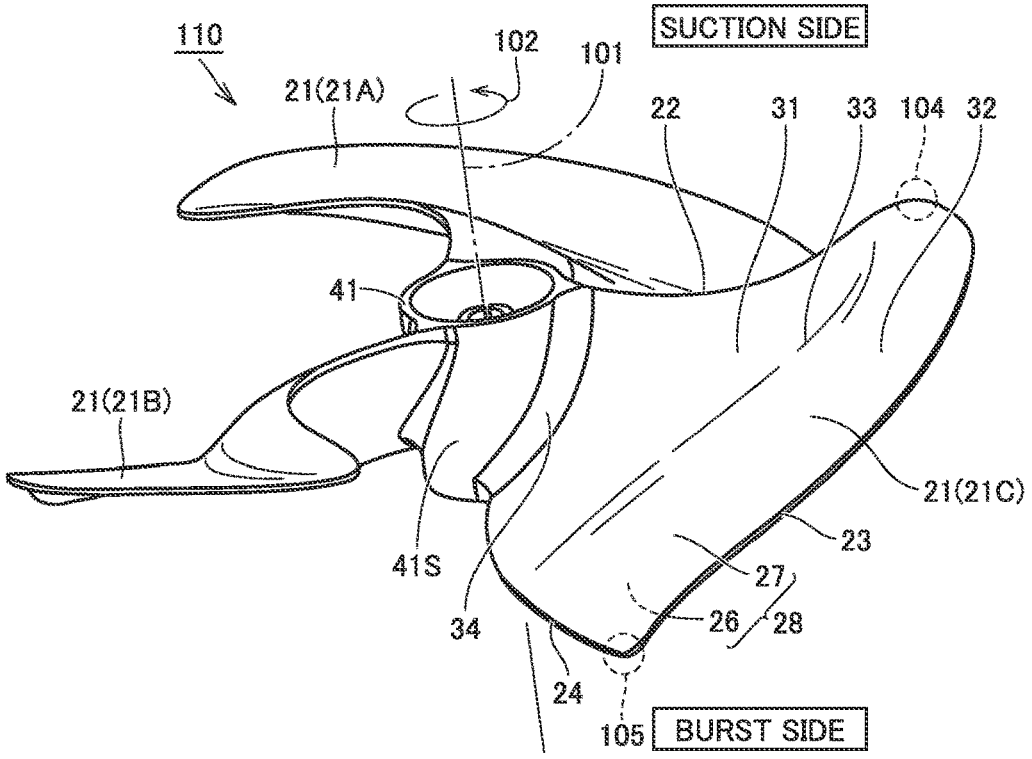
FIG. 2 is a first perspective view of a propeller fan in the first embodiment viewed from a suction side.
Figure 3:
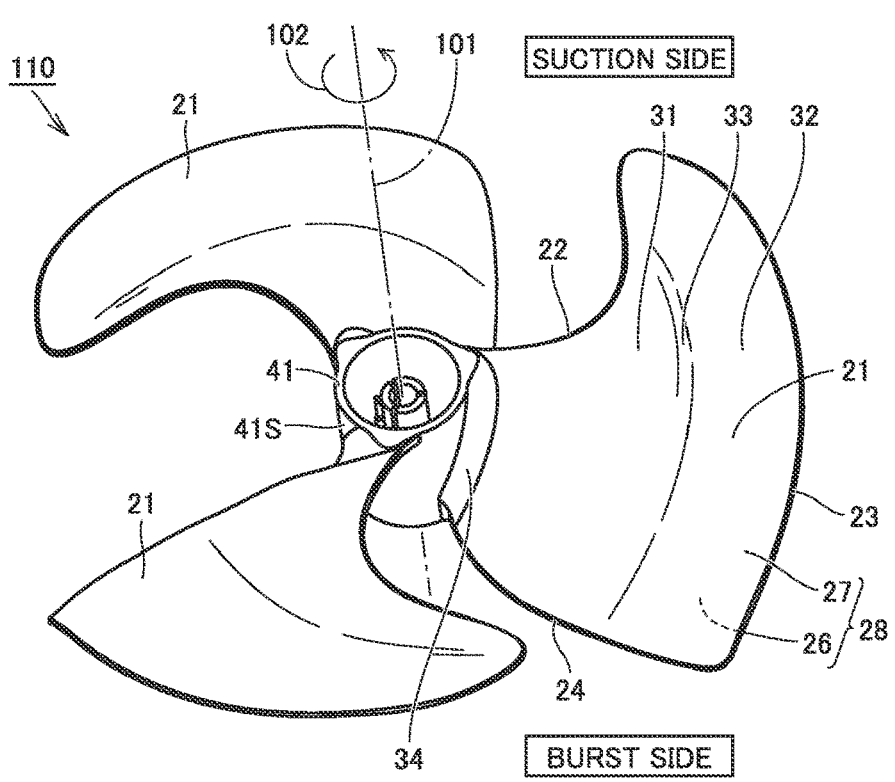
FIG. 3 is a second perspective view of the propeller fan in the first embodiment viewed from the suction side.
Figure 4:
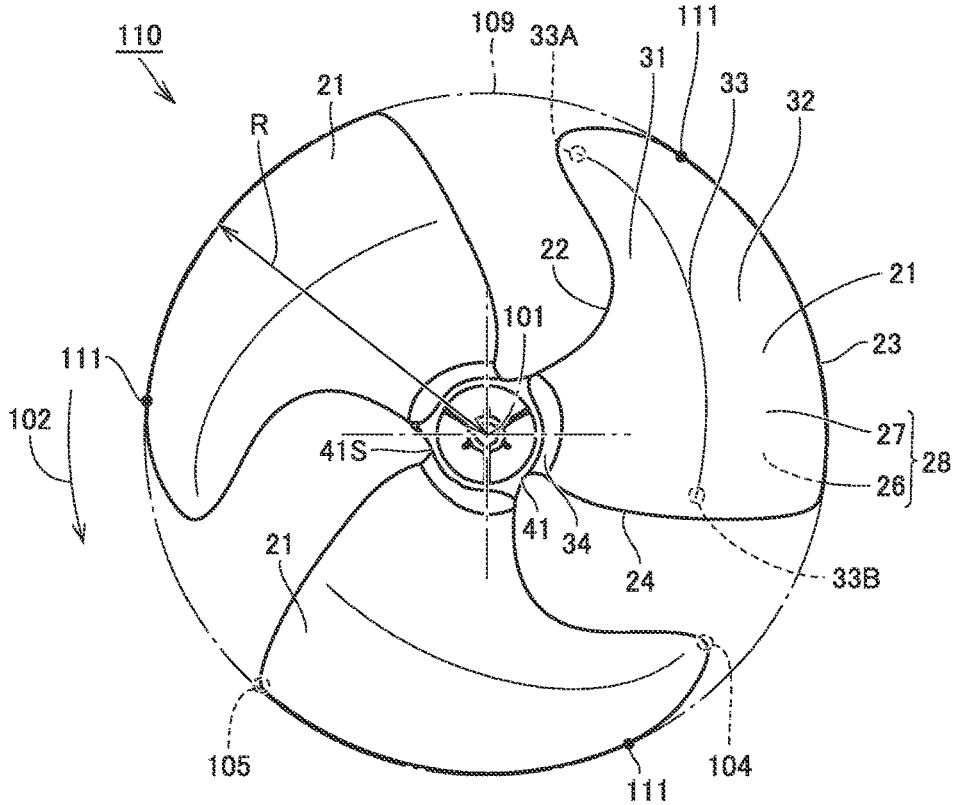
FIG. 4 is a plan view of the propeller fan in the first embodiment viewed from the suction side.
Figure 5:
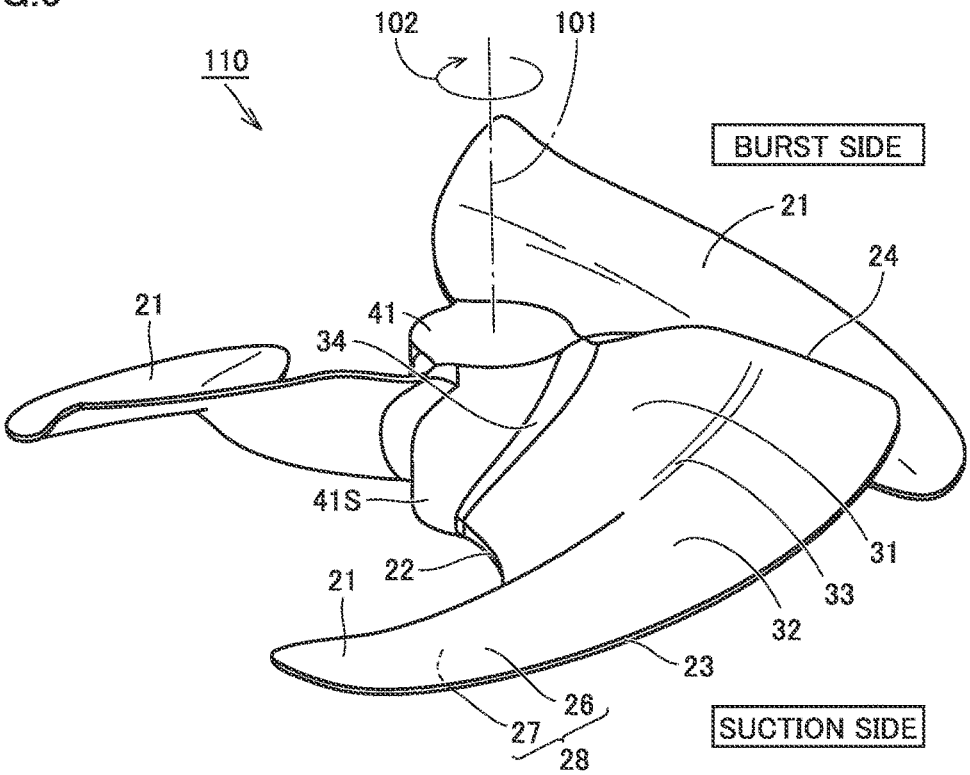
FIG. 5 is a perspective view of the propeller fan in the first embodiment viewed from a burst side.
Figure 6:
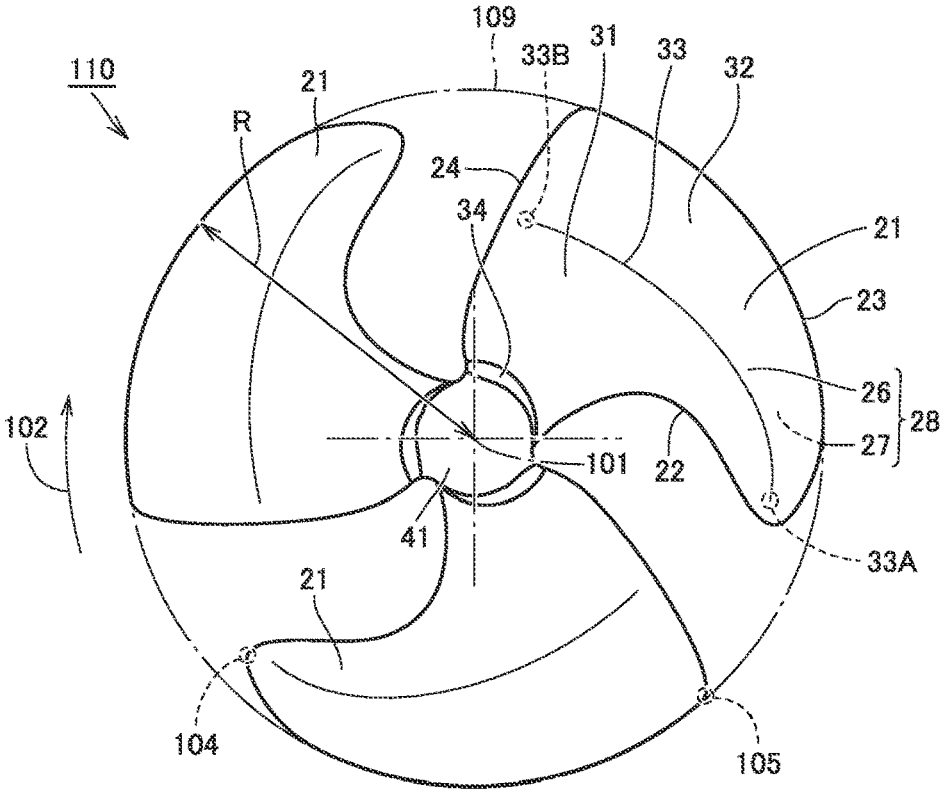
FIG. 6 is a plan view of the propeller fan in the first embodiment viewed from the burst side.
Figure 7:
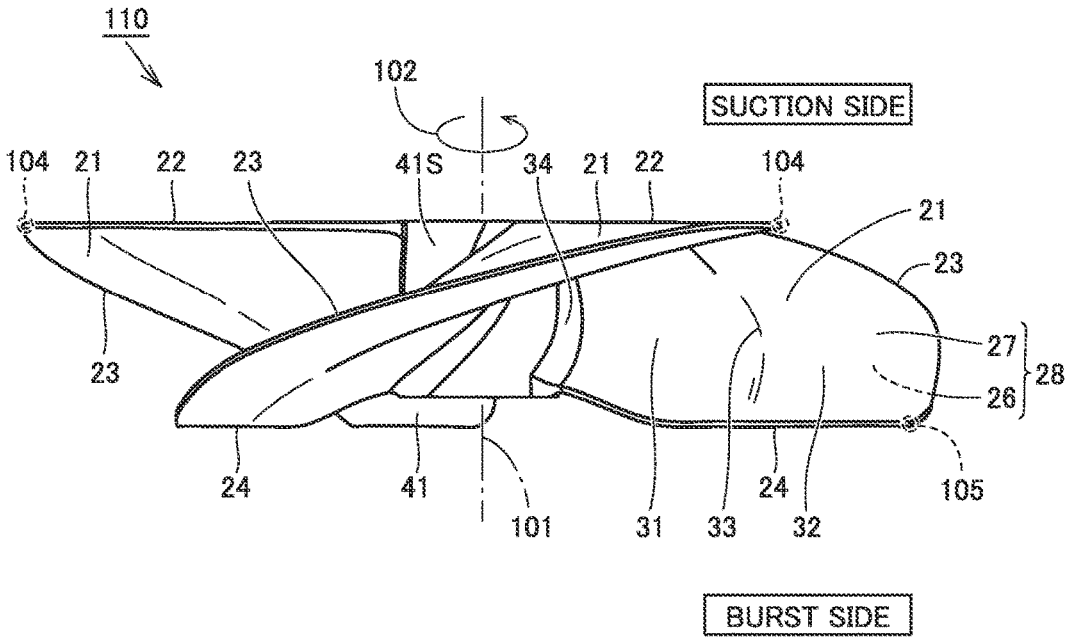
FIG. 7 is a first side view showing the propeller fan in the first embodiment.
Figure 8:
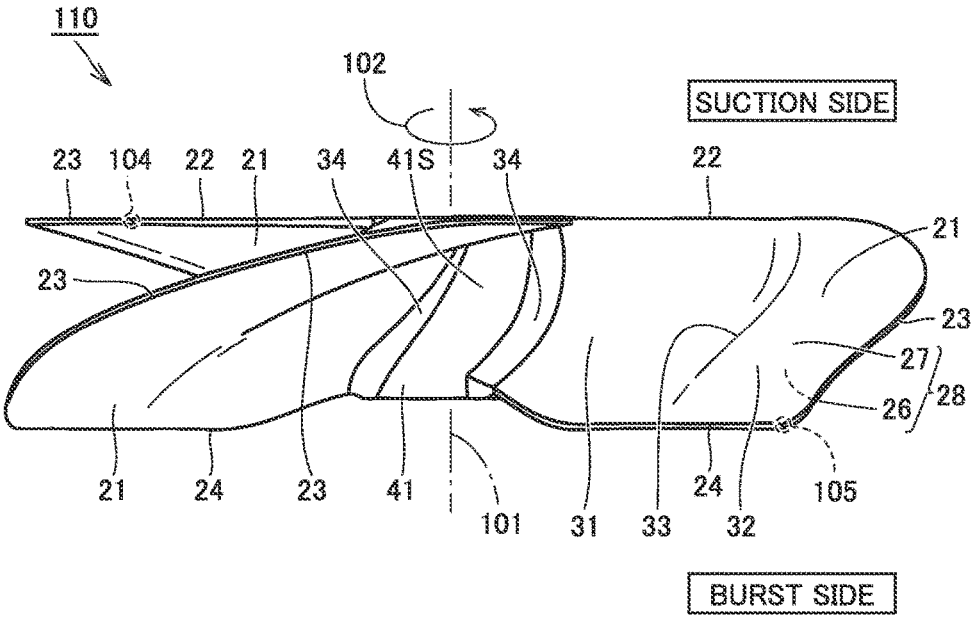
FIG. 8 is a second side view showing the propeller fan in the first embodiment.
Figure 9:
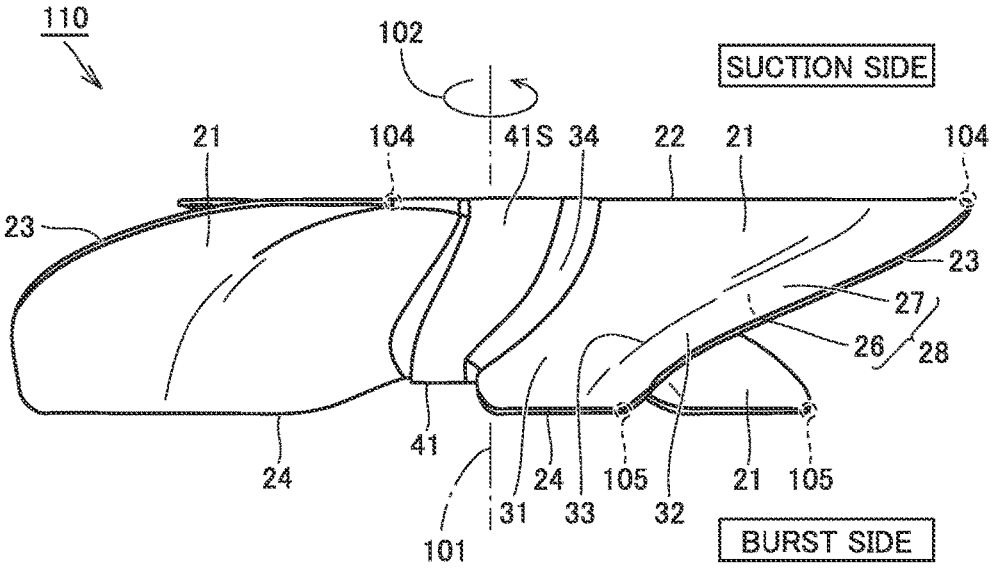
FIG. 9 is a third side view showing the propeller fan in the first embodiment.
Figure 10:
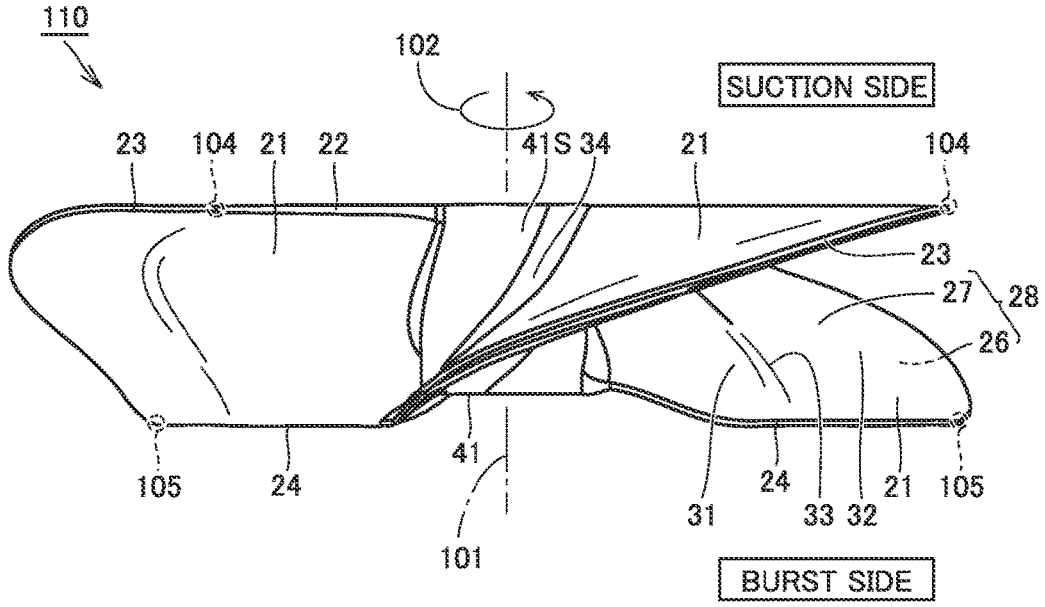
FIG. 10 is a fourth side view showing the propeller fan in the first embodiment.

A basic structure of propeller fan 110 will be described below with reference to FIGS. 2 to 10. FIG. 2 is a first perspective view of propeller fan 110 viewed from a suction side. FIG. 3 is a second perspective view of propeller fan 110 viewed from the suction side. FIG. 4 is a plan view of propeller fan 110 viewed from the suction side. FIG. 5 is a perspective view of propeller fan 110 viewed from a burst side. FIG. 6 is a plan view of propeller fan 110 viewed form the burst side. FIGS. 7 to 10 are first to fourth side views showing propeller fan 110, respectively.

Propeller fan 110 is integrally molded as a resin molded product with a synthetic resin such as an AS (acrylonitrile-styrene) resin. Propeller fan 110 has a boss hub portion 41 serving as a rotation shaft portion and blades 21A to 21C (see FIG. 2). In the following, each of blades 21A to 21C will be referred to as a blade 21 unless blades 21A to 21C are particularly distinguished.

For example, propeller fan 110 may be fabricated by twisting a sheet metal, or may be fabricated from an integrated small-thickness material formed to have a curved surface. In such a case, the propeller fan may have such a structure that blade 21A, blade 21B, and blade 21C are joined to separately molded boss hub portion 41.

Boss hub portion 41 is a portion connecting propeller fan 110 to an output shaft of a drive motor (not shown) which is a drive source. Receiving rotational motive force from the drive motor, boss hub portion 41 rotates in a prescribed direction of rotation (the direction shown with arrow 102) around virtual central axis 101. Boss hub portion 41 in the present embodiment has a cylindrical shape with bottom extending along an axial direction of central axis 101.

Blades 21A to 21C (see FIG. 2) are formed to extend outward from an outer surface 41S of boss hub portion 41 in the direction of radius of central axis 101. Blades 21A to 21C are arranged at regular intervals in the circumferential direction around the axis of rotation (central axis 101) of propeller fan 110. Blade 21B is arranged adjacent to blade 21A in the direction of rotation of propeller fan 110, and blade 21C is arranged adjacent to blade 21B in the direction of rotation of propeller fan 110.

When blades 21A to 21C rotate in the direction shown with arrow 102 around central axis 101, blades 21A to 21C rotate together with boss hub portion 41. Blades 21A to 21C send wind from the suction side to the burst side in the drawings as they rotate around central axis 101. In the present embodiment, blades 21A to 21C are identical in shape. When any blade 21 is rotated around central axis 101, that blade 21 and another blade 21 match in shape.

(Blade 21)

Blade 21 has a blade root portion 34 and a blade surface 28 extending like a plate from blade root portion 34. Blade root portion 34 is arranged between blade 21 and outer surface 41S of boss hub portion 41 (a boundary). Blade surface 28 is constituted of a positive pressure surface 26 and a negative pressure surface 27 arranged on the back of positive pressure surface 26. Positive pressure surface 26 is located on the burst side of blade surface 28 in the axial direction of central axis 101. Negative pressure surface 27 is located on the suction side of blade surface 28 in the axial direction of central axis 101. A surface of each of positive pressure surface 26 and negative pressure surface 27 is smoothly formed as a whole.

Blade surface 28 sends wind with rotation of propeller fan 110, and sends air from the suction side to the burst side. With generation of a flow of air over blade surface 28 during rotation of propeller fan 110, such pressure distribution that a pressure is relatively high over positive pressure surface 26 and a pressure is relatively low over negative pressure surface 27 is created.

On a periphery of blade surface 28, a front edge portion 22, a blade tip end portion 104 (see FIGS. 4, 6, and 7 to 10), an outer edge portion 23, a blade rear end portion 105 (see FIGS. 4, 6, and 7 to 10), and a rear edge portion 24 are annularly formed in this order from a portion on the side of the direction of rotation in blade root portion 34 toward a portion opposite in the direction of rotation in blade root portion 34.

In a plan view of blade 21, blade 21 has a shape pointed like a sickle, with blade tip end portion 104 where front edge portion 22 intersects with outer edge portion 23 being defined as the tip end. In a portion of front edge portion 22 and rear edge portion 24 on the radially inner side, a width thereof along the direction of rotation gradually decreases, and in a portion of front edge portion 22 and rear edge portion 24 on the radially outer side, a width thereof along the direction of rotation gradually increases.

Specifically, front edge portion 22 is arranged upstream in the direction of rotation (the direction shown with arrow 102) of blade 21. When propeller fan 110 is viewed in the axial direction of central axis 101 (in other words, propeller fan 110 is two-dimensionally viewed), front edge portion 22 extends from a portion on the side of the direction of rotation in blade root portion 34 outward in the direction of radius from the inner side in the direction of radius around central axis 101. Front edge portion 22 extends in the direction of rotation of propeller fan 110, as being curved from the inner side in the direction of radius outward in the direction of radius around central axis 101.

Blade tip end portion 104 is arranged on the outer side in the direction of radius in front edge portion 22 when viewed form central axis 101. Blade tip end portion 104 is a portion where front edge portion 22 and outer edge portion 23 which will be described next are connected to each other. Blade tip end portion 104 in the present embodiment is located most on the side of direction of rotation in blade 21.

Rear edge portion 24 is arranged downstream in the direction of rotation (the direction shown with arrow 102) of blade 21. When propeller fan 110 is viewed in the axial direction of central axis 101 (in other words, propeller fan 110 is two-dimensionally viewed), rear edge portion 24 extends from a portion opposite in the direction of rotation in blade root portion 34 outward in the direction of radius from the inner side in the direction of radius around central axis 101. Rear edge portion 24 is arranged as opposed to front edge portion 22 in the circumferential direction around central axis 101. Rear edge portion 24 extends in the direction of rotation of propeller fan 110, as being gently curved from the inner side in the direction of radius outward in the direction of radius around central axis 101.

Blade rear end portion 105 is arranged on the outer side in the direction of radius in rear edge portion 24 when viewed form central axis 101. Blade rear end portion 105 is a portion where rear edge portion 24 and outer edge portion 23 which will be described next are connected to each other. Blade tip end portion 104 in propeller fan 110 in the present embodiment is arranged on the inner circumferential side around central axis 101, relative to blade rear end portion 105.

Outer edge portion 23 extends along the circumferential direction around central axis 101 and is provided to connect blade tip end portion 104 and blade rear end portion 105 to each other. Outer edge portion 23 intersects with front edge portion 22 at blade tip end portion 104 located most on the side of the direction of rotation of propeller fan 110 on a line extending in the circumferential direction of outer edge portion 23 and intersects with rear edge portion 24 at blade rear end portion 105 located most opposite in the direction of rotation of propeller fan 110 on the line extending in the circumferential direction of outer edge portion 23. Outer edge portion 23 as a whole extends in an arc shape between blade tip end portion 104 and blade rear end portion 105.

Front edge portion 22, blade tip end portion 104, outer edge portion 23, blade rear end portion 105, and rear edge portion 24 constitute, together with blade root portion 34, a peripheral portion forming a periphery of blade 21. This peripheral portion (front edge portion 22, blade tip end portion 104, outer edge portion 23, blade rear end portion 105, and rear edge portion 24) are in a smooth shape not having a corner, as they are all formed in a substantially arc shape.

Referring to FIGS. 2, 3, 5, and 7 to 10, blade surface 28 is formed as being smoothly curved as a whole from the suction side to the burst side in the circumferential direction from front edge portion 22 toward rear edge portion 24. Blade 21 in propeller fan 110 in the present embodiment has such a blade shape that a thickness of a cross-sectional shape in the circumferential direction connecting front edge portion 22 and rear edge portion 24 to each other increases from front edge portion 22 and rear edge portion 24 toward a portion around a center of the blade and is greatest at a position close to front edge portion 22 relative to the center of the blade.

Referring to FIGS. 4 and 6, a virtual circumscribed circle 109 is formed around the plurality of blades 21. Circumscribed circle 109 has a radius R around central axis 101 and the plurality of blades 21 are inscribed therein. In other words, blade 21 has a maximum radius R around central axis 101 and circumscribed circle 109 is in contact with outer edge portion 23 of blade 21.

Outer edge portion 23 in the present embodiment has a maximum diameter end portion 111 (see FIG. 4) at a boundary between a position where outer edge portion 23 overlaps with circumscribed circle 109 and a position where outer edge portion 23 leaves circumscribed circle 109. Outer edge portion 23 extends from maximum diameter end portion 111 toward blade tip end portion 104 as being curved inward in the direction of radius around central axis 101.

(Inner Region 31, Outer Region 32, and Coupling Portion 33)

Figure 11:
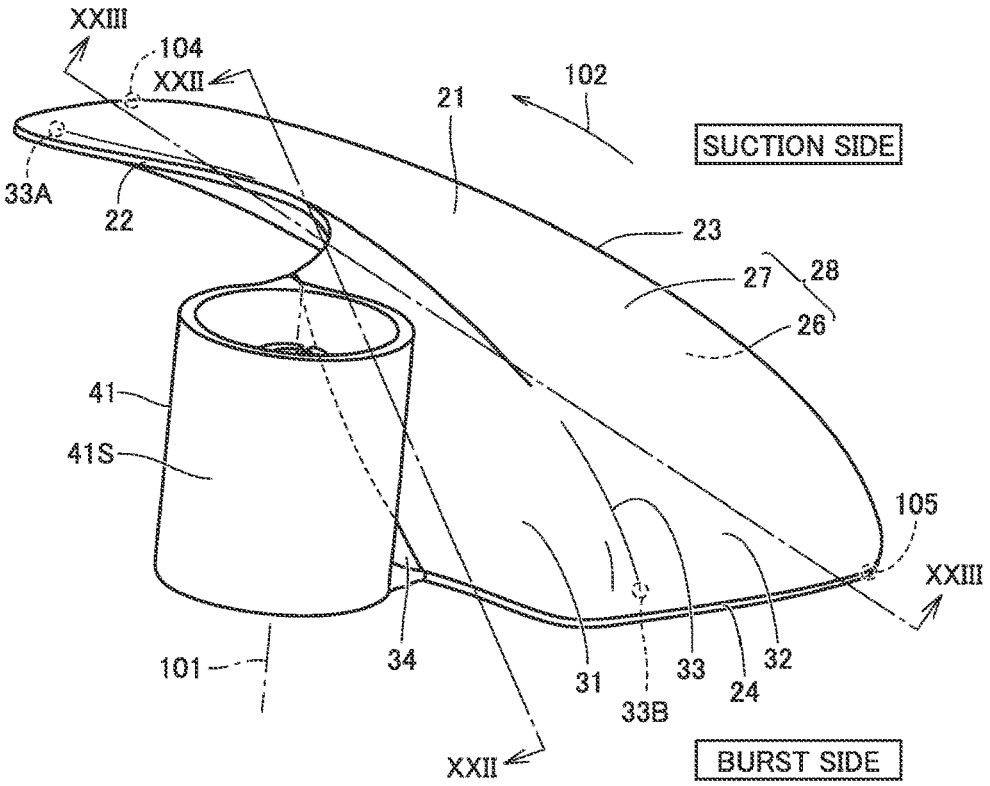
FIG. 11 is a partially enlarged perspective view of the propeller fan in the first embodiment viewed from the suction side.
Figure 12:
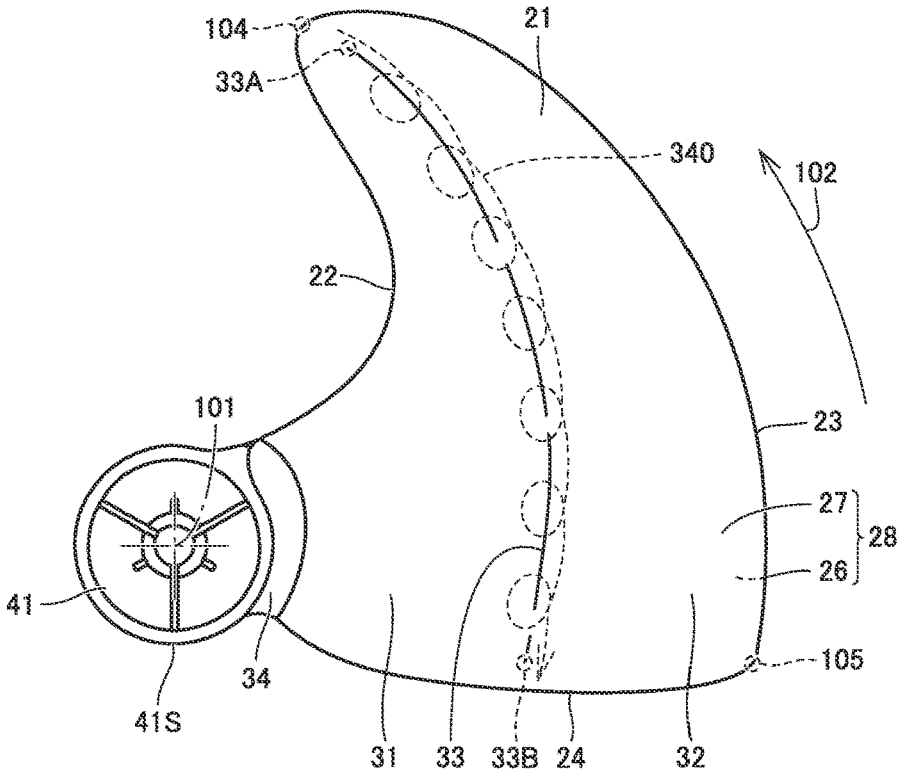
FIG. 12 is a first partially enlarged plan view of the propeller fan in the first embodiment viewed from the suction side.
Figure 13:
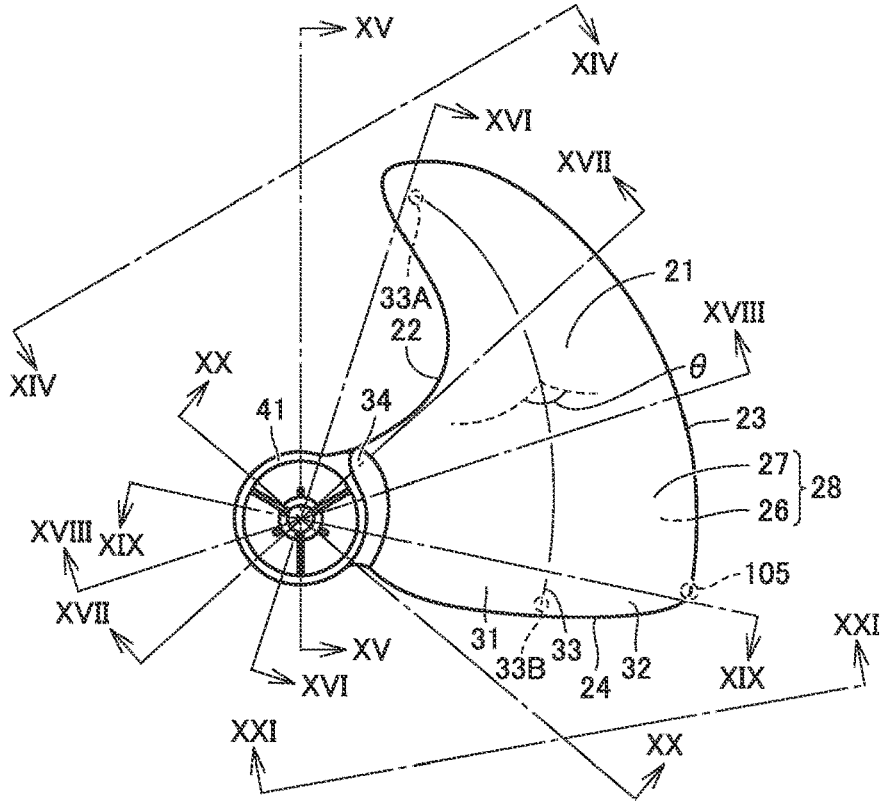
FIG. 13 is a second partially enlarged plan view of the propeller fan in the first embodiment viewed from the suction side.
Figure 14:
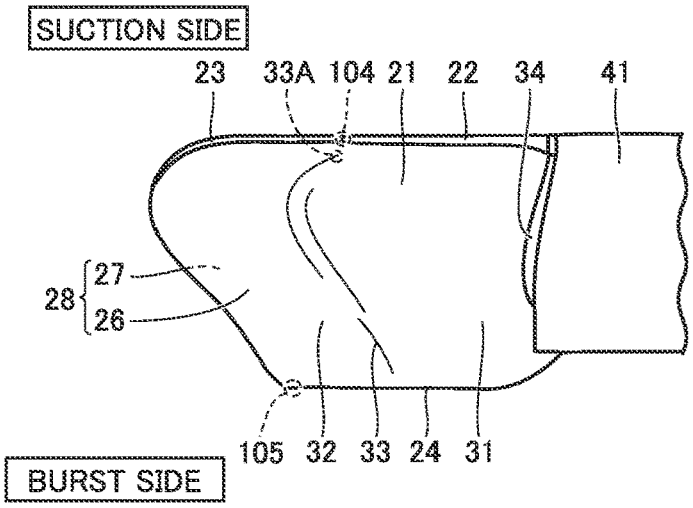
FIG. 14 is a view in a direction of an arrow along the line XIV-XIV in FIG. 13.
Figure 15:
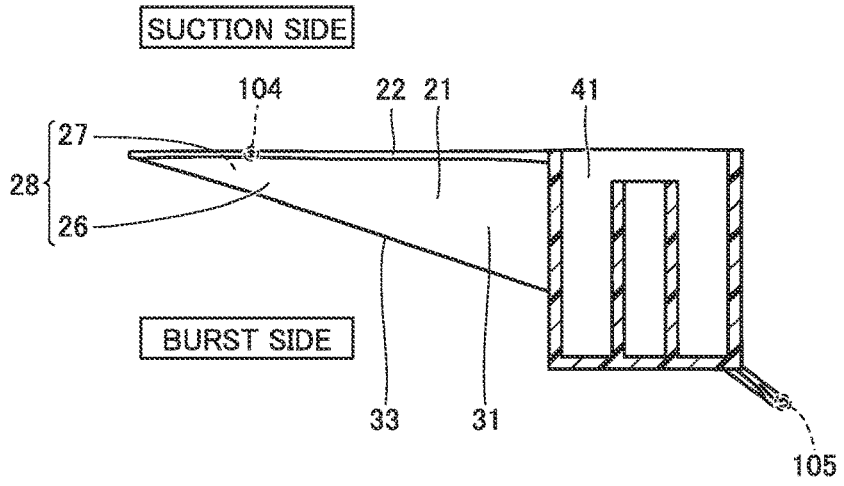
FIG. 15 is a cross-sectional view in a direction of an arrow along the line XV-XV in FIG. 13.

FIG. 11 is a partially enlarged perspective view of propeller fan 110 viewed from the suction side. FIG. 12 is a first partially enlarged plan view of propeller fan 110 viewed from the suction side. FIG. 13 is a second partially enlarged plan view of propeller fan 110 viewed from the suction side. FIG. 14 is a view in a direction of an arrow along the line XIV-XIV in FIG. 13. FIG. 15 is a cross-sectional view in a direction of an arrow along the line XV-XV in FIG. 13.

Figure 16:
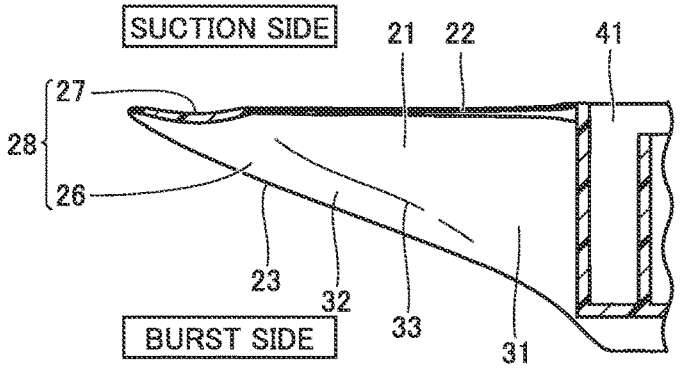
FIG. 16 is a cross-sectional view in a direction of an arrow along the line XVI-XVI in FIG. 13.
Figure 17:
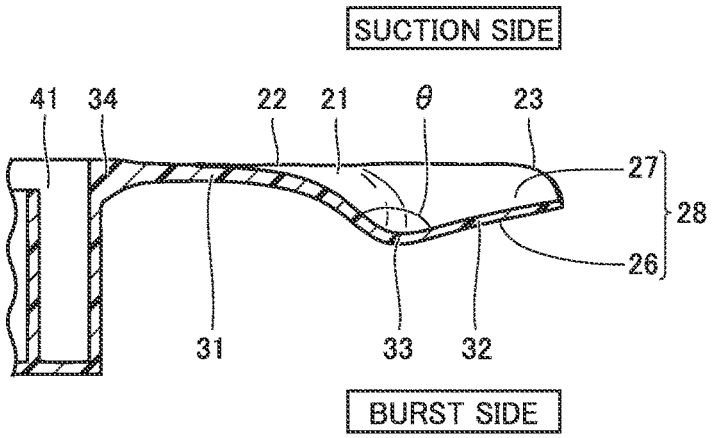
FIG. 17 is a cross-sectional view in a direction of an arrow along the line XVII-XVII in FIG. 13.
Figure 18:
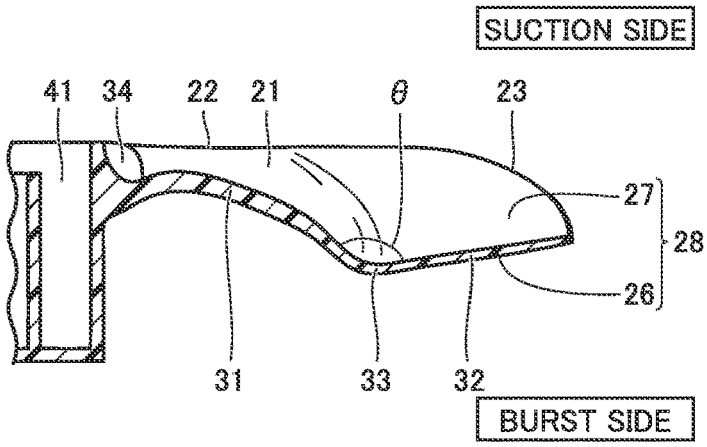
FIG. 18 is a cross-sectional view in a direction of an arrow along the line XVIII-XVIII in FIG. 13.
Figure 19:
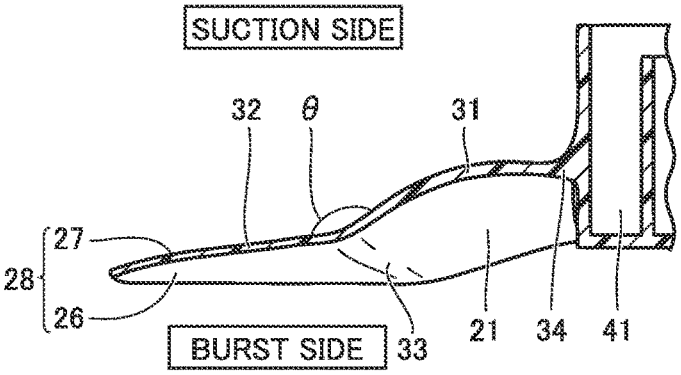
FIG. 19 is a cross-sectional view in a direction of an arrow along the line XIX-XIX in FIG. 13.
Figure 20:
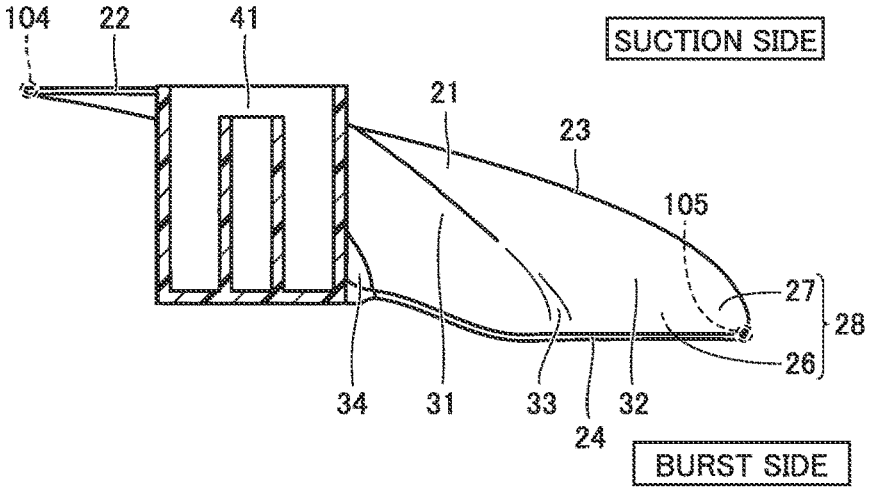
FIG. 20 is a cross-sectional view in a direction of an arrow along the line XX-XX in FIG. 13.
Figure 21:
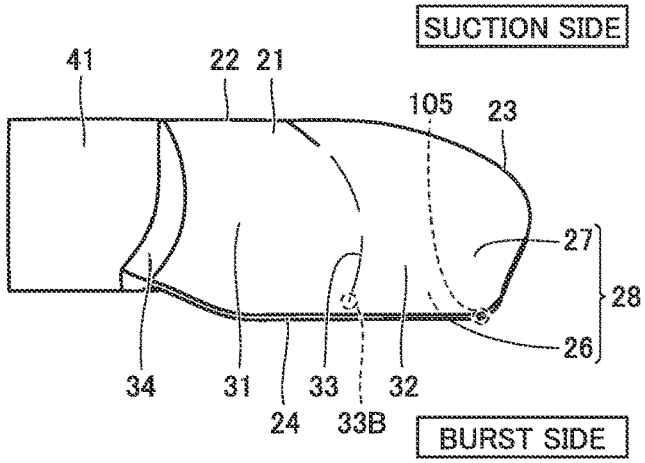
FIG. 21 is a view in a direction of an arrow along the line XXI-XXI in FIG. 13.

FIG. 16 is a cross-sectional view in a direction of an arrow along the line XVI-XVI in FIG. 13. FIG. 17 is a cross-sectional view in a direction of an arrow along the line XVII-XVII in FIG. 13. FIG. 18 is a cross-sectional view in a direction of an arrow along the line XVIII-XVIII in FIG. 13. FIG. 19 is a cross-sectional view in a direction of an arrow along the line XIX-XIX in FIG. 13. FIG. 20 is a cross-sectional view in a direction of an arrow along the line XX-XX in FIG. 13. FIG. 21 is a view in a direction of an arrow along the line XXI-XXI in FIG. 13.

Referring to FIGS. 11 and 12 (and FIGS. 2 to 10), blade surface 28 of propeller fan 110 has an inner region 31, an outer region 32, and a coupling portion 33. Inner region 31, outer region 32, and coupling portion 33 are formed in both of positive pressure surface 26 and negative pressure surface 27.

Inner region 31 includes blade root portion 34 in a part thereof and it is located on the inner side in the direction of radius of central axis 101, relative to coupling portion 33 and outer region 32. Outer region 32 includes blade rear end portion 105 in a part thereof and it is located on the outer side in the direction of radius of central axis 101, relative to coupling portion 33 and inner region 31. Positive pressure surface 26 in inner region 31 and positive pressure surface 26 in outer region 32 are formed to be different in surface shape from each other. Negative pressure surface 27 in inner region 31 and negative pressure surface 27 in outer region 32 are also formed to be different in surface shape from each other.

Coupling portion 33 couples inner region 31 and outer region 32 to each other such that a side of positive pressure surface 26 of blade surface 28 is projecting and a side of negative pressure surface 27 of blade surface 28 is recessed. Coupling portion 33 is provided to extend substantially along the direction of rotation, and extends from a front end portion 33A located most upstream in the direction of rotation in coupling portion 33 toward a rear end portion 33B located most downstream in the direction of rotation in coupling portion 33.

Coupling portion 33 is formed such that blade surface 28 is curved with slightly sharp variation in curvature from inner region 31 toward outer region 32, and couples in a curved manner, inner region 31 and outer region 32 different from each other in surface shape to each other at a boundary therebetween.

Coupling portion 33 is provided such that a curvature in a cross-sectional view along the direction of radius of blade surface 28 attains to relative maximum around the same, and appears as a curved protruding projecting portion on positive pressure surface 26 as extending like a streak from front end portion 33A toward rear end portion 33B and appears as a curved recessed groove portion on negative pressure surface 27 as extending like a streak from front end portion 33A toward rear end portion 33B.

Front end portion 33A of coupling portion 33 is located close to blade tip end portion 104 and provided as being distant from rear edge portion 24. Front end portion 33A of coupling portion 33 in the present embodiment is provided at a position displaced slightly inward in blade surface 28, from blade tip end portion 104 toward the side opposite to the direction of rotation (see FIGS. 4, 6, 11, and 12).

Front end portion 33A of coupling portion 33 may be provided close to front edge portion 22 or close to outer edge portion 23, so long as it is spaced apart from rear edge portion 24. Front end portion 33A of coupling portion 33 may be provided on front edge portion 22, on blade tip end portion 104, or on outer edge portion 23, so as to overlap with any of front edge portion 22, blade tip end portion 104, and outer edge portion 23.

Rear end portion 33B of coupling portion 33 is located close to rear edge portion 24 and provided as being spaced apart from all of front edge portion 22, blade tip end portion 104, and outer edge portion 23. Rear end portion 33B of coupling portion 33 in the present embodiment is provided at a position slightly displaced inward in blade surface 28 from a substantially central position in rear edge portion 24 in the direction of radius of central axis 101 toward the direction of rotation (see FIGS. 4, 6, 11, and 12). Rear end portion 33B of coupling portion 33 may be provided on rear edge portion 24 so as to overlap with rear edge portion 24. Coupling portion 33 may be provided from a portion in outer edge portion 23 located in midway between blade tip end portion 104 and blade rear end portion 105 to rear edge portion 24.

As shown in FIG. 12, when blade 21 rotates in a direction shown with arrow 102 around central axis 101, a blade tip end vortex 340 is generated over blade surface 28, which flows from each of front edge portion 22, blade tip end portion 104, and outer edge portion 23 toward rear edge portion 24, around a portion around blade tip end portion 104. This blade tip end vortex 340 is generated over each of positive pressure surface 26 and negative pressure surface 27. Preferably, coupling portion 33 is provided to extend along a flow of this blade tip end vortex 340.

(Degree of Curving of Coupling Portion 33)

As shown in FIGS. 13 to 15, coupling portion 33 in the present embodiment is provided such that front end portion 33A of coupling portion 33 does not reach (does not overlap with) any of front edge portion 22, blade tip end portion 104, and outer edge portion 23. A curve originating from presence of coupling portion 33 appears in none of front edge portion 22, blade tip end portion 104, and outer edge portion 23, and blade surface 28 (positive pressure surface 26 and negative pressure surface 27) located around front end portion 33A of coupling portion 33 is formed to be flat at 180° in a cross-sectional view along the direction of radius of central axis 101, which passes through front end portion 33A.

As shown in FIGS. 13 and 16, coupling portion 33 is provided such that blade surface 28 (positive pressure surface 26 and negative pressure surface 27) relatively sharply curves in the vicinity of front end portion 33A in coupling portion 33, on the side opposite to the direction of rotation. As shown in FIGS. 13, 17, and 18, coupling portion 33 is provided such that an interior angle θ virtually formed on the side of negative pressure surface 27 of coupling portion 33 is gradually smaller from front end portion 33A toward a portion around the center of coupling portion 33 in the direction of rotation. Preferably, this interior angle θ is formed to be smallest around the center of coupling portion 33 in the direction of rotation.

As shown in FIGS. 13 and 19, coupling portion 33 is provided such that interior angle θ virtually formed on the side of negative pressure surface 27 of coupling portion 33 increases gradually from the portion around the center of coupling portion 33 in the direction of rotation toward rear end portion 33B. As shown in FIGS. 13, 20, and 21, coupling portion 33 in the present embodiment is provided such that rear end portion 33B of coupling portion 33 does not reach (does not overlap with) rear edge portion 24. A curve originating from presence of coupling portion 33 does not appear in rear edge portion 24, and blade surface 28 (positive pressure surface 26 and negative pressure surface 27) located around rear end portion 33B of coupling portion 33 is formed to be flat at 180° in a cross-sectional view along the direction of radius of central axis 101, which passes through rear end portion 33B.

(Stagger Angle θA, θB)

Figure 22:
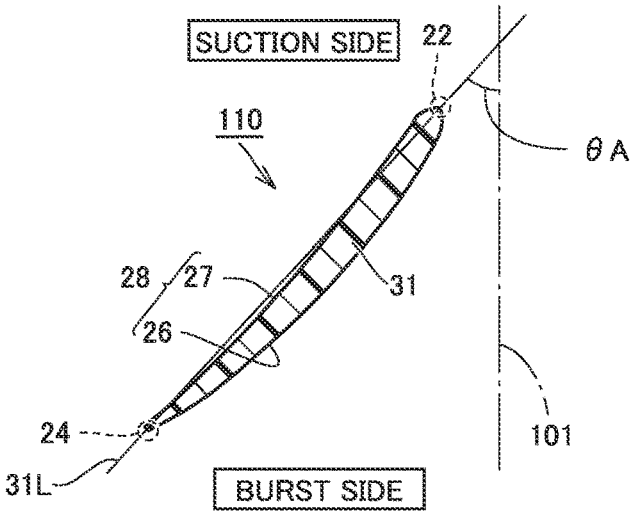
FIG. 22 is a cross-sectional view in a direction of an arrow along the line XXII-XXII in FIG. 11.

FIG. 22 is a cross-sectional view in a direction of an arrow along XXII-XXII in FIG. 11. As shown in FIGS. 11 and 22, inner region 31 in blade surface 28 located on the inner side in the direction of radius relative to coupling portion 33 has a prescribed stagger angle θA (see FIG. 22). By connecting a point on front edge portion 22 in inner region 31 and a point on rear edge portion 24 in inner region 31 to each other, a virtual straight line 31L (see FIG. 22) is formed. Stagger angle θA refers to an angle formed by virtual straight line 31L and central axis 101 therebetween.

As shown in FIG. 22, inner region 31 of blade 21 in the present embodiment is curved such that a bulge portion of inner region 31 is distant from virtual straight line 31L toward the burst side with front edge portion 22 and rear edge portion 24 being defined as opposing ends and has a warped shape such that the side of positive pressure surface 26 of blade surface 28 (inner region 31) is projecting and the side of negative pressure surface 27 of blade surface 28 (inner region 31) is recessed.

Blade 21 in the present embodiment is formed such that stagger angle θA in a portion on the inner side in the direction of radius relative to coupling portion 33 in blade surface 28 is smaller toward boss hub portion 41.

Figure 23:
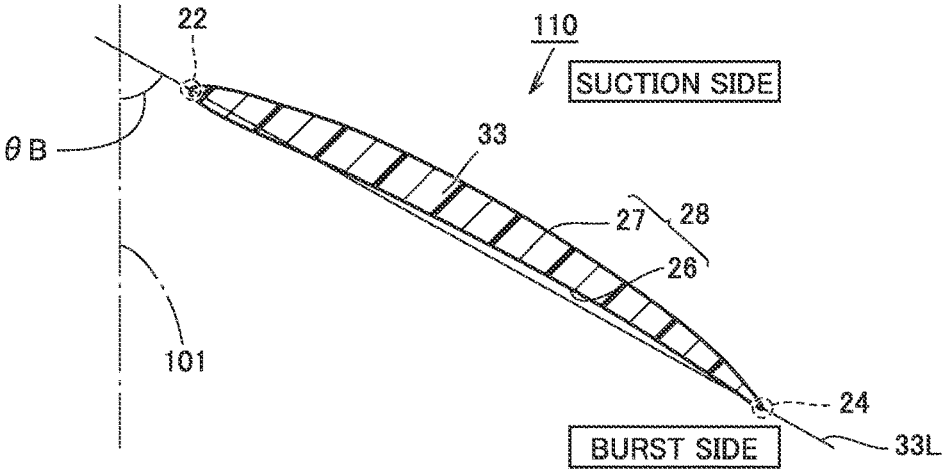
FIG. 23 is a cross-sectional view in a direction of an arrow along the line XXIII-XXII in FIG. 11.

FIG. 23 is a cross-sectional view in a direction of an arrow along the line XXIII-XXIII in FIG. 11. As shown in FIGS. 11 and 23, outer region 32 in blade surface 28 located on the outer side in the direction of radius relative to coupling portion 33 has a prescribed stagger angle θB (see FIG. 23). By connecting a point on front edge portion 22 in outer region 32 and a point on rear edge portion 24 in outer region 32 to each other, a virtual straight line 33L is formed (see FIG. 23). Stagger angle θB refers to an angle formed by virtual straight line 33L and central axis 101 therebetween.

As shown in FIG. 23, outer region 32 of blade 21 in the present embodiment is curved such that a bulge portion of outer region 32 is distant from virtual straight line 33L toward the suction side with front edge portion 22 and rear edge portion 24 being defined as opposing ends and has a warped shape such that the side of positive pressure surface 26 of blade surface 28 (outer region 32) is recessed and the side of negative pressure surface 27 of blade surface 28 (outer region 32) is projecting.

Referring to FIGS. 22 and 23, blade 21 in the present embodiment is formed such that stagger angle θA is smaller than stagger angle θB. Blade 21 is formed such that stagger angle θA in blade root portion 34 is also smaller than stagger angle θB in outer edge portion 23. Furthermore, blade 21 has a warped shape in blade root portion 34 and inner region 31 such that the side of positive pressure surface 26 is projecting and the side of negative pressure surface 27 is recessed, and has a warped shape in outer region 32 and outer edge portion 23 such that the side of positive pressure surface 26 is recessed and the side of negative pressure surface 27 is projecting (a reverse camber structure).

(Function and Effect)

Figure 24:
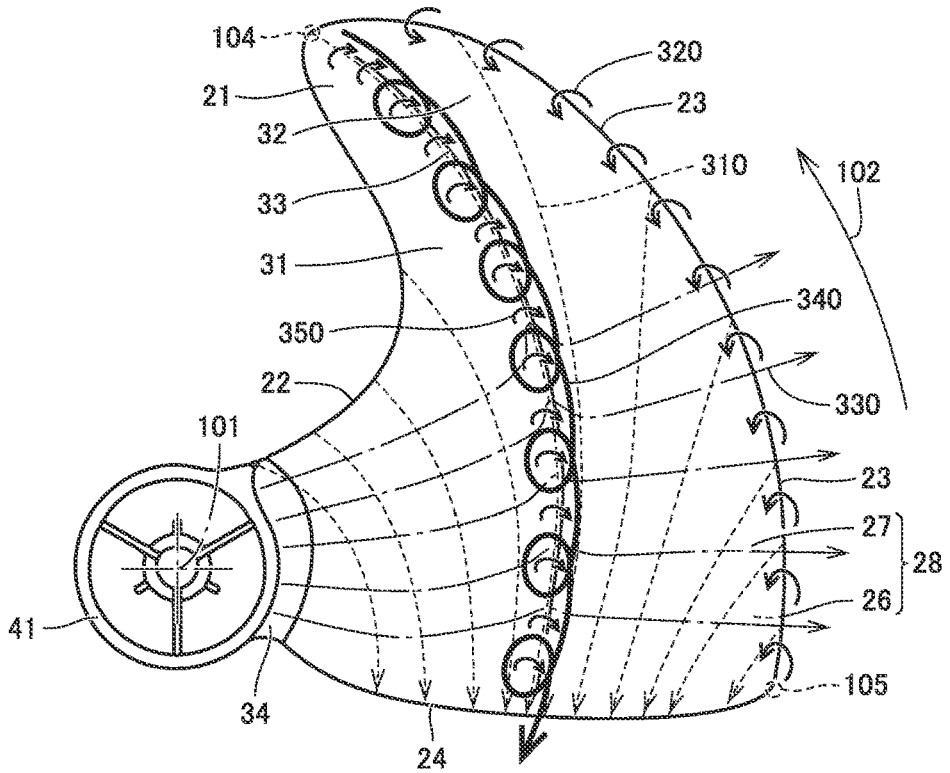
FIG. 24 is a plan view of a manner during rotation of a blade of the propeller fan in the first embodiment, viewed from the suction side.
Figure 25:
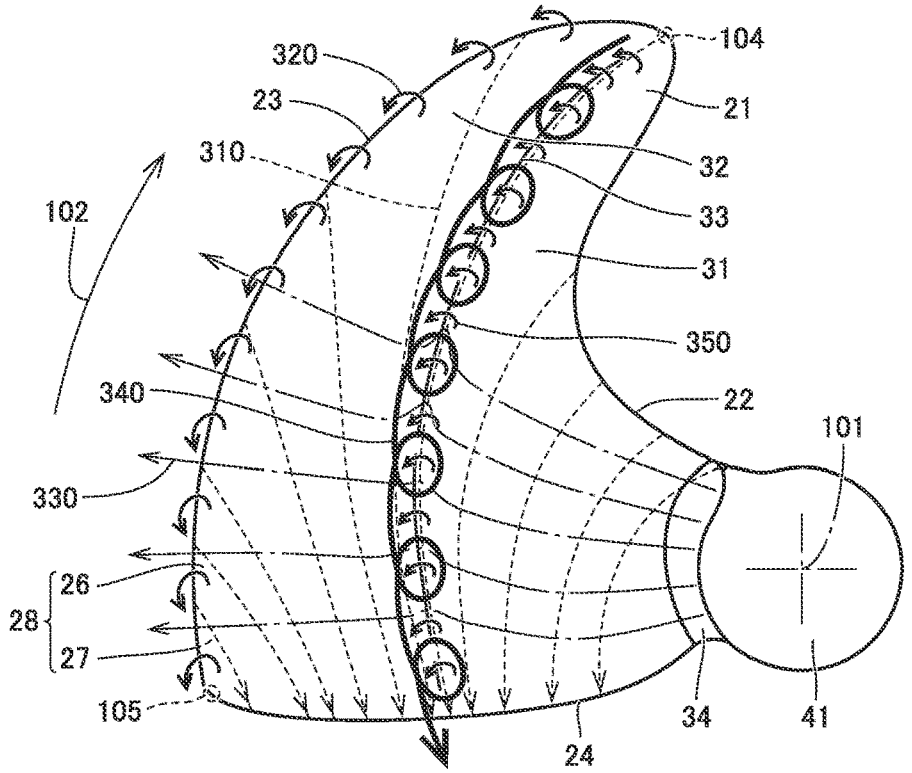
FIG. 25 is a plan view of a manner during rotation of a blade of the propeller fan in the first embodiment, viewed from the burst side.
Figure 26:
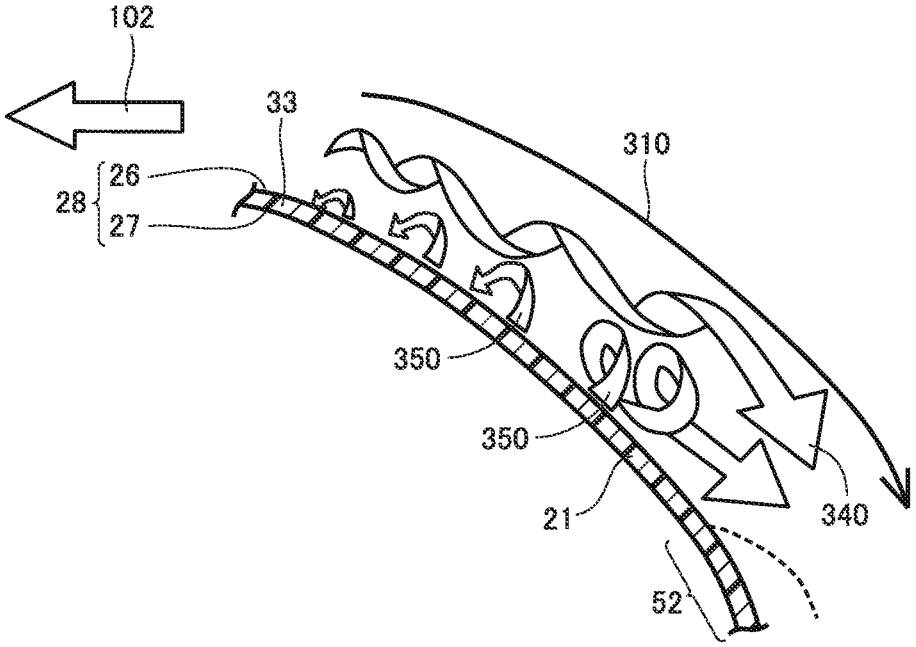
FIG. 26 is a cross-sectional view of the propeller fan in the first embodiment virtually cut along a coupling portion, which is a diagram showing a manner during rotation of a blade of the fan.

A function and effect of fluid feeder 510 (see FIG. 1) and propeller fan 110 in the present embodiment will be described with reference to FIGS. 24 to 26. FIG. 24 is a plan view of a manner during rotation of blade 21 of propeller fan 110 viewed from the suction side. FIG. 25 is a plan view of a manner during rotation of blade 21 of propeller fan 110 viewed from the burst side. FIG. 26 is a cross-sectional view of propeller fan 110 virtually cut along coupling portion 33, which is a diagram showing a manner during rotation of blade 21 of propeller fan 110.

As shown in FIGS. 24 and 25, during use of fluid feeder 510 (see FIG. 1), blade 21 of propeller fan 110 rotates in a direction shown with arrow 102 around central axis 101. Over blade surface 28 (both of positive pressure surface 26 and negative pressure surface 27) of blade 21 in propeller fan 110 in the present embodiment, blade tip end vortex 340, a mainstream 310, a secondary flow 330, a horseshoe vortex 320, and a horseshoe vortex 350 are generated as flows of air.

Blade tip end vortex 340 is formed when blade tip end portion 104 mainly collides with air during rotation of propeller fan 110. Blade tip end vortex 340 originates mainly from blade tip end portion 104 and flows from blade tip end portion 104, a portion close to blade tip end portion 104 of front edge portion 22 located in the vicinity of blade tip end portion 104, and a portion close to blade tip end portion 104 of outer edge portion 23 located in the vicinity of blade tip end portion 104 over blade surface 28 toward rear edge portion 24.

Mainstream 310 is formed on a further upper side of blade surface 28 than blade tip end vortex 340 during rotation of propeller fan 110. In other words, mainstream 310 is formed on an opposite side of blade surface 28 with respect to a surface layer of blade surface 28 over which blade tip end vortex 340 is formed, with blade tip end vortex 340 lying therebetween. Mainstream 310 flows in from front edge portion 22, blade tip end portion 104, and outer edge portion 23 to blade surface 28, and flows toward rear edge portion 24.

Horseshoe vortex 320 is generated along outer edge portion 23 so as to flow from positive pressure surface 26 into negative pressure surface 27, owing to a pressure difference between positive pressure surface 26 and negative pressure surface 27 caused by rotation of propeller fan 110. Secondary flow 330 is generated to flow from boss hub portion 41 toward outer edge portion 23, owing to centrifugal force caused by rotation of the propeller fan. Horseshoe vortex 350 is generated as secondary flow 330 flows across a portion where coupling portion 33 is provided in blade surface 28.

As described above, front end portion 33A of coupling portion 33 in the present embodiment is provided at a position slightly displaced inward in blade surface 28 from blade tip end portion 104 toward the side opposite to the direction of rotation, and rear end portion 33B of coupling portion 33 is provided at a position slightly displaced inward in blade surface 28 from a substantially central position in rear edge portion 24 in the direction of radius of central axis 101 toward the direction of rotation (see FIGS. 4, 6, 11, and 12). According to such a construction, coupling portion 33 is formed to extend substantially along the direction of flow of mainstream 310 and blade tip end vortex 340.

As shown in FIG. 26, coupling portion 33 coupling inner region 31 and outer region 32 to each other in a curved manner has horseshoe vortex 350 and blade tip end vortex 340 held in the vicinity of coupling portion 33 at a surface layer of blade surface 28, and suppress separation of horseshoe vortex 350 and blade tip end vortex 340 from the surface layer of blade surface 28. Coupling portion 33 also suppresses development or fluctuation of horseshoe vortex 350 which is generated in the vicinity of coupling portion 33 and flows as being held by coupling portion 33.

Blade tip end vortex 340 which is generated in the vicinity of blade tip end portion 104 and flows as being held by coupling portion 33 and horseshoe vortex 350 which is generated in the vicinity of coupling portion 33 and flows as being held by coupling portion 33 provide kinetic energy to mainstream 310. Mainstream 310 provided with kinetic energy is less likely to separate from blade surface 28 on the downstream side over blade surface 28. Consequently, a separation region 52 can be made smaller or eliminated. Propeller fan 110 can achieve lowering in noise generated during rotation owing to suppression of separation, and increase in quantity of wind as compared with a case not provided with coupling portion 33 and resulting higher efficiency.

Figure 27:
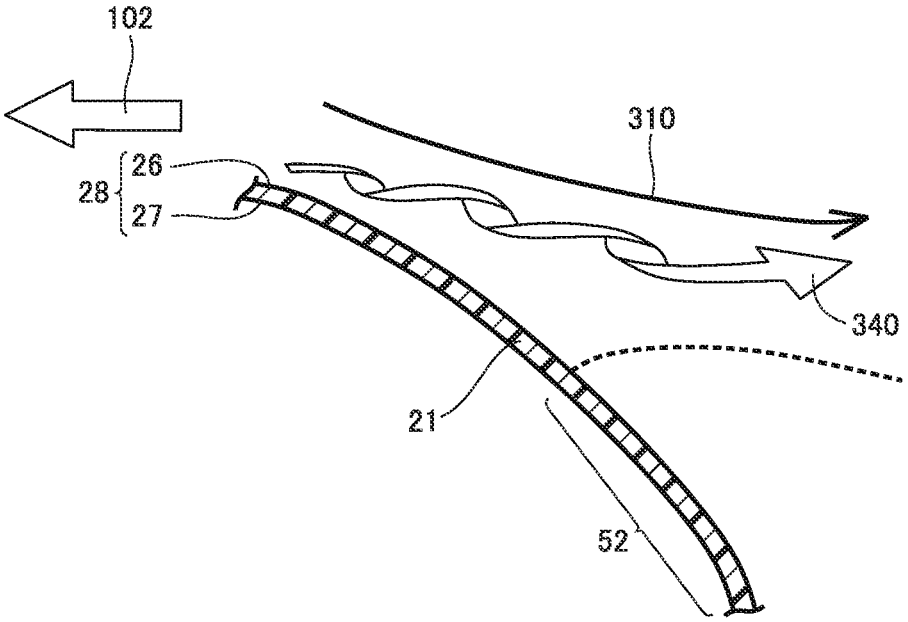
FIG. 27 is a cross-sectional view of a general propeller fan virtually cut along a portion corresponding to a coupling portion in the first embodiment, which is a diagram showing a manner during rotation of a blade of this propeller fan.

FIG. 27 is a cross-sectional view of a general propeller fan virtually cut along a portion corresponding to coupling portion 33 of propeller fan 110 in the present embodiment, which is a diagram showing a manner during rotation of a blade of this propeller fan. This general propeller fan is constructed substantially similarly to propeller fan 110, except for not having coupling portion 33.

In such a general propeller fan, mainstream 310 and blade tip end vortex 340 generated over each of positive pressure surface 26 and negative pressure surface 27 of blade surface 28 flow along blade surface 28 on the upstream side over blade surface 28 close to front edge portion 22, blade tip end portion 104, and outer edge portion 24, however, it is less likely to flow along blade surface 28 on the downstream side over blade surface 28 close to rear edge portion 24. Since no kinetic energy is provided from blade tip end vortex 340 to mainstream 310 on the downstream side, separation region 52 where mainstream 310 separates from blade surface 28 is likely. In this propeller fan, it is difficult to lower noise generated during rotation. Such tendency is noticeable in particular over negative pressure surface 27, of positive pressure surface 26 and negative pressure surface 27.

During rotation of propeller fan 110 in the present embodiment, in the vicinity of a region where coupling portion 33 is provided, mainstream 310 flows from the outer side in the direction of radius toward the inner side in that direction. Therefore, by forming coupling portion 33 substantially along a flow of mainstream 310 and adopting a blade shape also for a region where coupling portion 33 is provided, the blade shape can be realized for all flows of mainstream 310 and hence wind can more efficiency be sent.

As coupling portion 33 is provided such that blade surface 28 is smoothly curved from the side of inner region 31 toward outer region 32, a degree of freedom in terms of design can be ensured in a shape of blade surface 28. For example, in order to suppress generation of a horseshoe vortex, such a complicated shape of blade surface 28 that a height of blade surface 28 is increased around boss hub portion 41 while a sickle shape decreasing in width of front edge portion 22 and outer edge portion 23 toward blade tip end portion 104 is maintained can also be implemented.

As described above with reference to FIG. 13, in propeller fan 110 in the present embodiment, blade surface 28 (positive pressure surface 26 and negative pressure surface 27) located around front end portion 33A of coupling portion 33 is formed to be flat at 180° in a cross-sectional view along the direction of radius of central axis 101, which passes through front end portion 33A, and furthermore, blade surface 28 (positive pressure surface 26 and negative pressure surface 27) located around rear end portion 33B of coupling portion 33 is formed to be flat at 180° in a cross-sectional view along the direction of radius of central axis 101, which passes through rear end portion 33B. According to such a construction, since wind which flows into blade surface 28 and wind which flows out of blade surface 28 are not disturbed, resistance against mainstream 310 can be lessened. Such a feature is desirably provided as necessary.

As described above with reference to FIGS. 22 and 23, propeller fan 110 in the present embodiment is formed such that blade 21 has stagger angle θA smaller than stagger angle θB. Blade 21 is formed to have stagger angle θA in blade root portion 34 also smaller than stagger angle θB in outer edge portion 23. According to such a construction, a peak of a wind velocity on the outer side in the direction of radius which is a cause of uncomfortableness can be adjusted.

As described above with reference to FIGS. 22 and 23, blade 21 in the present embodiment has a warped shape in blade root portion 34 and inner region 31 such that the side of positive pressure surface 26 is projecting and the side of negative pressure surface 27 is recessed and has a warped shape in outer region 32 and outer edge portion 23 such that the side of positive pressure surface 26 is recessed and the side of negative pressure surface 27 is projecting. Such a construction can be referred to as a reverse camber structure.

In a general propeller fan, owing to its structure, a peripheral velocity in a portion on the inner side in the direction of radius is low and a peripheral velocity in a portion on the outer side in the direction of radius is high. An inflow angle of air is different between the side of the blade root portion located on the inner side in the direction of radius and the side of the outer edge portion (a blade end side) located on the outer side in the direction of radius. Therefore, as an inflow angle (a camber angle) on the side of the outer edge portion (the blade end side) is designed such that inflow of air is good on the side of the outer edge portion (the blade end side), good inflow of air is less likely on the side of the blade root portion, and separation may occur in a flow of air on the side of the blade root portion (vice versa).

Therefore, as in propeller fan 110 in the present embodiment, a camber angle is varied appropriately on the side of blade root portion 34 located on the inner side in the direction of radius and the side of outer edge portion 23 (the blade end side) located on the outer side in the direction of radius and the reverse camber structure is provided in a region where an inflow angle of air on the side of blade root portion 34 is large, so that air can flow in at an appropriate inflow angle with respect to blade surface 28 over the entire region in the direction of radius and in addition separation of a flow of air can be prevented.

A construction of blade surface 28 as having a warped shape such that the side of positive pressure surface 26 is projecting and the side of negative pressure surface 27 is recessed in blade root portion 34 and inner region 31 and having a warped shape such that the side of positive pressure surface 26 is recessed and the side of negative pressure surface 27 is projecting in outer region 32 and outer edge portion 23 (the reverse camber structure) can be enabled independently of such a technical concept that coupling portion 33 is provided in blade surface 28.

Even when coupling portion 33 is not provided in the propeller fan, according to blade surface 28 having the reverse camber structure, air can flow in at an appropriate inflow angle with respect to blade surface 28 over the entire region in the direction of radius, and the object to prevent separation of a flow of air can be achieved.

As described above with reference to FIG. 22, blade 21 in the present embodiment is formed such that stagger angle θA in a portion on the inner side in the direction of radius relative to coupling portion 33 in blade surface 28 is smaller toward boss hub portion 41. According to such a construction, on the inner circumferential side around central axis 101, capability to send wind is higher toward central axis 101.

In a general propeller fan, there is a great difference in distribution of a wind velocity at the time of blowing off in the direction of radius. A wind velocity is high on the outer side in the direction of radius and highest around the tip end portion of the blade, and the wind velocity has an extreme peak point. A difference in wind velocity is excessive between a portion where blade 21 does not function in the vicinity of central axis 101 and a portion where blade 21 most functions, and variation in wind velocity at the time of blowing off is caused, which is a major cause of uncomfortableness.

In contrast, according to propeller fan 110 in the present embodiment, a difference in quantity of wind (wind velocity) between the inner circumferential side and the outer circumferential side can be lessened. Propeller fan 110 can achieve more uniform blowing and uncomfortableness of a person who has received wind can be suppressed. With propeller fan 110, a space which can be occupied by a fan can be utilized as much as possible and strong blowing can also be achieved. Such a feature is desirably provided as necessary.

From a point of view of more uniform blowing by propeller fan 110, blade 21 is desirably formed such that an area of a blade in a portion on the inner side in the direction of radius relative to coupling portion 33 (inner region 31) in blade 21 is equal to or greater than an area of a blade in a portion on the outer side in the direction of radius relative to coupling portion 33 (outer region 32) in blade surface 28.

With such a construction, capability to send wind in the portion on the inner side in the direction of radius relative to coupling portion 33 (inner region 31) in blade 21 can be enhanced, and capability to send wind in the portion on the outer side in the direction of radius relative to coupling portion 33 (outer region 32) in blade surface 28 can be lowered. A difference in quantity of wind (wind velocity) between the inner circumferential side and the outer circumferential side can be lessened, more uniform blowing by propeller fan 110 can be achieved, and uncomfortableness of a person who has received wind can be suppressed. Such a feature is desirably provided as necessary.

Variation of First Embodiment

Coupling portion 33 of propeller fan 110 in the first embodiment described above is formed such that blade surface 28 is curved with slightly sharp variation in curvature from inner region 31 toward outer region 32 and couples in a curved manner, inner region 31 and outer region 32 different from each other in surface shape to each other at a boundary therebetween.

Figure 28:
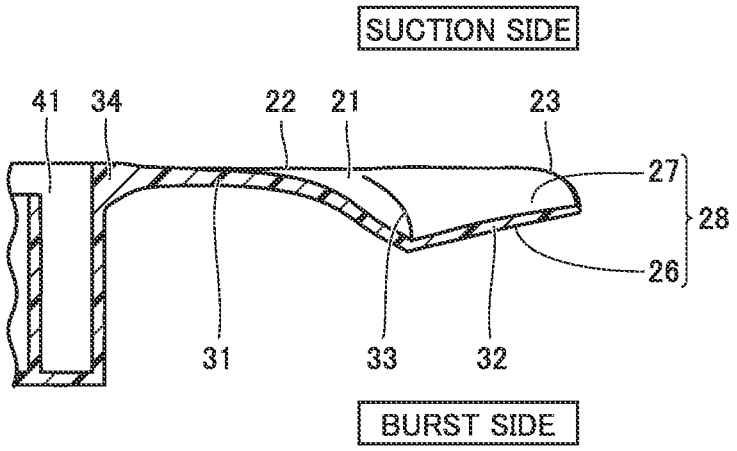
FIG. 28 is a cross-sectional view of a part of a propeller fan in a variation of the first embodiment virtually cut along a direction of radius of rotation.

As shown in FIG. 28, coupling portion 33 may be formed such that blade surface 28 is curved with slightly sharp variation in curvature from inner region 31 toward outer region 32 and may couple in a bent manner, inner region 31 and outer region 32 different from each other in surface shape to each other at a boundary therebetween. According to such a construction as well, an effect the same as that of propeller fan 110 in the first embodiment described above can be obtained.

If blade surface 28 is bent too extremely in coupling portion 33, that shape of coupling portion 33 is likely to affect a secondary flow which is not a mainstream generated over blade surface 28. In a case of maximum use of the same space as well, desirably, an appropriate degree of curving or bending is determined in consideration of a flow of air in coupling portion 33.

Second Embodiment

Figure 29:
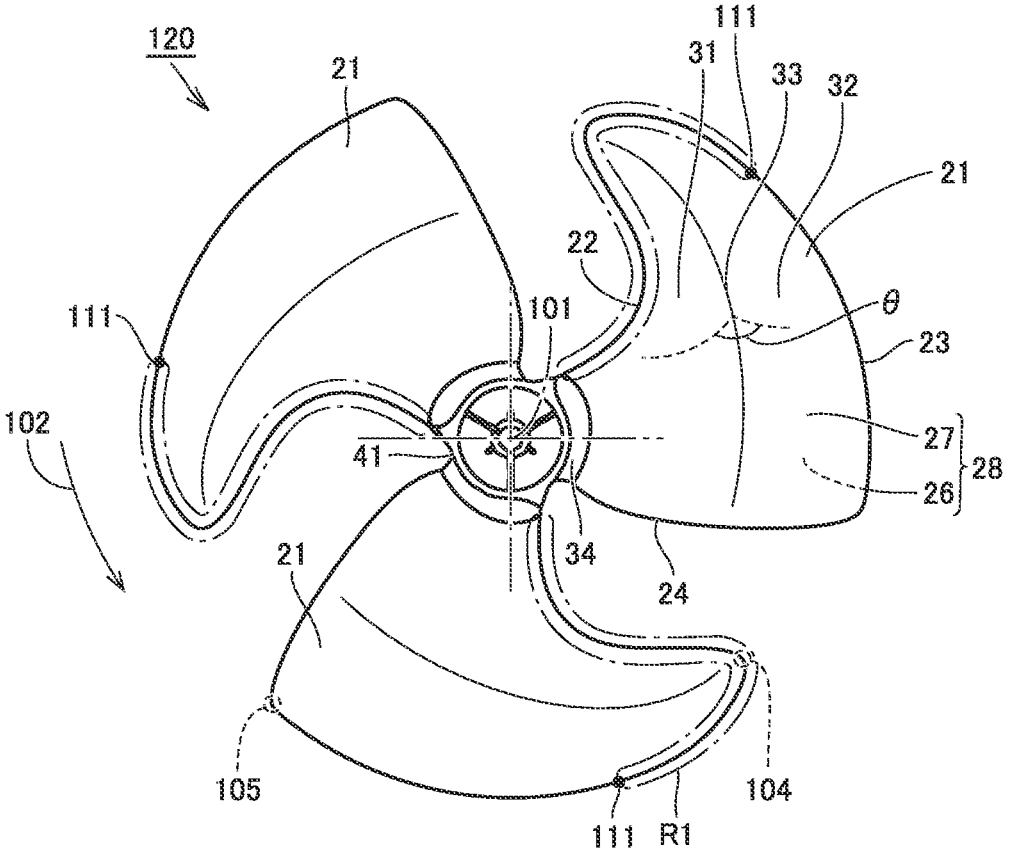
FIG. 29 is a plan view of a propeller fan in a second embodiment viewed from the suction side.
Figure 30:
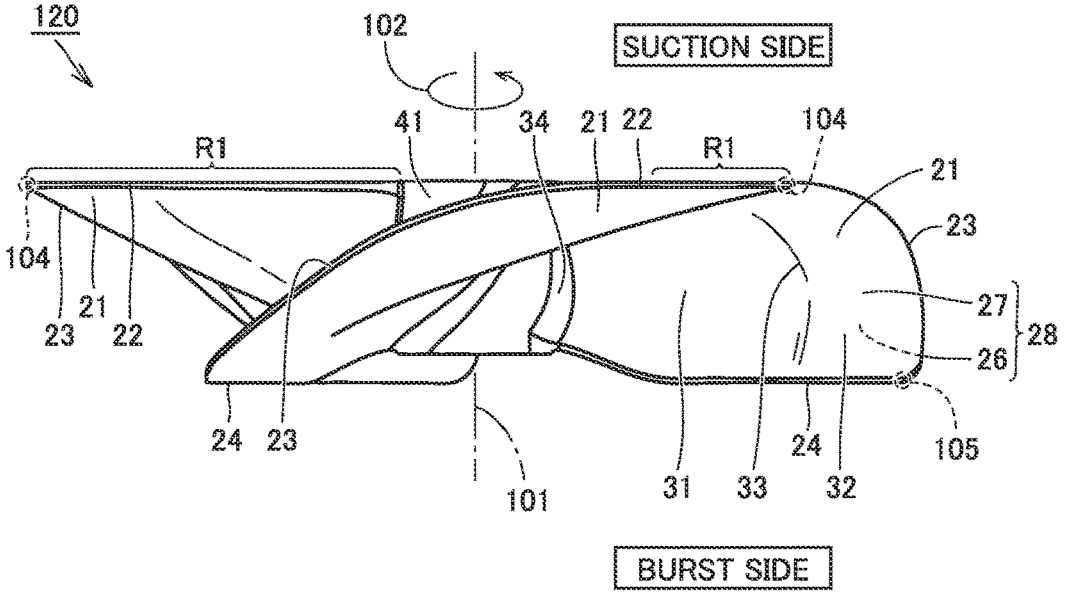
FIG. 30 is a side view showing the propeller fan in the second embodiment.

A propeller fan 120 in the present embodiment will be described with reference to FIGS. 29 and 30. In addition to the features of propeller fan 110 in the first embodiment described above, propeller fan 120 is formed such that, in a region R1 from front edge portion 22 to a portion of outer edge portion 23 close to blade tip end portion 104, these maintain a constant height in the axial direction of central axis 101. This region R1 in the present embodiment is formed in the entire region over front edge portion 22 and formed in a portion close to blade tip end portion 104 relative to maximum diameter end portion 111 over outer edge portion 23.

As a reference surface for a height in the axial direction, a virtual plane orthogonal to central axis 101 on the burst side is defined. In this case, front edge portion 22 of a general propeller fan is provided such that a height of front edge portion 22 from the virtual plane is higher on the outer circumferential side around central axis 101 and lower on the inner circumferential side. In this case, a height of blade 21 from the virtual plane is extremely smaller on the inner circumferential side than on the outer circumferential side around central axis 101, and capability to send wind of blade 21 on the inner circumferential side is extremely low.

In contrast, in propeller fan 120 in the present embodiment, front edge portion 22 has a constant height between the inner circumferential side and the outer circumferential side around central axis 101. With such a construction, on the inner circumferential side around central axis 101, a height of blade 21 from the virtual plane is set to be great so that capability to send wind can be improved. Thus, as compared with a general propeller fan having a blade equal in diameter and height, a quantity of wind sent from the propeller fan can significantly be increased.

By enhancing capability to send wind on the inner circumferential side around central axis 101, efficiency in sending wind with respect to a volume of an occupied space virtually formed as a result of rotation of the plurality of blades 21 can be enhanced. In this case, in sending wind of the same quantity of wind as well, the number of rotations of blade 21 can be suppressed to a lower value and hence it is advantage in terms of energy saving or lowering in noise.

By enhancing capability to send wind on the inner circumferential side around central axis 101, a difference in quantity of wind (wind velocity) between the inner circumferential side and the outer circumferential side can be lessened. Thus, more uniform blowing from propeller fan 120 can be achieved and uncomfortableness of a person who has received wind can be prevented.

Variation of Second Embodiment

In propeller fan 120 in the second embodiment described above, region R1 from front edge portion 22 to the portion of outer edge portion 23 close to blade tip end portion 104 is formed in the entire region over front edge portion 22 and formed in the portion close to blade tip end portion 104 relative to maximum diameter end portion 111 over outer edge portion 23.

Figure 31:
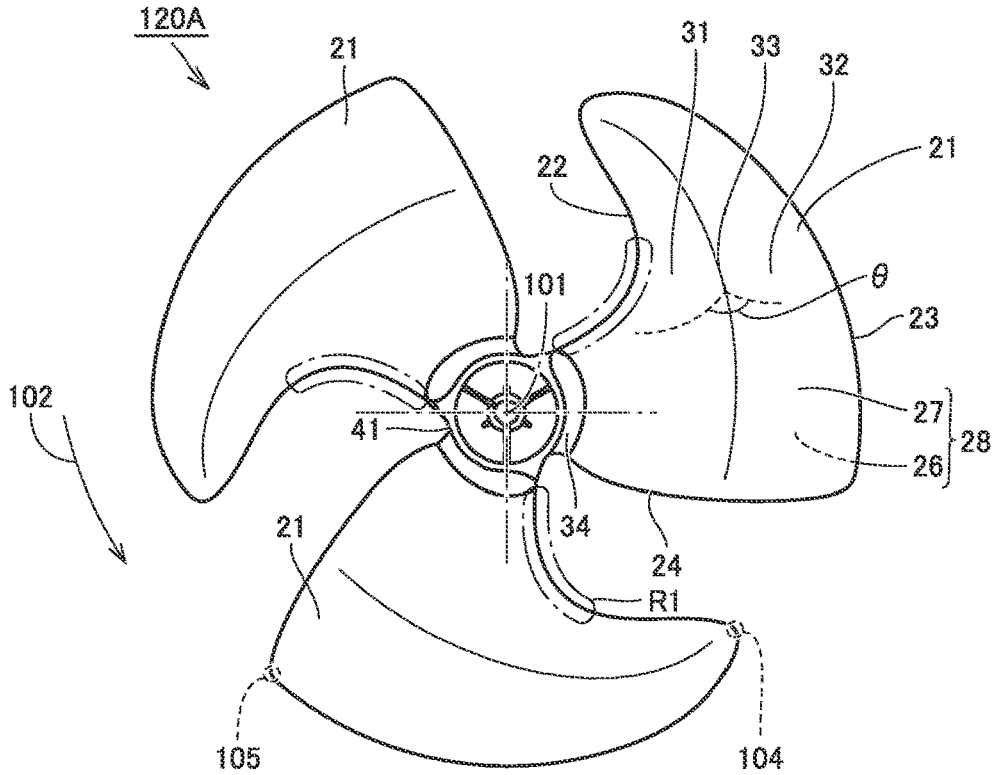
FIG. 31 is a plan view of a propeller fan in a variation of the second embodiment viewed from the suction side.

As in a propeller fan 120A shown in FIG. 31, region R1 may be formed between boss hub portion 41 and a position distant from boss hub portion 41 outward in the direction of radius of central axis 101. Front edge portion 22 of propeller fan 120A also has a constant height in the axial direction of central axis 101 in region R1.

Region R1 where front edge portion 22 has a constant height in the axial direction of central axis 101 is formed, for example, between boss hub portion 41 and a position distant from central axis 101 by 0.4R to 0.6R (R representing a maximum radius of blade 21 in a plan view of propeller fan 120 (see FIGS. 4 and 6)).

Even when region R having a constant height in the axial direction of central axis 101 is formed in a portion close to boss hub portion 41 of front edge portion 22 as in propeller fan 120A, a height of blade 21 is set to be large on the inner circumferential side around central axis 101. Thus, capability to send wind can be enhanced, and a function and effect substantially the same as in propeller fan 120 in the second embodiment described above can be obtained.

Alternatively, a height of front edge portion 22 of blade 21 may be constant from boss hub portion 41 to a certain section and subsequently the height may decrease. According to such a construction, a portion of front edge portion 22 on the side of boss hub portion 41 is higher than the portion of front edge portion 22 on the side of blade tip end portion 104. Since a wind velocity which tends to be low on the inner side in the direction of radius is high, a difference in wind velocity caused between the portion of front edge portion 22 on the side of boss hub portion 41 and the portion of front edge portion 22 on the side of blade tip end portion 104 can be decreased. Consequently, variation in wind generated on the downstream side of blade 21 is lessened. By suppressing a wind velocity being low in the portion of front edge portion 22 on the side of boss hub portion 41 and a wind velocity being extremely high in the portion of front edge portion 22 on the side of blade tip end portion 104, distribution of a wind velocity in the direction of radius is uniform, and hence generated wind is smoother and more comfortable.

Third Embodiment

A propeller fan 130 in the present embodiment will be described with reference to FIG. 32. In propeller fan 130, in addition to the features of propeller fan 120 in the second embodiment described above, rear edge portion 24 has a constant height in the axial direction of central axis 101 in a region R2 on the outer circumferential side around central axis 101.

Figure 32:
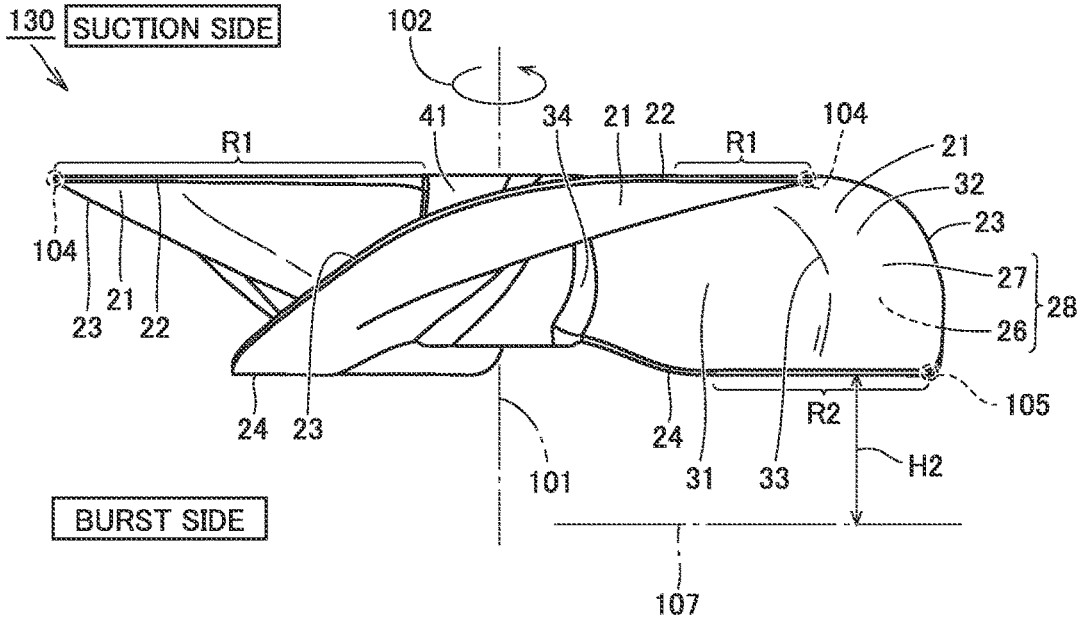
FIG. 32 is a side view showing a propeller fan in a third embodiment.

FIG. 32 shows a virtual plane 107 orthogonal to central axis 101 on the burst side of propeller fan 130. With this virtual plane 107 being defined as the reference, rear edge portion 24 has a constant height H2 in region R2 on the outer circumferential side around central axis 101.

According to such a construction, a height of blade 21 is maintained high also on the outer circumferential side around central axis 101. Thus, efficiency in sending wind of propeller fan 130 with respect to a volume of an occupied space virtually formed as a result of rotation of the plurality of blades 21 can further be enhanced.

In propeller fan 130, for the purpose of avoiding interference between a not-shown spinner for fixing boss hub portion 41 to a rotation shaft extending from the drive motor and blade 21, a height of rear edge portion 24 is greater on the inner circumferential side around central axis 101. Without being limited to such a construction, boss hub portion 41 may be extended to the burst side such that a height of rear edge portion 24 is constant between boss hub portion 41 and outer edge portion 23.

Fourth Embodiment

Figure 33:
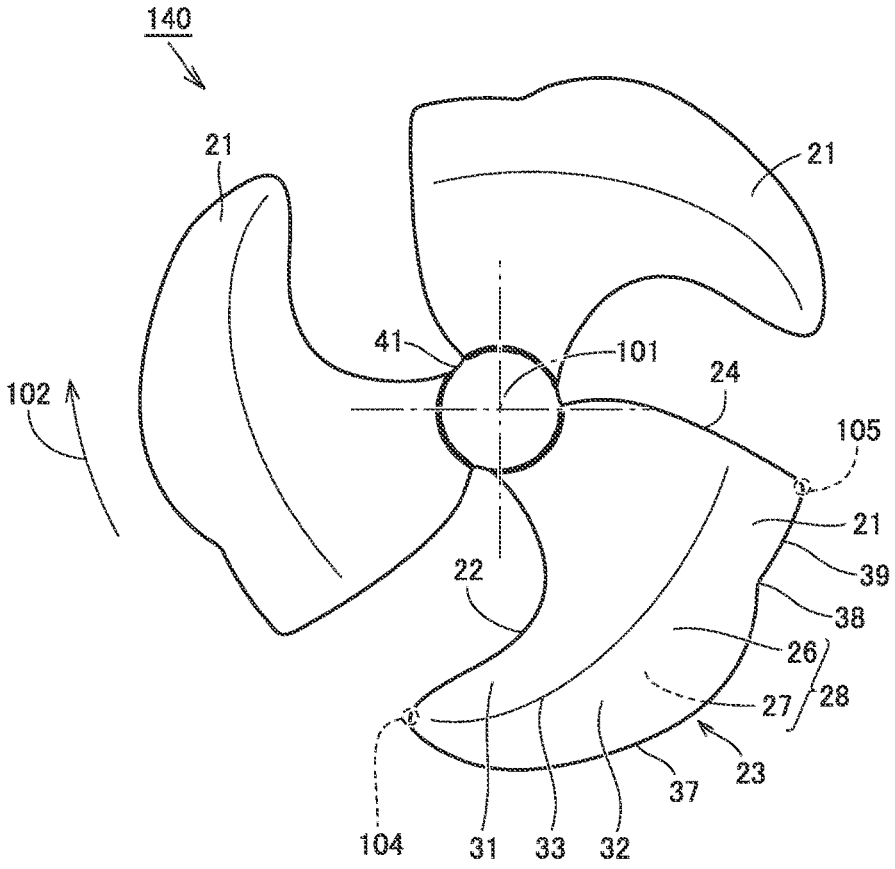
FIG. 33 is a plan view of a propeller fan in a fourth embodiment viewed from the burst side.
Figure 34:
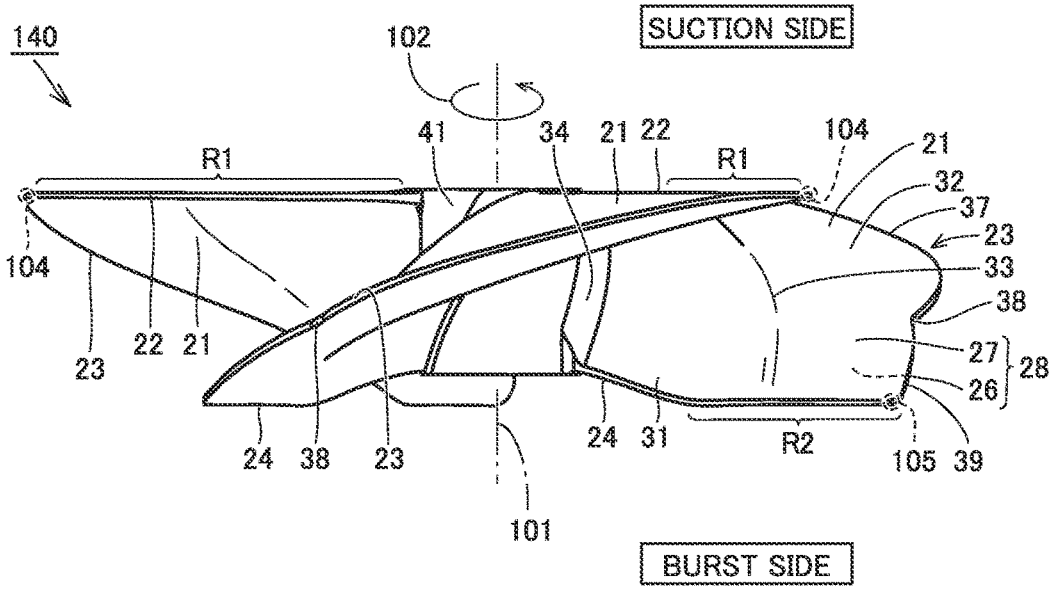
FIG. 34 is a side view showing the propeller fan in the fourth embodiment.

A propeller fan 140 in the present embodiment will be described with reference to FIGS. 33 to 38. As shown in FIGS. 33 and 34, in blade 21 of propeller fan 140, outer edge portion 23 of blade 21 includes, in addition to the features of blade 21 of propeller fan 130 in the third embodiment described above, a front outer edge portion 37 located on the side of front edge portion 22, a rear outer edge portion 39 located on the side of rear edge portion 24, and a connection portion 38 in a prescribed shape connecting front outer edge portion 37 and rear outer edge portion 39 to each other. In the present embodiment, connection portion 38 recessed toward central axis 101 is formed in outer edge portion 23 of blade 21. Connection portion 38 is formed at a position in midway between blade tip end portion 104 and blade rear end portion 105 in outer edge portion 23. As connection portion 38 is formed in outer edge portion 23, in outer edge portion 23 of blade 21, front outer edge portion 37 located on the side of blade tip end portion 104 in outer edge portion 23 and rear outer edge portion 39 located on the side of blade rear end portion 105 in outer edge portion 23 are provided.

Here, though connection portion 38 is preferably formed in a smoothly curved shape as illustrated, it does not necessarily have to be in the curved shape but it may be in a bent shape. In the present embodiment, since connection portion 38 is formed as being relatively shallowly recessed on outer edge portion 23, connection portion 38 has a shape at a substantially obtuse angle. A position where connection portion 38 is formed is not particularly limited so long as it is a position on outer edge portion 23. In the present embodiment, however, connection portion 38 is formed at a position close to blade rear end portion 105 in outer edge portion 23. In the present embodiment, a width of front outer edge portion 37 along the direction of rotation is formed to be greater than a width of rear outer edge portion 39 along the direction of rotation. By forming outer edge portion 23 in such a shape, an effect as follows is achieved.

Firstly, with blade 21 constructed as above, wind velocity distribution in a radial direction can be more uniform and variation in wind velocity can be suppressed. Thus, comfortably impinging wind can be obtained.

Namely, in a case of a blade shape not having recessed connection portion 38 formed in outer edge portion 23, a wind velocity increases radially outward substantially in proportion, and there is a great difference in velocity between wind generated in a portion close to the radially inner side and wind generated in a portion close to the radially outer side. Thus, significant variation in wind velocity is caused in generated wind.

In contrast, in the present embodiment, recessed connection portion 38 is formed in outer edge portion 23. Therefore, as compared with a case that no recessed connection portion 38 is formed on outer edge portion 23, an area of a blade is decreased in the vicinity of outer edge portion 23 (that is, a portion close to the radially outer side). Therefore, a wind velocity increasing radially outward substantially in proportion is lowered in a portion close to outer edge portion 23. A velocity of wind generated in the portion close to the radially inner side and a velocity of wind generated in a portion close to outer edge portion 23 are close to each other and wind velocity distribution in the radial direction is more uniform. Therefore, variation in wind velocity can be suppressed and comfortably impinging wind can be obtained.

Secondly, with blade 21 constructed as above, pressure fluctuation included in wind generated in a portion close to the radially outer side is less and comfortably impinging wind can be generated.

Namely, in a case of a blade shape not having recessed connection portion 38 formed in outer edge portion 23, air passes through a relatively large space between blades and great pressure fluctuation is caused in generated wind. This is particularly noticeable in a portion on the side of outer edge portion 23 where wind high in velocity is generated, and wind greater in pressure difference is generated as the number of blades 21 is smaller.

In contrast, in the present embodiment, the blade shape is such that recessed connection portion 38 is formed in outer edge portion 23. Therefore, a relatively small space (that is, a space where recessed connection portion 38 is located) is formed between front outer edge portion 37 and rear outer edge portion 39 in one blade 21, and the space is present as a space in blade 21 where no wind is generated.

Consequently, in a portion on the side of outer edge portion 23 where wind high in velocity is generated, a pressure difference caused in generated wind is lessened as a result of decrease in area of the blade, and in addition, a pressure fluctuates in a more finely stepwise manner. Therefore, front outer edge portion 37 and rear outer edge portion 39 provided in one blade 21 function as if two blades sent wind, and comfortably impinging wind less in pressure fluctuation as a whole can be generated.

Thirdly, with blade 21 constructed as above, during rotation at a low speed, comfortably impinging wind diffusing over a wide range can be obtained, and during rotation at a high speed, wind high in straightness and reaching farther can be obtained, which will be described in further detail with reference to FIGS. 35 to 38.

Figure 35:
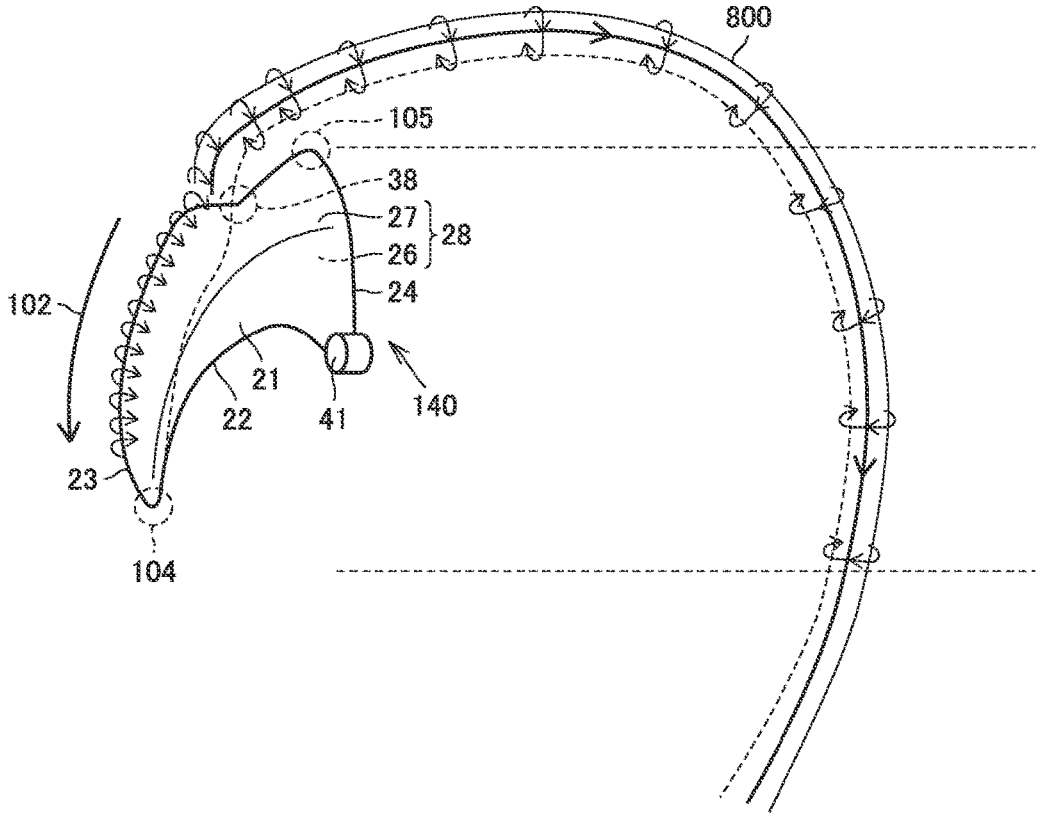
FIG. 35 is a conceptual diagram showing a flow of wind obtained at the time when the propeller fan in the fourth embodiment is rotated at a low speed.
Figure 36:
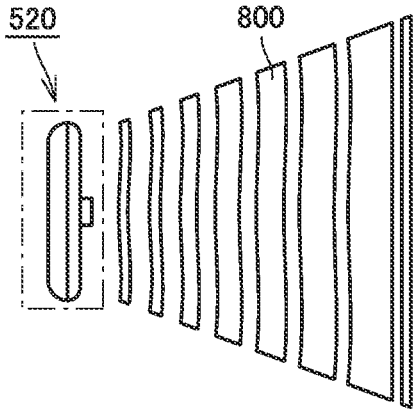
FIG. 36 is a diagram schematically showing a state of wind obtained at the time when the propeller fan is rotated at a low speed in a fluid feeder in the fourth embodiment.
Figure 37:
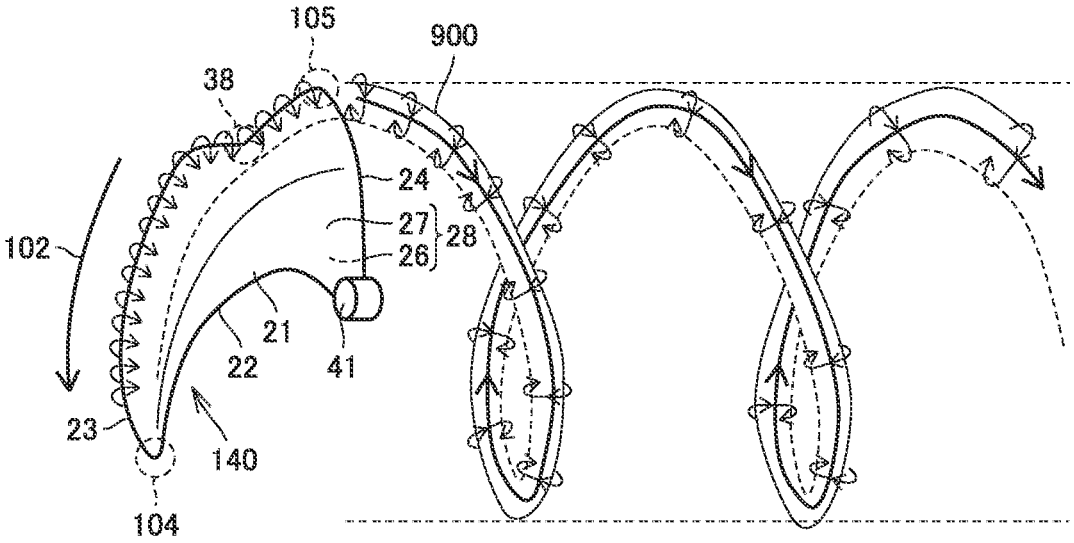
FIG. 37 is a conceptual diagram showing a flow of wind obtained at the time when the propeller fan in the fourth embodiment is rotated at a high speed.
Figure 38:
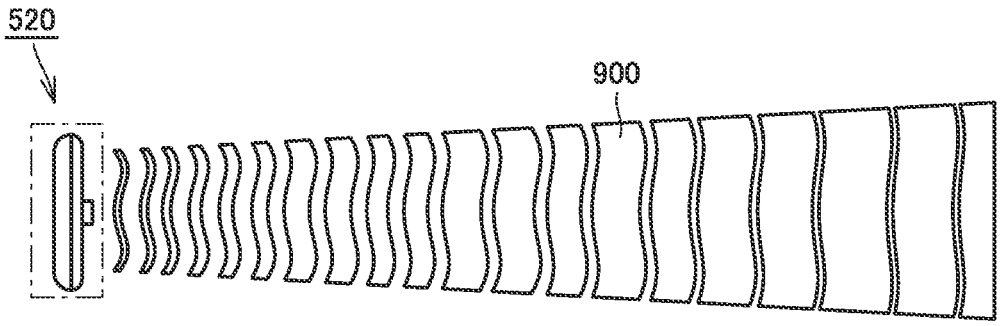
FIG. 38 is a diagram schematically showing a state of wind obtained at the time when the propeller fan is rotated at a high speed in a fluid feeder in the fourth embodiment.
Figure 39:
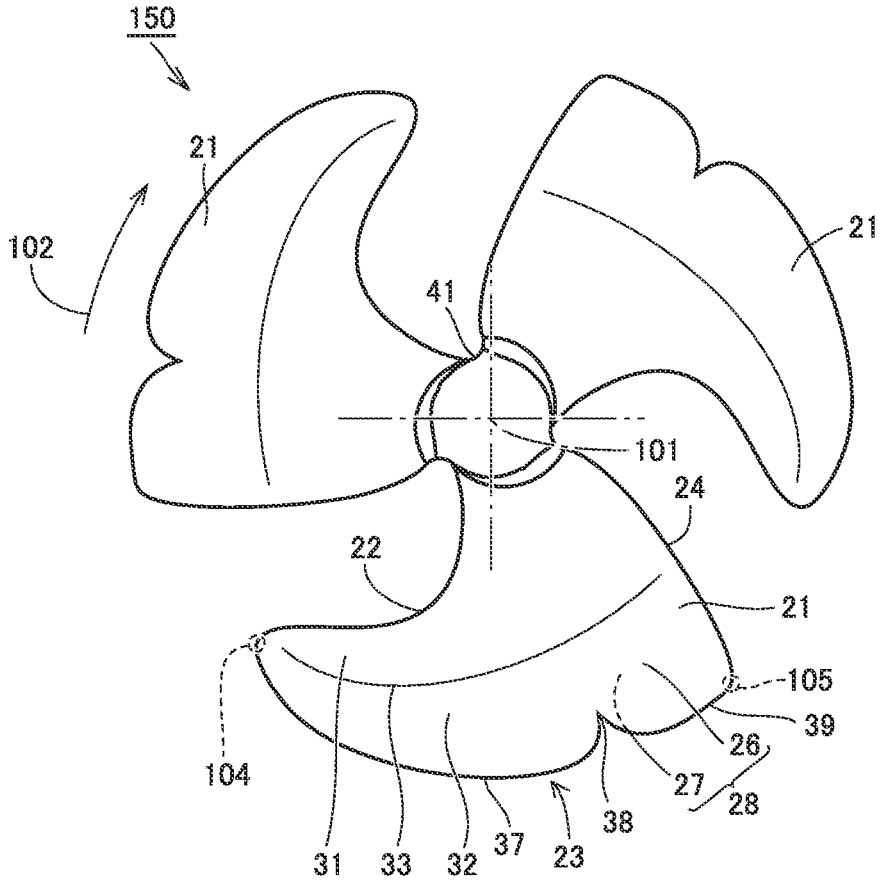
FIG. 39 is a plan view of a propeller fan in a variation of the fourth embodiment viewed from the burst side.

FIG. 35 is a conceptual diagram showing a flow of wind obtained at the time when propeller fan 140 is rotated at a low speed. FIG. 36 is a diagram schematically showing a state of wind obtained at the time when propeller fan 140 is rotated at a low speed in a fluid feeder 520. FIG. 37 is a conceptual diagram showing a flow of wind obtained at the time when propeller fan 140 is rotated at a high speed. FIG. 38 is a diagram schematically showing a state of wind obtained at the time when propeller fan 140 is rotated at a high speed in fluid feeder 520. In FIGS. 35 and 37, as a track representative of a blade tip end vortex, a track of a blade tip end vortex generated around blade tip end portion 104 of outer edge portion 23 is schematically shown with a thin dashed line, a track representative of a horseshoe vortex is schematically shown with a thin line, and a track of wind generated at a position close to outer edge portion 23 of blade 21 is further shown schematically with a bold line.

As described above, in the present embodiment, recessed connection portion 38 is formed at a position on outer edge portion 23 of blade 21. The position on outer edge portion 23 corresponds to a position downstream of blade tip end portion 104, along a streamline of the blade tip end vortex which flows over the blade surface.

As shown in FIG. 35, when blade 21 rotates at a low speed, kinetic energy of the blade tip end vortex and the horseshoe vortex generated as a result of rotation of blade 21 is low, and hence separation of the blade tip end vortex and the horseshoe vortex is promoted in recessed connection portion 38 without the vortexes being trapped therein. Thus, the blade tip end vortex and the horseshoe vortex are both dispelled outward in the direction of radius by centrifugal force in a portion where recessed connection portion 38 is formed. Therefore, as shown in FIG. 36, wind generated by blade 21 is diffused in front of fluid feeder 520, and comfortably impinging wind 800 can be sent over a wide range. Therefore, in a case that the electric fan is desirably operated during bedtime such as night without wind being substantially felt, a breezy operation satisfying such a desire can also be realized.

On the other hand, as shown in FIG. 37, when blade 21 rotates at a high speed, kinetic energy of the blade tip end vortex and the horseshoe vortex generated as a result of rotation of blade 21 is great, and hence the blade tip end vortex and the horseshoe vortex are trapped and held in recessed connection portion 38 and fluctuation or development of the blade tip end vortex and the horseshoe vortex is suppressed. In that case, the blade tip end vortex and the horseshoe vortex will move inward along recessed connection portion 38, and hence, thereafter, the blade tip end vortex and the horseshoe vortex which are separated at blade rear end portion 105 of outer edge portion 23 are dispelled in an axial direction by a large quantity of wind and a high static pressure resulting from rotation at high speed. Therefore, as shown in FIG. 38, wind generated by blade 21 converges in front of fluid feeder 520, and wind 900 high in straightness and reaching farther can be sent. Therefore, wind can efficiently be sent and generation of noise can also be suppressed owing to enhanced straightness of wind.

Thus, according to propeller fan 140 and fluid feeder 520 including the same in the present embodiment, generated wind can be less in pressure fluctuation and comfortably impinging wind can be sent, and noise can be lowered.

Variation of Fourth Embodiment

In propeller fan 140 in the fourth embodiment described above, recessed connection portion 38 is formed at a position close to blade rear end portion 105 of outer edge portion 23. In a propeller fan 150 in the present embodiment, recessed connection portion 38 is provided in a region in midway between blade tip end portion 104 and blade rear end portion 105 on outer edge portion 23. According to such a construction as well, a function and effect substantially the same as in propeller fan 140 in the fourth embodiment can be obtained.

[First Verification Experiment]

A first verification experiment carried out in connection with coupling portion 33 commonly provided in the propeller fans in the embodiments above will be described with reference to FIGS. 40 to 44. In a first verification test, a plurality of propeller fans 160 different in position where coupling portion 33 was provided were prepared as samples, and based thereon, a quantity of wind obtained at the time when each propeller fan 160 was rotated and pressure fluctuation included in obtained wind were measured as a relative value.

Figure 40:
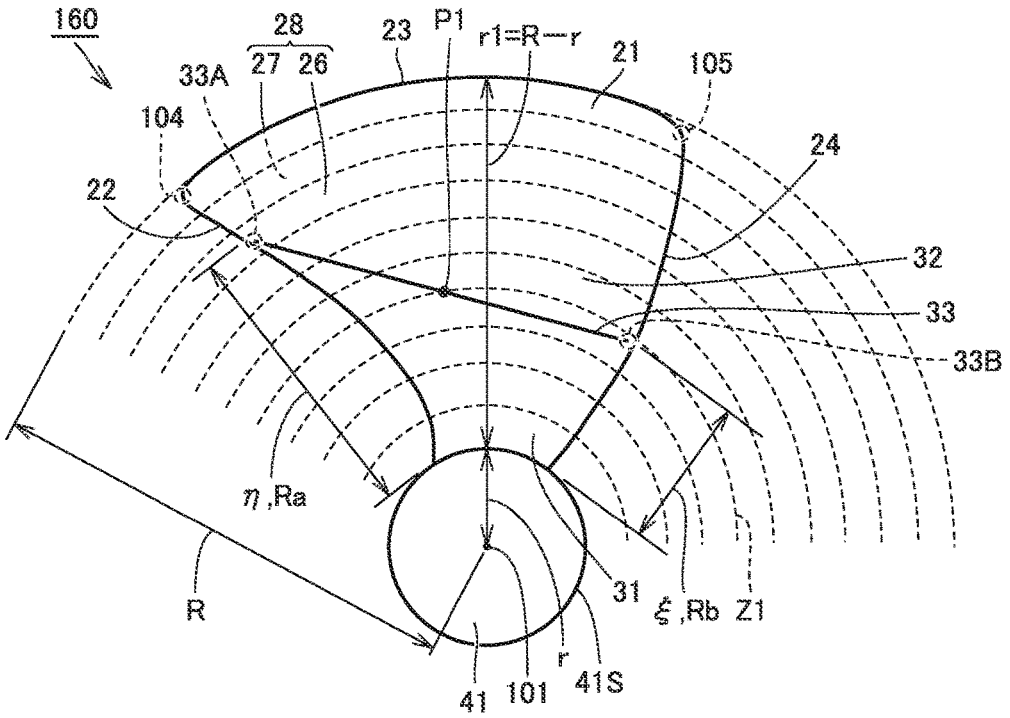
FIG. 40 is a plan view of a propeller fan used in a first verification experiment viewed from the suction side.
Figure 41:
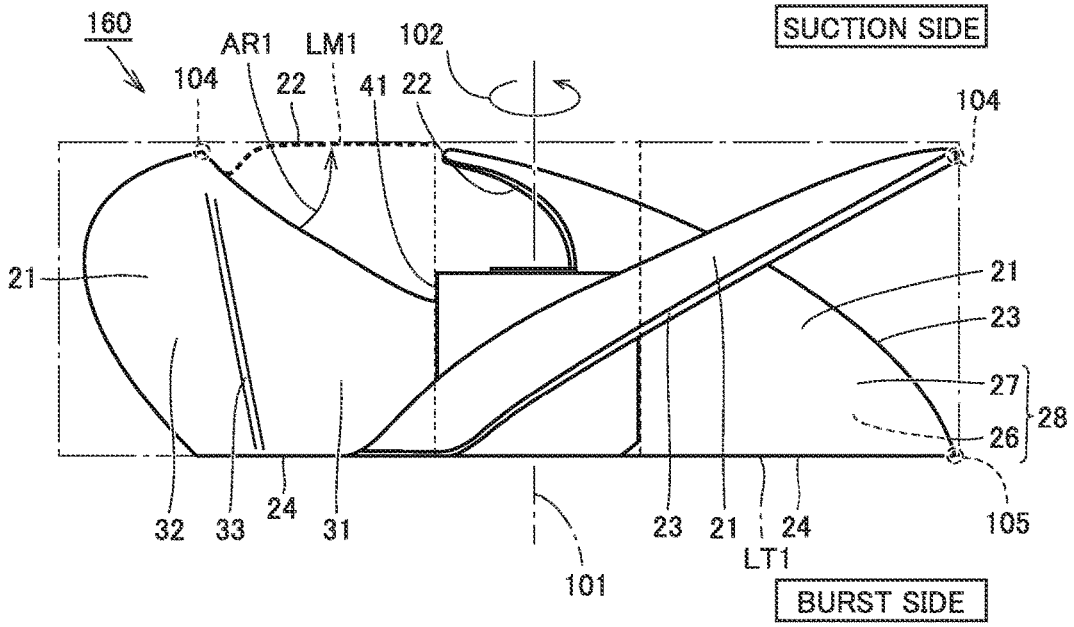
FIG. 41 is a side view showing the propeller fan used in the first verification experiment.

As shown in FIGS. 40 and 41, as a basic shape of propeller fan 160, outer edge portion 23 of propeller fan 160 has a radius R, boss hub portion 41 has a radius r, blade 21 has a length r1 in the direction of radius (=R−r), front end portion 33A of coupling portion 33 has a dimensionless position $\eta$, and rear end portion 33B of coupling portion 33 has a dimensionless position $\xi$. Blade 21 is provided with coupling portion 33 extending from dimensionless position $\eta$ of front end portion 33A to dimensionless position $\xi$ of rear end portion 33B.

With a length dimension along the direction of radius from outer surface 41S of boss hub portion 41 to front end portion 33A of coupling portion 33 being denoted as Ra, dimensionless position η is represented as a value calculated by dividing Ra by length r1 in the direction of radius of blade 21 (Ra/r1). With a length dimension along the direction of radius from outer surface 41S of boss hub portion 41 to rear end portion 33B of coupling portion 33 being denoted as Rb, dimensionless position ξ is represented as a value calculated by dividing Rb by length r1 in the direction of radius of blade 21 (Rb/r1).

Blade 21 of propeller fan 160 is formed such that a stagger angle on the inner side in the direction of radius relative to coupling portion 33 (on the side of inner region 31) and a stagger angle on the outer side in the direction of radius (on the side of outer region 32) relative to coupling portion 33 are substantially constant, and such that the stagger angle on the inner side in the direction of radius relative to coupling portion 33 (on the side of inner region 31) is smaller than the stagger angle on the outer side in the direction of radius (on the side of outer region 32) relative to coupling portion 33.

Regarding a height of front edge portion 22 of blade surface 28, a propeller fan (shown with a dotted line in FIG. 41) formed by deforming a conventional propeller fan (shown with a solid line in FIG. 41) in a direction shown with an arrow AR1 so as to have an increased constant height on the inner side in the direction of radius was prepared. The height of front edge portion 22 increased on the inner side in the direction of radius matches with a height of an upper surface of an occupied space LM1 formed as a result of rotation of propeller fan 160.

A quantity of wind and pressure fluctuation were measured at a position distant by 30 mm on the burst side along central axis 101 of propeller fan 160 where a distance along the direction of radius from central axis 101 of propeller fan 160 is 80% of maximum radius R of outer edge portion 23. The position around a portion where a distance along the direction of radius from central axis 101 of propeller fan 160 is 70% to 80% of the maximum radius of outer edge portion 23 is generally a position where a wind velocity is highest and hence pressure fluctuation is most.

Figure 42:
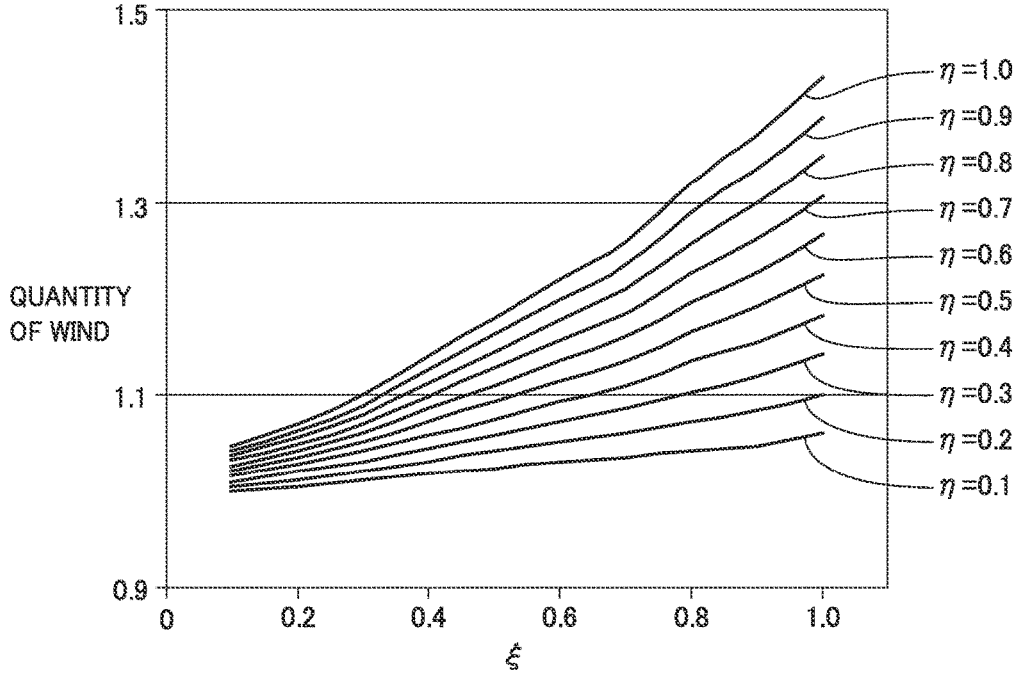
FIG. 42 is a graph showing relation between a shape of a blade and a relative quantity of wind of the propeller fan obtained in a first verification test.

FIG. 42 is a graph showing relation between a shape of a blade and a relative quantity of wind obtained in the first verification test. In FIG. 42, the abscissa represents dimensionless position ξ of rear end portion 33B and the ordinate represents a relative quantity of wind. A relative quantity of wind shown on the ordinate is represented as a value obtained by dividing a wind velocity measured for each sample by a wind velocity in a propeller fan having no coupling portion 33 formed.

As shown in FIG. 42, it can be seen that, when dimensionless position η of front end portion 33A is relatively small, a quantity of wind slightly increases as dimensionless position ξ of rear end portion 33B is greater. It can be seen that, when dimensionless position η of front end portion 33A is relatively large, a quantity of wind significantly increases as dimensionless position ξ of rear end portion 33B is greater.

Figure 43:
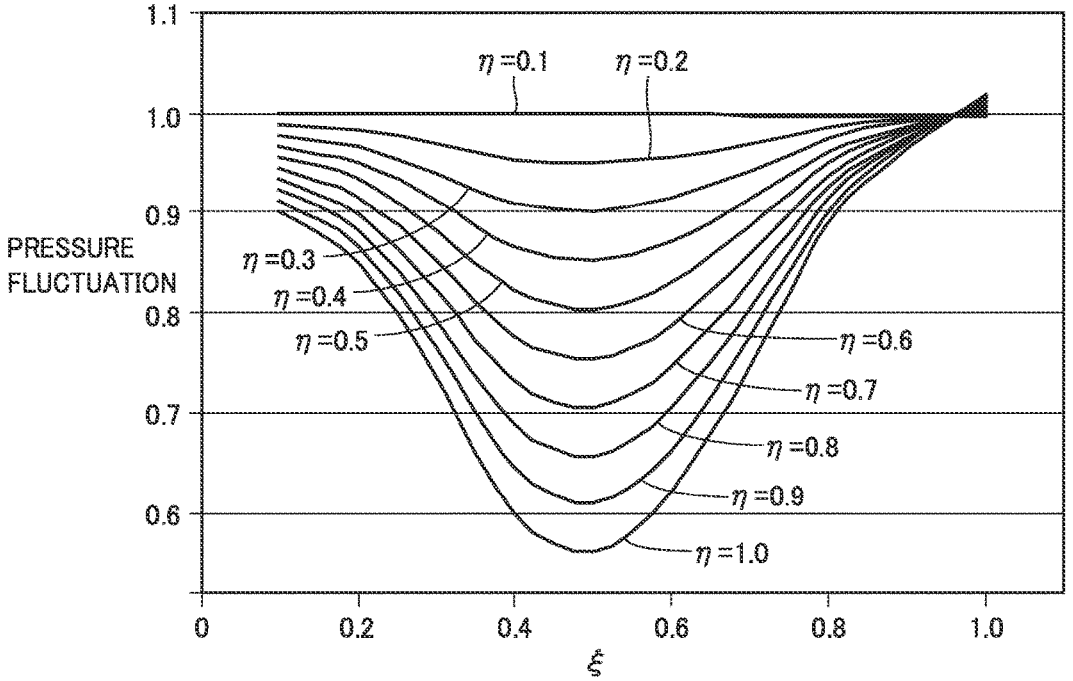
FIG. 43 is a graph showing relation between a shape of a blade and relative pressure fluctuation of the propeller fan obtained in the first verification test.

FIG. 43 is a graph showing relation between a shape of a blade and relative pressure fluctuation obtained in the first verification test. In FIG. 43, the abscissa represents dimensionless position ξ of rear end portion 33B and the ordinate represents relative pressure fluctuation. Relative pressure fluctuation shown on the ordinate is represented as a value obtained by dividing relative pressure fluctuation measured for each sample by a wind velocity in a propeller fan having no coupling portion 33 formed.

As shown in FIG. 43, it can be seen that a value for relative pressure fluctuation gradually decreases with increase in dimensionless position ξ of rear end portion 33B, and with dimensionless position ξ of rear end portion 33B at approximately 0.5 being defined as an inflection point, a value for relative pressure fluctuation gradually increases with increase in dimensionless position ξ of rear end portion 33B. It can be seen that this tendency is noticeable as dimensionless position η of front end portion 33A is relatively greater.

Figure 44:
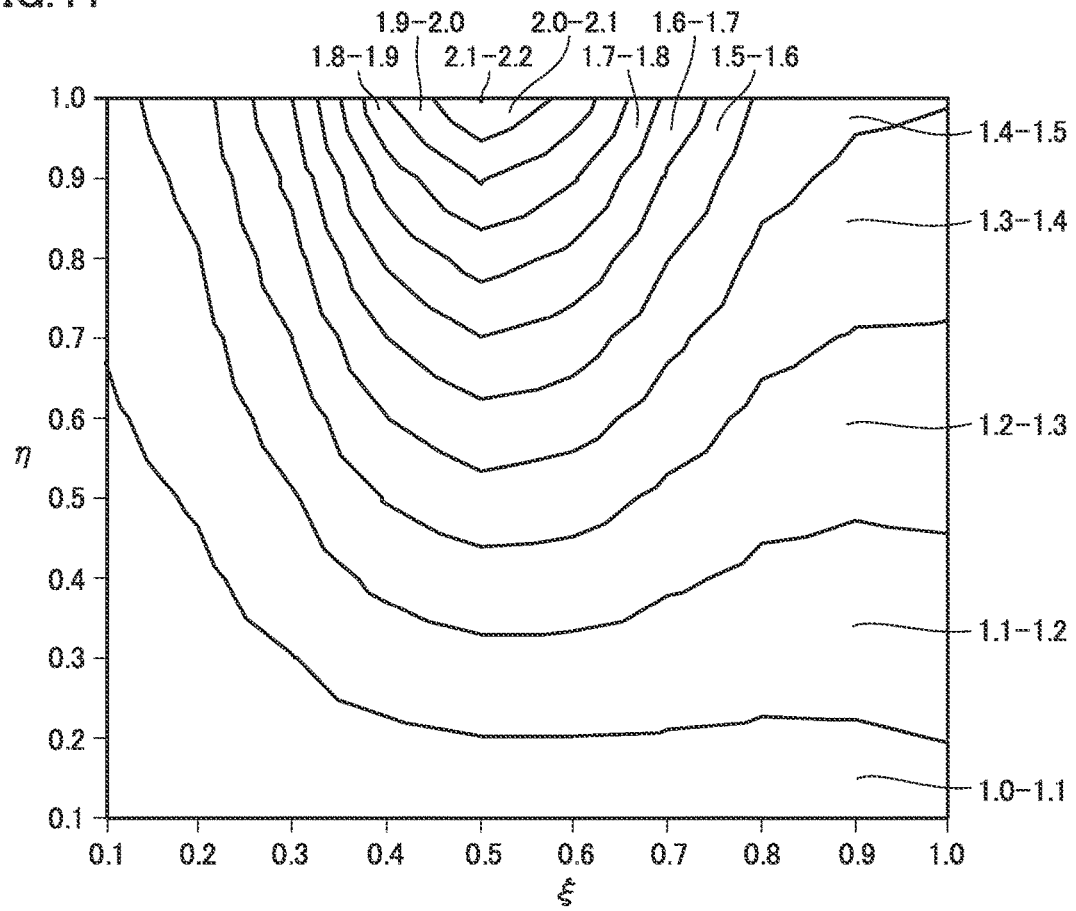
FIG. 44 is a contour diagram showing relation between a shape of a blade and a comfort index of the propeller fan obtained in the first verification test.

FIG. 44 is a contour diagram showing relation between a shape of a blade and a comfort index obtained in the first verification test. The contour diagram represents results in the first verification test as fan performance including a comfort index based on the results shown in FIGS. 42 and 43 described above. The comfort index is calculated by dividing the relative quantity of wind shown in FIG. 42 by relative pressure fluctuation shown in FIG. 43, and a higher value thereof indicates higher comfort. The ordinate in FIG. 44 represents a value representing dimensionless position η of front end portion 33A and the abscissa in FIG. 44 represents a value representing dimensionless position ξ of rear end portion 33B.

As shown in FIG. 44, with attention being paid to η, it can be seen that the comfort index is not lower than approximately 1.2 within a range of $0.4 \leq \eta \leq 1$. With attention being paid to ξ, it can be seen that the comfort index is not lower than approximately 1.4 within a range of $0.3 \leq \xi \leq 0.7$. With attention being paid to both of η and ξ, it can be seen that the comfort index is not lower than approximately 1.5 as η satisfies a condition of $0.80 \leq \eta \leq 1.0$ and ξ satisfies a condition of $0.4 \leq \xi \leq 0.65$.

Referring to FIG. 40, regarding a position where coupling portion 33 is provided, when a virtual concentric circle Z1 is drawn which passes through a central position P1 of coupling portion 33 in the direction of rotation with central axis 101 being defined as the center, desirably, front end portion 33A of coupling portion 33 is located on the outer side in the direction of radius of concentric circle Z1 and rear end portion 33B of coupling portion 33 is located on the inner side in the direction of radius of concentric circle Z1.

According to such a construction, during rotation of the propeller fan, in the vicinity of the region where coupling portion 33 is provided, a mainstream flows from the outer side to the inner side in the direction of radius. Therefore, by forming coupling portion 33 substantially along a flow of the mainstream and adopting a blade shape also for the region where coupling portion 33 is provided, a blade shape can be realized for all flows of a mainstream, and hence wind can more efficiently be sent.

[Second Verification Experiment]

A second verification experiment carried out in connection with coupling portion 33 commonly provided in the propeller fans in the embodiments above will be described with reference to FIGS. 45 to 49. In the second verification test, a plurality of propeller fans 170 different in position where coupling portion 33 was provided were prepared as samples, and based thereon, a quantity of wind obtained at the time when each propeller fan 170 was rotated and pressure fluctuation included in obtained wind were measured as a relative value.

Figure 45:
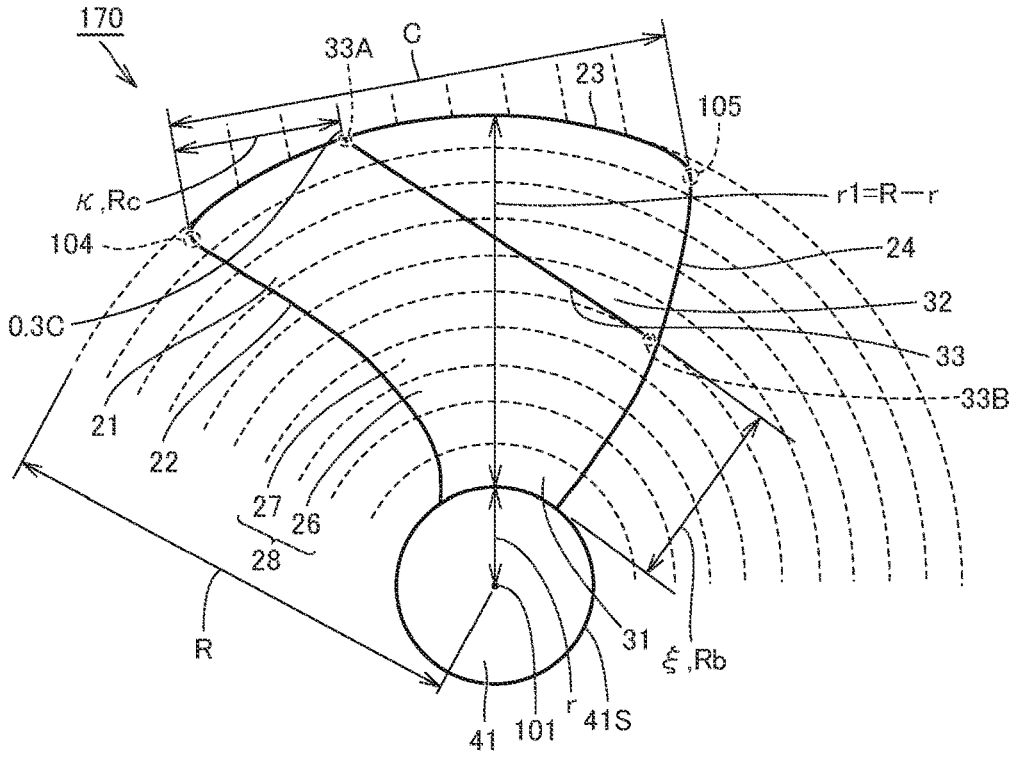
FIG. 45 is a plan view of a propeller fan used in a second verification experiment viewed from the suction side.
Figure 46:
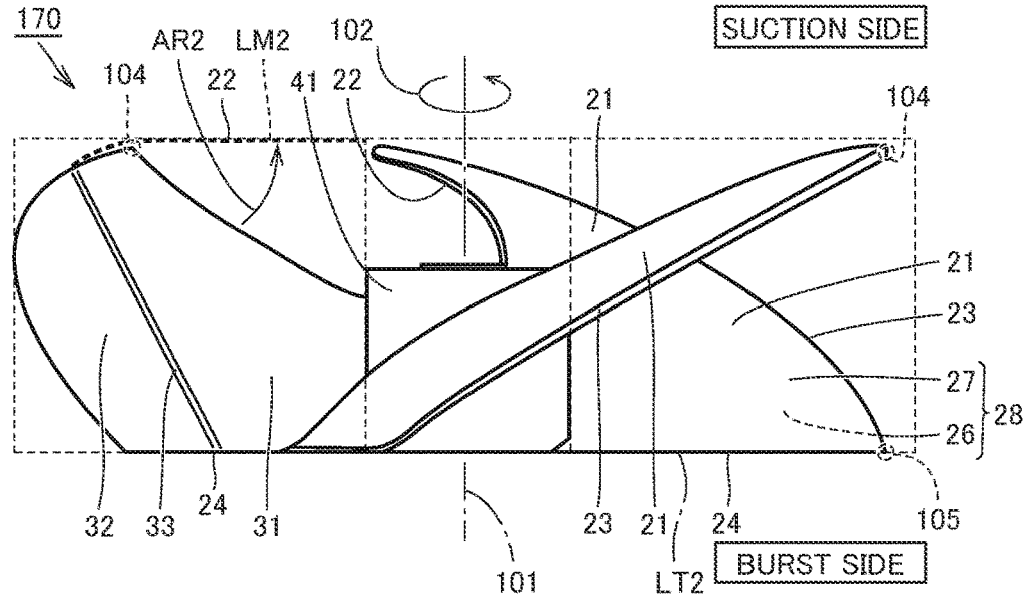
FIG. 46 is a side view showing the propeller fan used in the second verification experiment.

As shown in FIGS. 45 and 46, as a basic shape of propeller fan 170, outer edge portion 23 of propeller fan 170 has radius R, boss hub portion 41 has radius r, blade 21 has length r1 in the direction of radius (=R−r), outer edge portion 23 of blade 21 has a cord length dimension C, front end portion 33A of coupling portion 33 is located close to outer edge portion 23, front end portion 33A of coupling portion 33 has a dimensionless position κ, and rear end portion 33B of coupling portion 33 has dimensionless position ξ. Blade 21 is provided with coupling portion 33 extending from dimensionless position κ of front end portion 33A to dimensionless position ξ of rear end portion 33B.

With a length dimension along the direction of radius from outer surface 41S of boss hub portion 41 to rear end portion 33B of coupling portion 33 being denoted as Rb, dimensionless position ξ is represented as a value obtained by dividing Rb by length r1 in the direction of radius of blade 21. With a length dimension from blade tip end portion 104 to front end portion 33A being denoted as Rc, dimensionless position κ is represented as a value obtained by dividing Rc by cord length dimension C of outer edge portion 23 of blade 21 (Rc/C).

Blade 21 of propeller fan 170 is formed such that a stagger angle on the inner side in the direction of radius relative to coupling portion 33 and a stagger angle on the outer side in the direction of radius (on the side of outer region 32) relative to coupling portion 33 are substantially constant and the stagger angle on the inner side in the direction of radius (on the side of inner region 31) relative to coupling portion 33 is smaller than a stagger angle on the outer side in the direction of radius (on the side of outer region 32) relative to coupling portion 33.

Regarding a height of front edge portion 22 of blade surface 28, a propeller fan (shown with a dotted line in FIG. 46) formed by deforming a conventional propeller fan (shown with a solid line in FIG. 46) in a direction shown with an arrow AR2 so as to have an increased constant height on the inner side in the direction of radius was prepared. The height of front edge portion 22 increased on the inner side in the direction of radius matches with a height of an upper surface of an occupied space LM2 formed as a result of rotation of propeller fan 170.

A quantity of wind and pressure fluctuation were measured at a position distant by 30 mm on the burst side along central axis 101 of propeller fan 170 where a distance along the direction of radius from central axis 101 of propeller fan 170 is 80% of maximum radius R of outer edge portion 23. The position where a distance along the direction of radius from central axis 101 of propeller fan 170 is 80% of the maximum radius of outer edge portion 23 is generally a position where a wind velocity is highest and hence pressure fluctuation is most.

Figure 47:
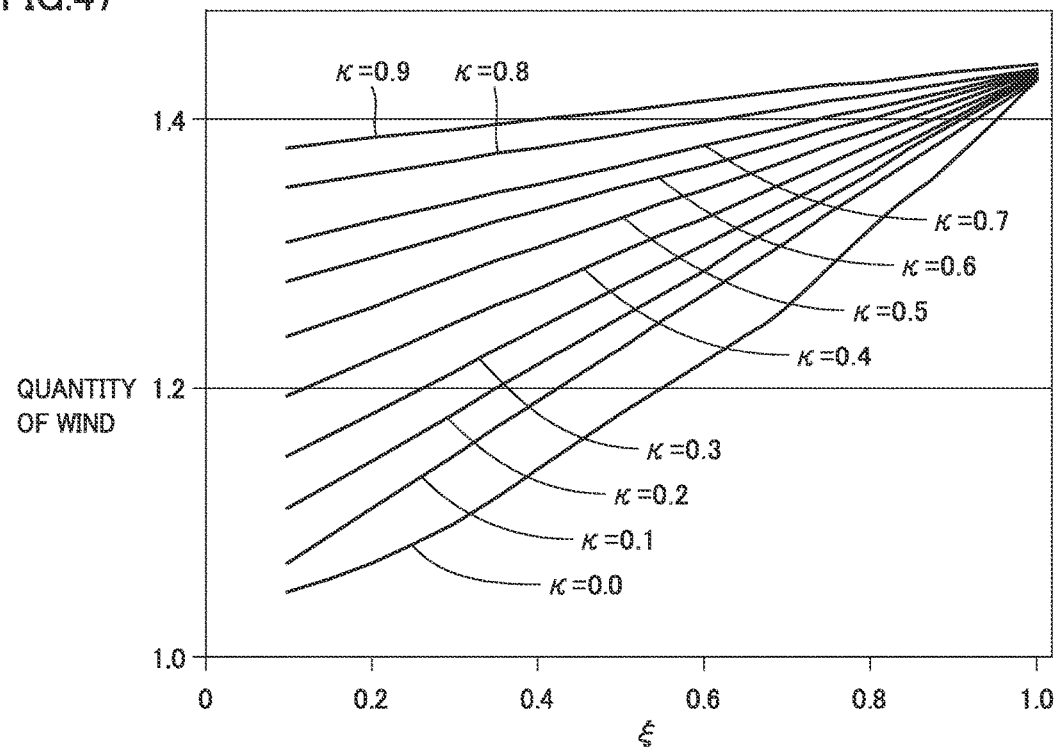
FIG. 47 is a graph showing relation between a shape of a blade and a relative quantity of wind of the propeller fan obtained in a second verification test.

FIG. 47 is a graph showing relation between a shape of a blade and a relative quantity of wind obtained in the second verification test. In FIG. 47, the abscissa represents dimensionless position ξ of rear end portion 33B and the ordinate represents a relative quantity of wind. A relative quantity of wind shown on the ordinate is represented as a value obtained by dividing a quantity of wind measured for each sample by a quantity of wind in the propeller fan having no coupling portion 33 formed.

As shown in FIG. 47, it can be seen that, when dimensionless position κ of front end portion 33A is relatively large, a quantity of wind slightly increases as dimensionless position ξ of rear end portion 33B is greater. It can be seen that, when dimensionless position κ of front end portion 33A is relatively small, a quantity of wind significantly increases as dimensionless position ξ of rear end portion 33B is greater.

Figure 48:
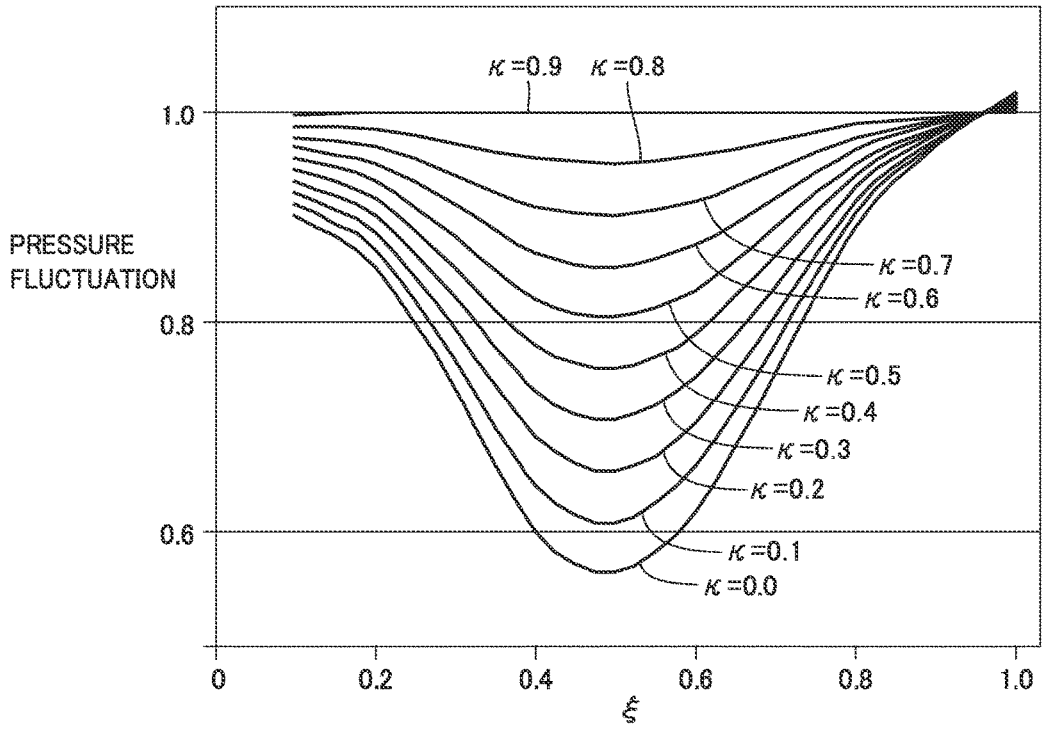
FIG. 48 is a graph showing relation between a shape of a blade and relative pressure fluctuation of the propeller fan obtained in the second verification test.

FIG. 48 is a graph showing relation between a shape of a blade and relative pressure fluctuation obtained in the second verification test. In FIG. 48, the abscissa represents dimensionless position ξ of rear end portion 33B and the ordinate represents relative pressure fluctuation. Relative pressure fluctuation shown on the ordinate is represented as a value obtained by dividing pressure fluctuation measured for each sample by pressure fluctuation in the propeller fan having no coupling portion 33 formed.

As shown in FIG. 48, it can be seen that a value for relative pressure fluctuation gradually decreases with increase in dimensionless position ξ of rear end portion 33B, and with dimensionless position ξ of rear end portion 33B at approximately 0.5 being defined as an inflection point, a value for relative pressure fluctuation gradually increases with increase in dimensionless position ξ of rear end portion 33B. It can be seen that this tendency is noticeable as dimensionless position κ of front end portion 33A is relatively smaller.

Figure 49:
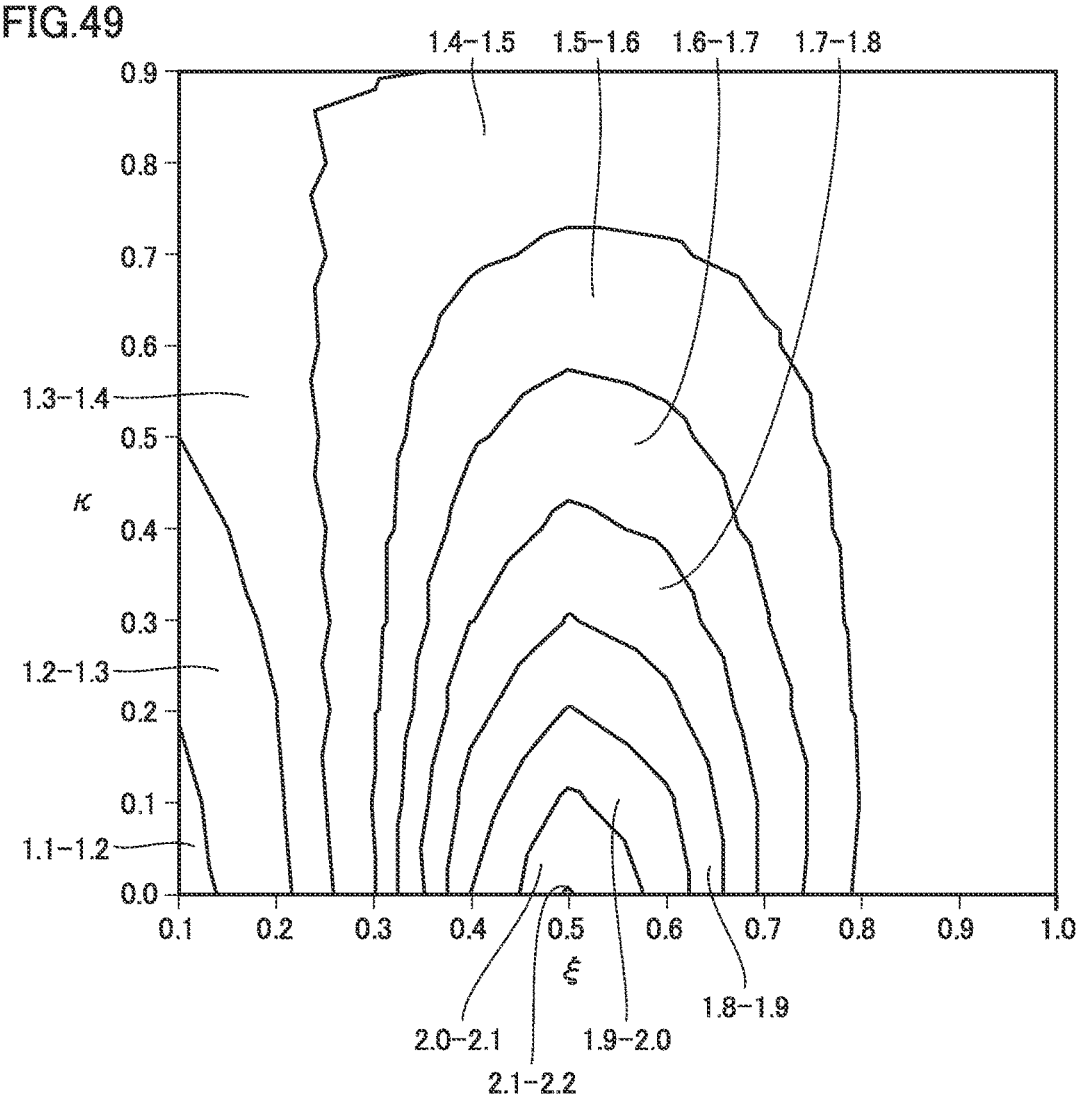
FIG. 49 is a contour diagram showing relation between a shape of a blade and a comfort index of the propeller fan obtained in the second verification test.

FIG. 49 is a contour diagram showing relation between a shape of a blade and a comfort index obtained in the second verification test. The contour diagram represents results in the second verification test as fan performance including a comfort index based on the results shown in FIGS. 47 and 48 described above. The comfort index is calculated by dividing the relative quantity of wind shown in FIG. 47 by relative pressure fluctuation shown in FIG. 48, and a higher value thereof indicates higher comfort. The ordinate in FIG. 49 represents a value representing dimensionless position κ of front end portion 33A and the abscissa in FIG. 49 represents a value representing dimensionless position ξ of rear end portion 33B.

As shown in FIG. 49, with attention being paid to κ, it can be seen that the comfort index is not lower than approximately 1.6 within a range of $0 \leq \kappa \leq 0.5$. With attention being paid to ξ, it can be seen that the comfort index is not lower than approximately 1.5 within a range of $0.3 \leq \xi \leq 0.8$. With attention being paid to both of κ and ξ, it can be seen that the comfort index is not lower than approximately 1.6 as ξ satisfies a condition of $0.4 \approx \xi \leq 0.70$ and κ satisfies a condition of $0 \leq \kappa \leq 0.3$.

Figure 50:
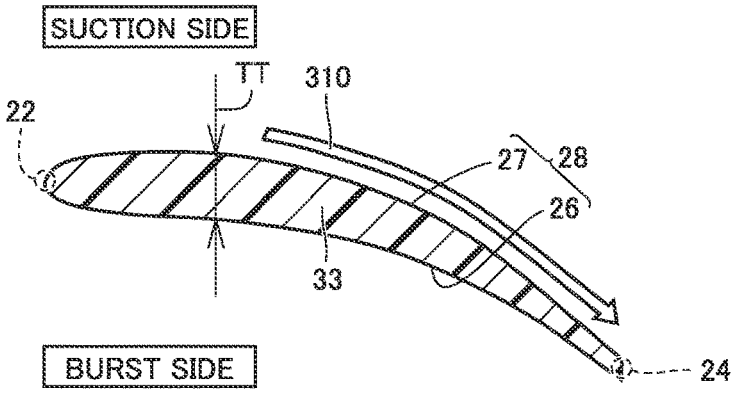
FIG. 50 is a cross-sectional view showing a preferred construction of the propeller fan in connection with the second verification test.

Referring to FIG. 50, regarding a position where coupling portion 33 is provided, when coupling portion 33 is provided from the portion in outer edge portion 23 located in midway between blade tip end portion 104 and blade rear end portion 105 to rear edge portion 24, coupling portion 33 is desirably provided from the side downstream in the direction of rotation, of a portion where a thickness TT of blade surface 28 is largest. In particular, when blade surface 28 is formed to have a large thickness and a cross-sectional shape of blade surface 28 is in a blade shape, it is effective to provide coupling portion 33 from a region downstream of a position of a largest thickness of blade surface 28.

[Third Verification Experiment]

A third verification experiment carried out in connection with coupling portion 33 commonly provided in the propeller fans in the embodiments above will be described with reference to FIGS. 51 to 57. In the third verification experiment, a propeller fan 180 shown in FIGS. 51 and 52 and a propeller fan 910 shown in FIGS. 53 and 54 were prepared, and a quantity of wind, noise, and power consumption obtained during rotation of propeller fans 180 and 910 were measured.

Figure 51:
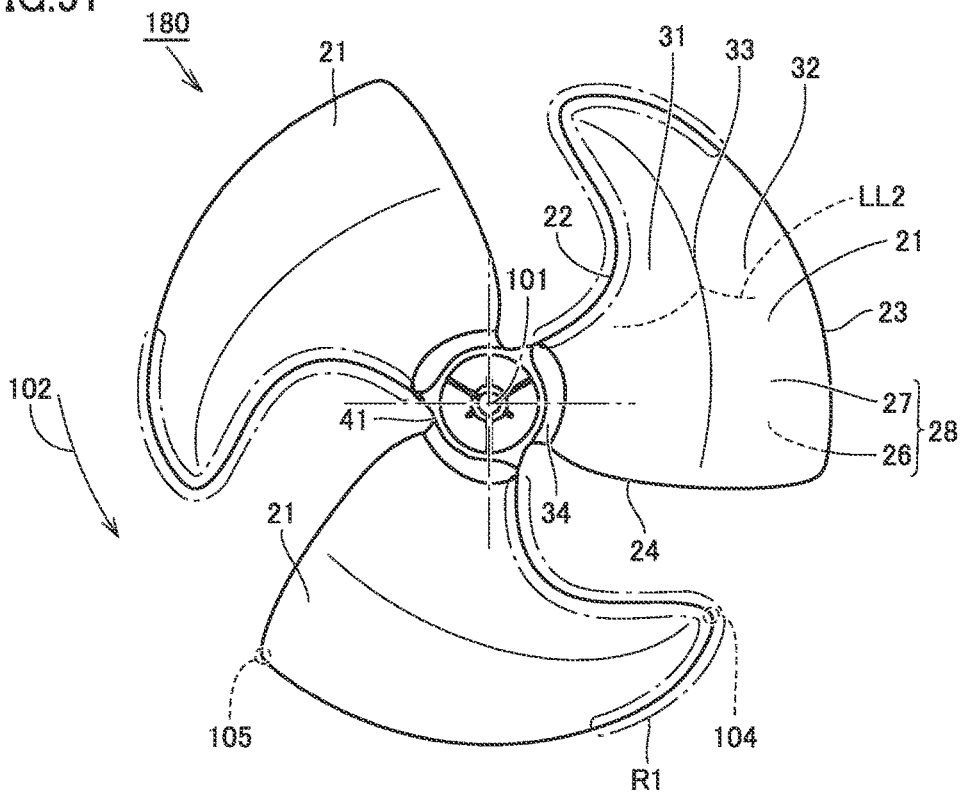
FIG. 51 is a plan view of a propeller fan used in a third verification experiment viewed from the suction side.
Figure 52:
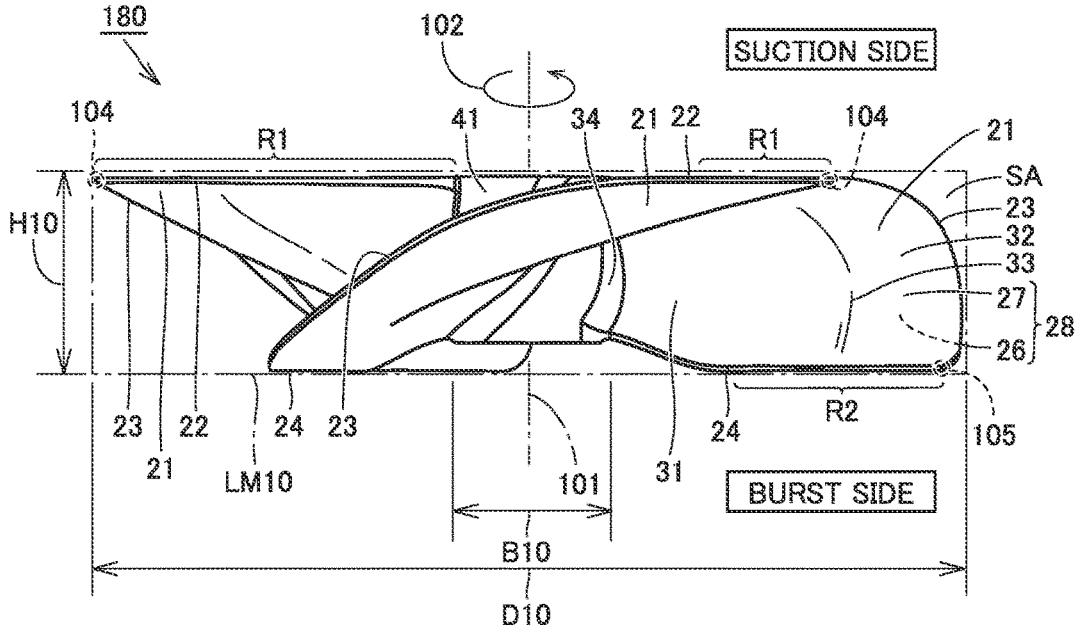
FIG. 52 is a side view showing the propeller fan used in the third verification experiment.

Referring to FIGS. 51 and 52, propeller fan 180 is substantially the same in basic construction as propeller fan 160 (see FIGS. 40 and 41) used in the first verification experiment described above. A value for dimensionless position 11 of front end portion 33A of coupling portion 33 is 0.9. A value for dimensionless position ξ of rear end portion 33B of coupling portion 33 is 0.5. As shown with a dotted line LL2, blade 21 of propeller fan 180 is bent at a prescribed depth around the center in the direction of rotation of coupling portion 33.

Propeller fan 180 has a diameter D10 of 180 mm. An occupied space LM10 formed as a result of rotation of propeller fan 180 has a height H10 in the direction of central axis 101 of 40 mm. Boss hub portion 41 has a diameter D10 of 30 mm. A gap SA having a prescribed volume is formed between propeller fan 180 and occupied space LM10.

Figure 53:
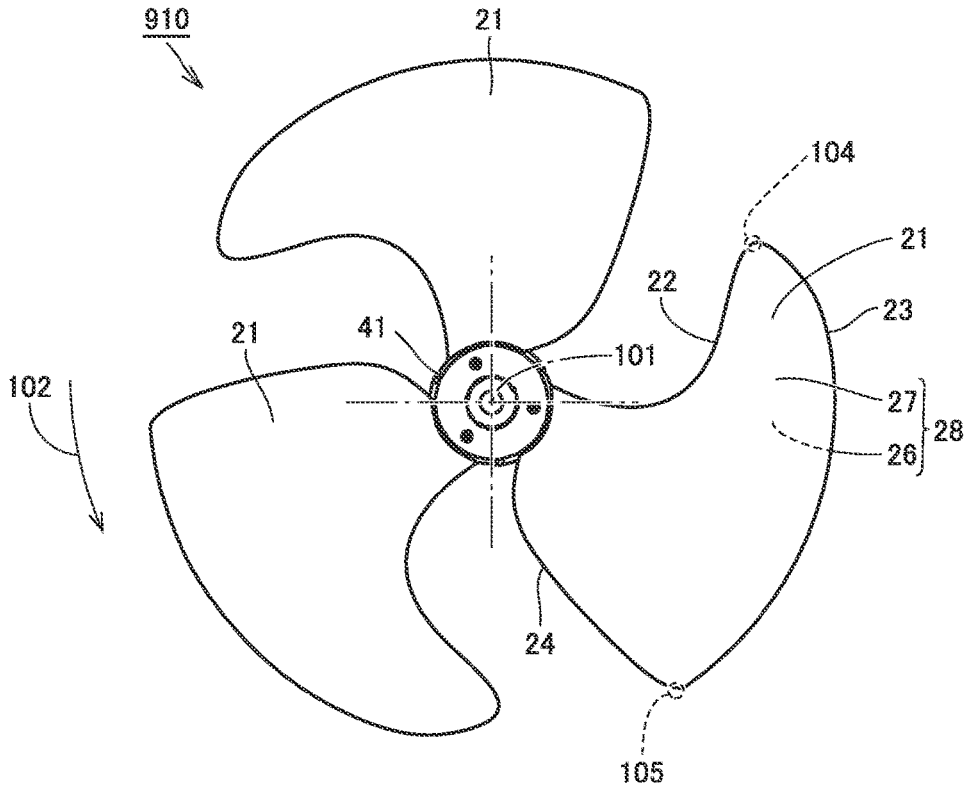
FIG. 53 is a plan view of a propeller fan as a Comparative Example used in the third verification experiment viewed from the suction side.
Figure 54:
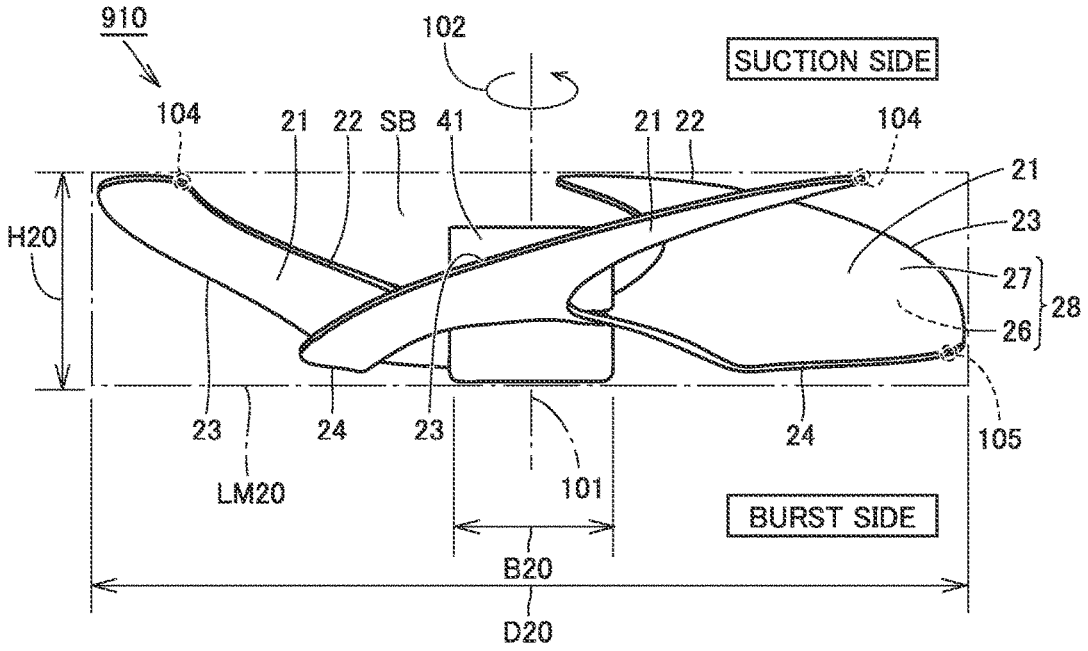
FIG. 54 is a side view showing the propeller fan as Comparative Example used in the third verification experiment.

Referring to FIGS. 53 and 54, propeller fan 910 does not have coupling portion 33 as in propeller fan 180, and blade 21 is formed to be substantially flat. Propeller fan 910 has a diameter D20 which is the same as diameter D1 (180 mm) of propeller fan 180. An occupied space LM20 formed as a result of rotation of propeller fan 910 also has a height H20 in the direction of central axis 101 the same as height H10 (40 mm) of propeller fan 180.

Boss hub portion 41 also has a diameter D20 the same as diameter D10 (30 mm) of boss hub portion 41 in propeller fan 180. A gap SB having a prescribed volume is formed between propeller fan 910 and occupied space LM20. Gap SB is greater than gap SA.

Figure 55:
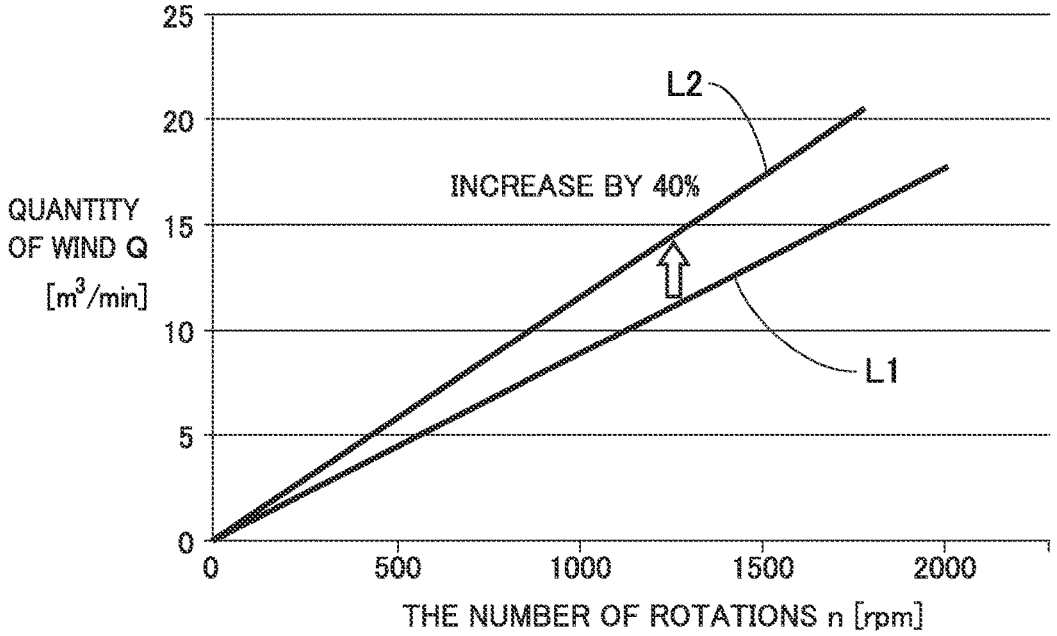
FIG. 55 is a graph showing relation between the number of rotations and a quantity of wind of the propeller fan obtained in a third verification test.

FIG. 55 is a graph showing relation between the number of rotations n (rpm) of propeller fans 180 and 910 and a quantity of wind Q (m3/min.) obtained from each of propeller fans 180 and 910. Relation between the number of rotations n and quantity of wind Q of propeller fan 910 is shown with a line L1. Relation between the number of rotations n and quantity of wind Q of propeller fan 180 is shown with a line L2.

Based on comparison between line L1 and line L2, with the number of rotations n being the same, propeller fan 180 obtains a quantity of wind increased by 40% as compared with propeller fan 910. Therefore, it can be seen that propeller fan 180 can obtain a larger quantity of wind than propeller fan 910 identical in diameter of the propeller fan, height of the occupied space formed as a result of rotation of the propeller fan, and diameter of the boss hub portion.

Figure 56:
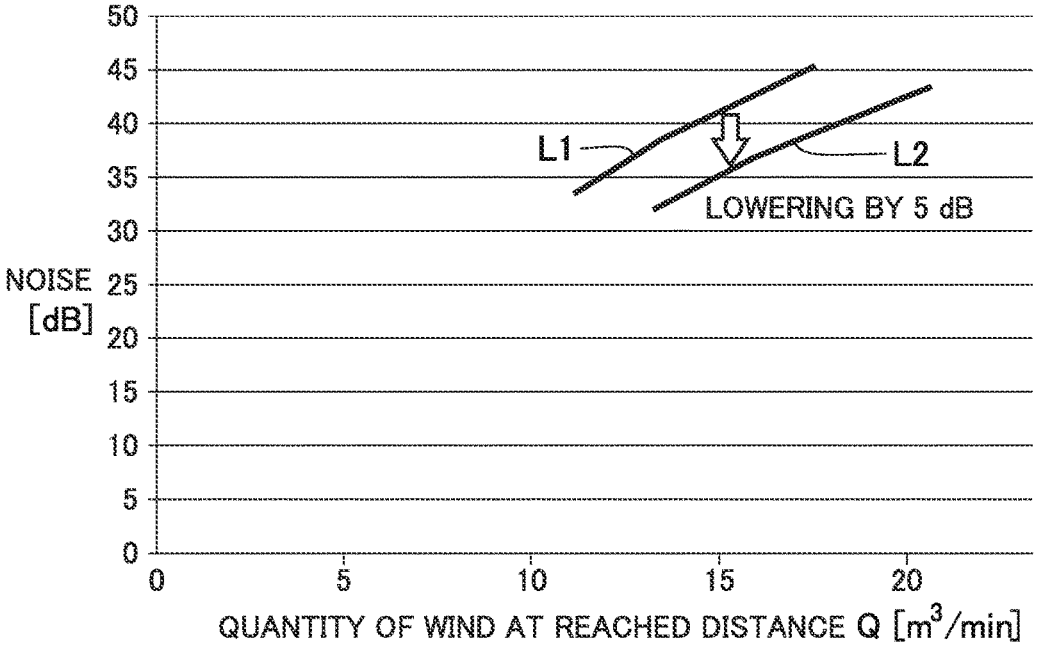
FIG. 56 is a graph showing relation between a quantity of wind at a reached distance and noise of the propeller fan obtained in the third verification test.

FIG. 56 is a graph showing relation between a quantity of wind Q at a reached distance (m3/min.) of propeller fans 180 and 910 and noise (dB) generated from each of propeller fans 180 and 910. Relation between quantity of wind Q at a reached distance and noise of propeller fan 910 is shown with line L1. Relation between quantity of wind Q at a reached distance and noise of propeller fan 180 is shown with line L2.

Based on comparison between line L1 and line L2, with quantity of wind Q at a reached distance being the same, noise generated from propeller fan 180 is lower by 5 dB than noise generated from propeller fan 910. Therefore, it can be seen that propeller fan 180 can achieve lower noise than propeller fan 910 identical in diameter of the propeller fan, height of the occupied space formed as a result of rotation of the propeller fan, and diameter of the boss hub portion.

Figure 57:
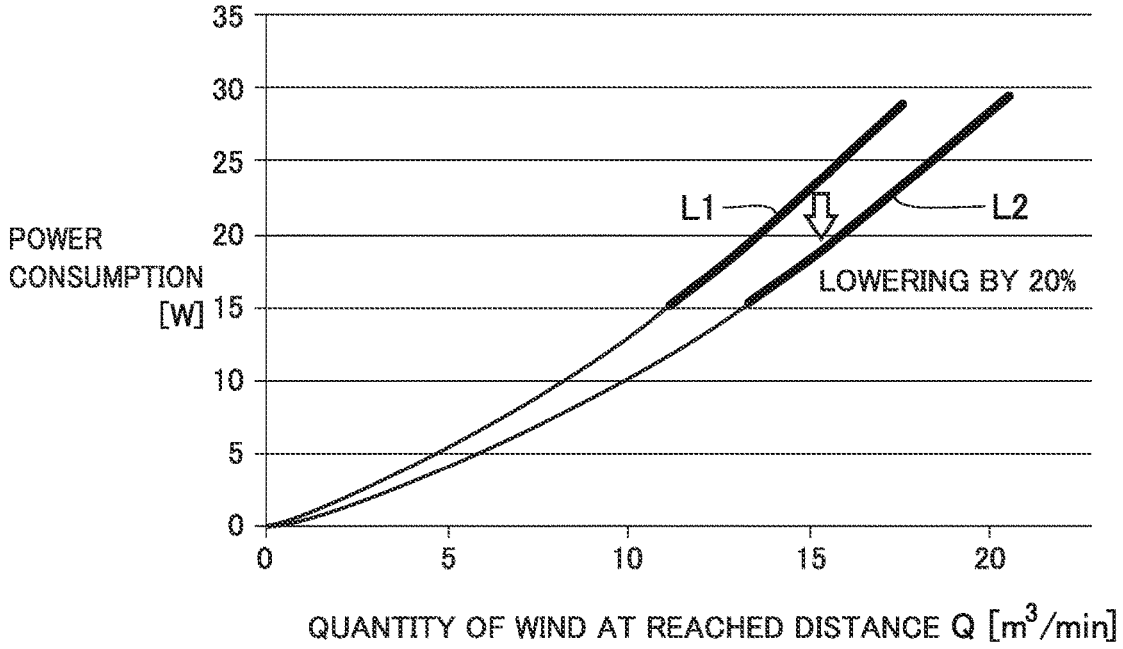
FIG. 57 is a graph showing relation between a quantity of wind at a reached distance and power consumption of the propeller fan obtained in the third verification test.

FIG. 57 is a graph showing relation between quantity of wind Q at a reached distance (m3/min.) of propeller fans 180 and 910 and power consumption (W) in each of propeller fans 180 and 910. Relation between quantity of wind Q at a reached distance and power consumption of propeller fan 910 is shown with line L1. Relation between quantity of wind Q at a reached distance and power consumption of propeller fan 180 is shown with line L2.

Based on comparison between line L1 and line L2, with quantity of wind Q at a reached distance being the same, power consumption in propeller fan 180 is lower by 5% than power consumption in propeller fan 910. Therefore, it can be seen that propeller fan 180 can achieve lowering in power consumption as compared with propeller fan 910 identical in diameter of the propeller fan, height of the occupied space formed as a result of rotation of the propeller fan, and diameter of the boss hub portion.

[Fourth Verification Experiment]

A fourth verification experiment carried out in connection with coupling portion 33 commonly provided in the propeller fans in the embodiments above will be described with reference to FIGS. 58 to 63. In the fourth verification experiment, a quantity of wind, noise, power consumption, and wind velocity distribution obtained during rotation of a propeller fan 190 shown in FIGS. 58 and 59 and propeller fan 910 used in the third verification experiment described above (see FIGS. 53 and 54) were measured.

Figure 58:
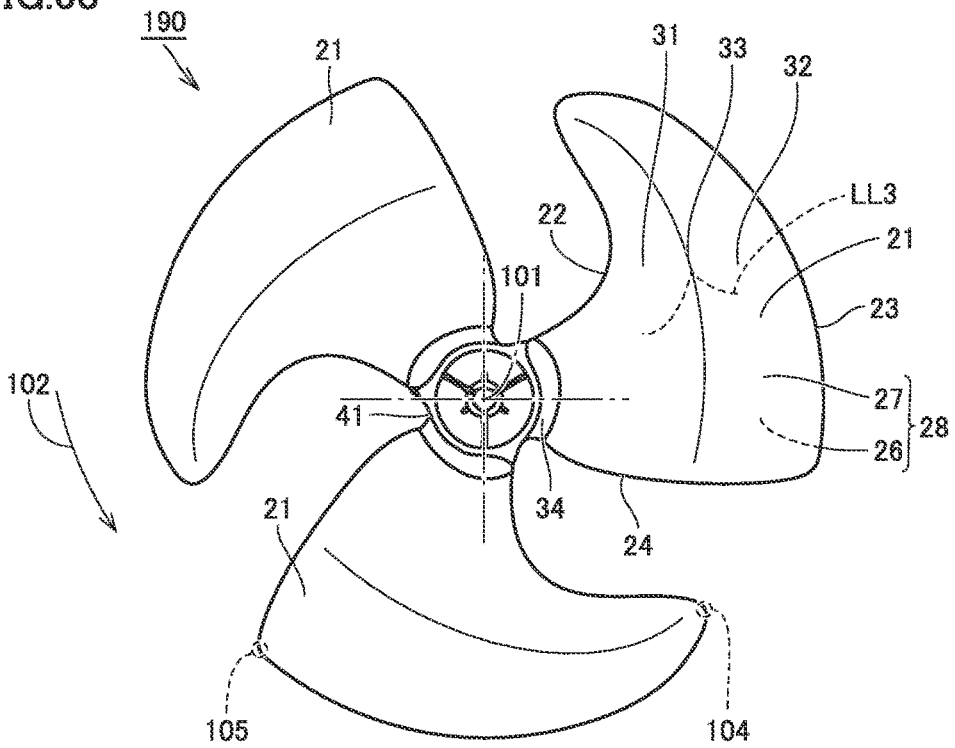
FIG. 58 is a plan view of a propeller fan used in a fourth verification experiment viewed from the suction side.
Figure 59:
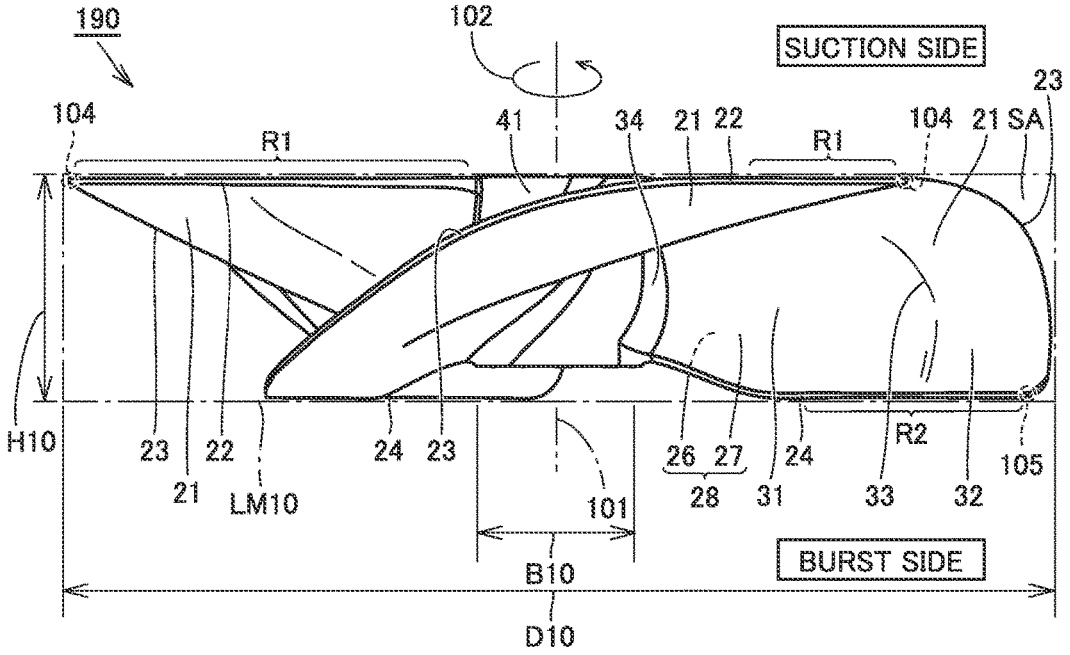
FIG. 59 is a side view showing the propeller fan used in the fourth verification experiment.

As shown in FIGS. 58 and 59, propeller fan 190 is substantially the same in basic shape as propeller fan 180 (see FIGS. 51 and 52) used in the third verification experiment described above. As shown with a dotted line LL3, blade 21 of propeller fan 190 is bent considerably deeply around the center in the direction of rotation of coupling portion 33. An interior angle formed on the side of negative pressure surface 27 of coupling portion 33 is formed to be smaller in propeller fan 190 than in propeller fan 180.

Figure 60:
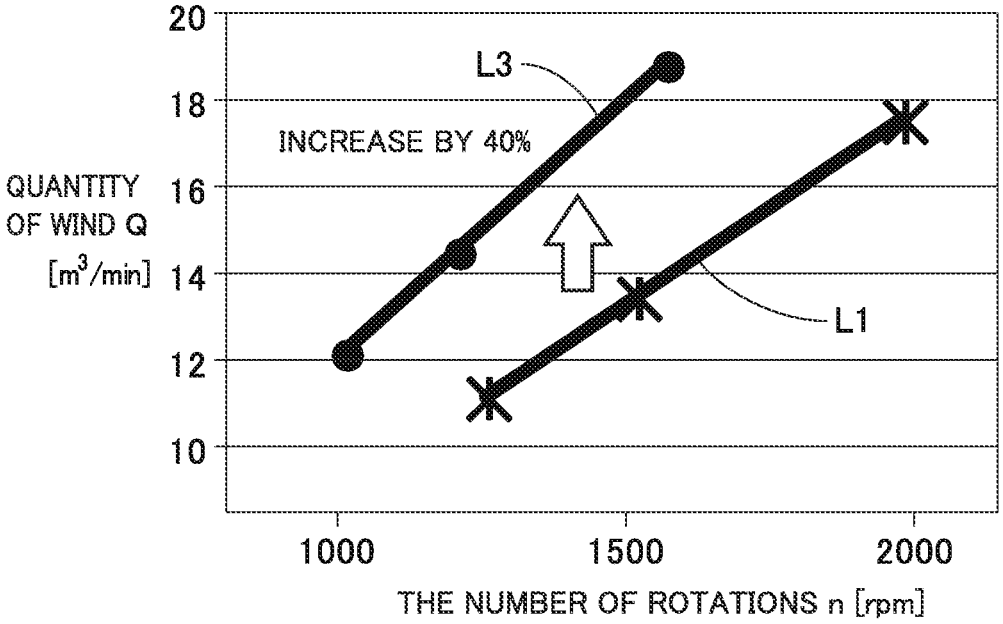
FIG. 60 is a graph showing relation between the number of rotations and a quantity of wind of the propeller fan obtained in a fourth verification test.

FIG. 60 is a graph showing relation between the number of rotations n (rpm) of propeller fans 190 and 910 and quantity of wind Q (m3/min.) obtained from each of propeller fans 190 and 910. Relation between the number of rotations n and quantity of wind Q of propeller fan 910 is shown with line L1. Relation between the number of rotations n and quantity of wind Q of propeller fan 190 is shown with a line L3.

Based on comparison between line L1 and line L3, with the number of rotations n being the same, propeller fan 190 obtains a quantity of wind increased by 40% as compared with propeller fan 910. Therefore, it can be seen that propeller fan 190 can obtain a larger quantity of wind than propeller fan 910 identical in diameter of the propeller fan, height of the occupied space formed as a result of rotation of the propeller fan, and diameter of the boss hub portion.

Figure 61:
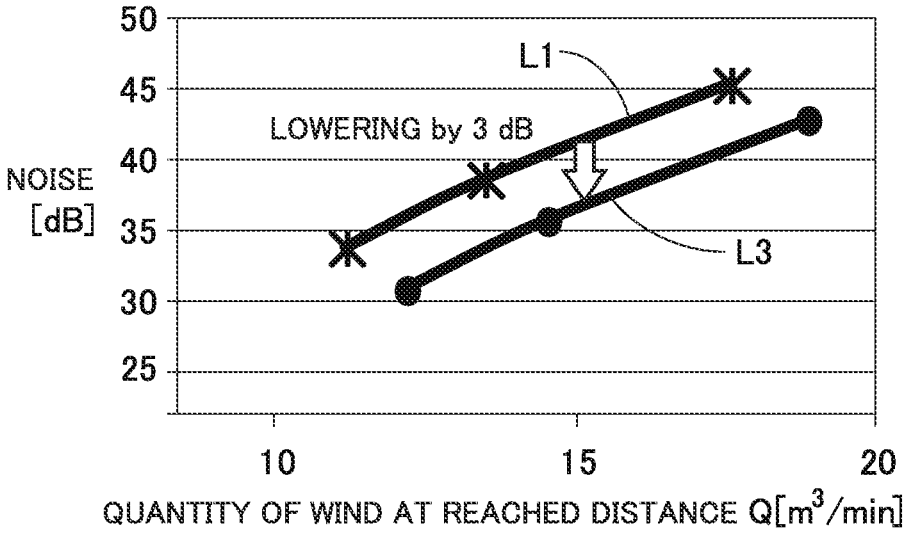
FIG. 61 is a graph showing relation between a quantity of wind at a reached distance and noise of the propeller fan obtained in the fourth verification test.

FIG. 61 is a graph showing relation between quantity of wind Q at a reached distance (m3/min.) of propeller fans 190 and 910 and noise (dB) generated from each of propeller fans 190 and 910. Relation between quantity of wind Q at a reached distance and noise of propeller fan 910 is shown with line L1. Relation between quantity of wind Q at a reached distance and noise of propeller fan 190 is shown with line L3.

Based on comparison between line L1 and line L3, with quantity of wind Q at a reached distance being the same, noise generated from propeller fan 190 is lower by 3 dB than noise generated from propeller fan 910. Therefore, it can be seen that propeller fan 190 can achieve lower noise than propeller fan 910 identical in diameter of the propeller fan, height of the occupied space formed as a result of rotation of the propeller fan, and diameter of the boss hub portion.

Figure 62:
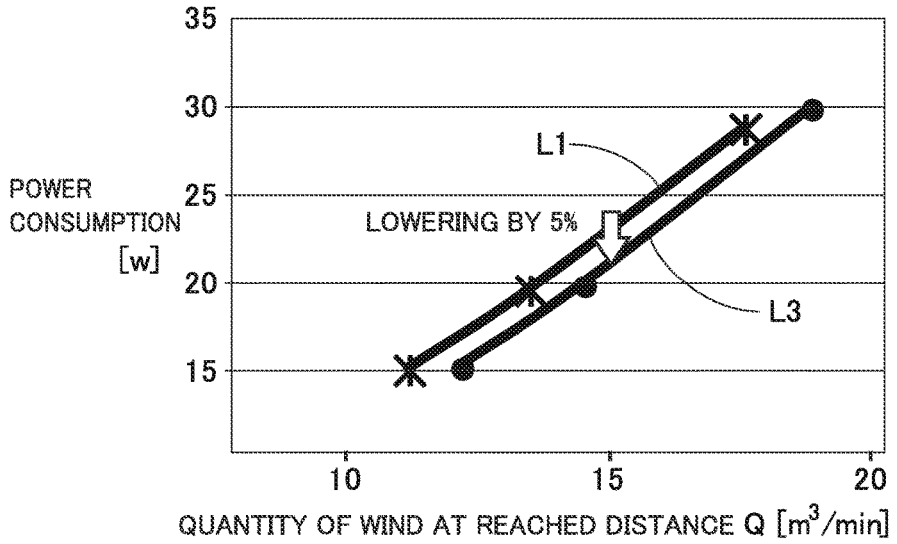
FIG. 62 is a graph showing relation between a quantity of wind at a reached distance and power consumption of the propeller fan obtained in the fourth verification test.

FIG. 62 is a graph showing relation between quantity of wind Q at a reached distance (m3/min.) of propeller fans 190 and 910 and power consumption (W) in each of propeller fans 190 and 910. Relation between quantity of wind Q at a reached distance and power consumption of propeller fan 910 is shown with line L1. Relation between quantity of wind Q at a reached distance and power consumption of propeller fan 190 is shown with line L3.

Based on comparison between line L1 and line L3, with quantity of wind Q at a reached distance being the same, power consumption in propeller fan 190 is lower by 5% than power consumption in propeller fan 910. Therefore, it can be seen that propeller fan 190 can be lower in power consumption than propeller fan 910 identical in diameter of the propeller fan, height of the occupied space formed as a result of rotation of the propeller fan, and diameter of the boss hub portion.

Figure 63:
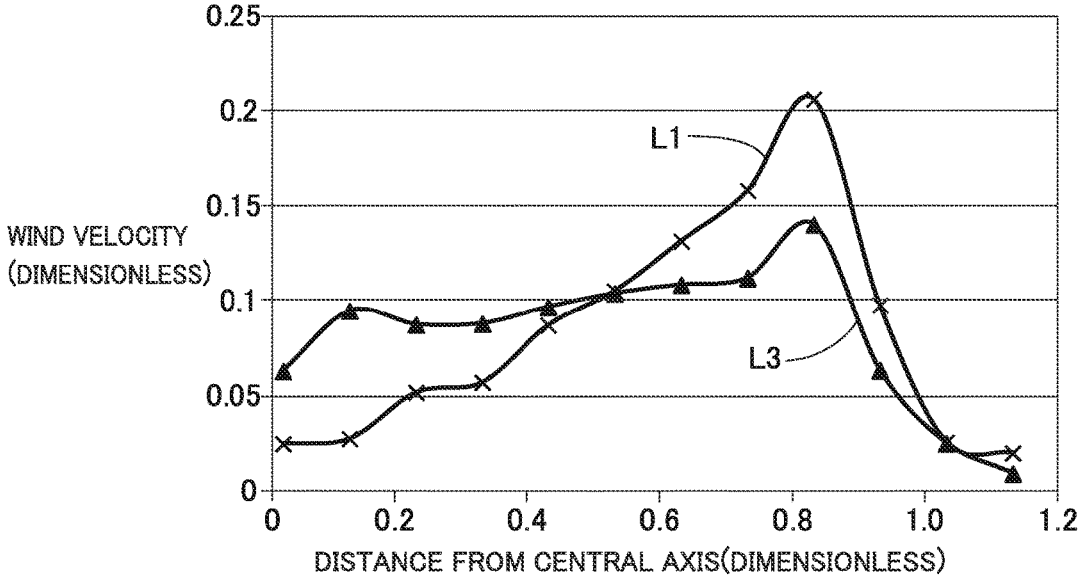
FIG. 63 is a graph showing relation between a distance (dimensionless) from a central axis in a direction of radius and a wind velocity (dimensionless) of the propeller fan obtained in the fourth verification test.

FIG. 63 is a graph showing relation between a distance (dimensionless) from central axis 101 in the direction of radius and a wind velocity (dimensionless) in each of propeller fans 190 and 910. Relation between the distance (dimensionless) from central axis 101 in the direction of radius and the wind velocity (dimensionless) in propeller fan 910 is shown with line L1. Relation between the distance (dimensionless) from central axis 101 in the direction of radius and the wind velocity (dimensionless) in propeller fan 190 is shown with line L3.

Based on comparison between line L1 and line L3, with regard to both of propeller fans 190 and 910, a wind velocity exhibits a high peak value at a position distant by 0.8R (R representing a maximum radius of blade 21 in a plan view of the propeller fan) from central axis 101. On the other hand, it can be seen that, in propeller fan 190, by enhancing capability to send wind on the inner circumferential side around central axis 101 and lowering capability to send wind on the outer circumferential side around central axis 101, a peak of the wind velocity has been eliminated.

Considering the fourth verification experiment, it can be seen that a total quantity of wind can significantly be increased and noise and power consumption can be lowered by providing coupling portion 33 on blade surface 28, making a stagger angle on the inner side of blade surface 28 relatively smaller, making a stagger angle on the outer side of blade surface 28 relatively greater, and forming a sickle shape while making a substantially maximum use of a space which can be occupied in the propeller fan.

When blade surface 28 is formed as being deeply bent in coupling portion 33, a stagger angle which has once attained to the maximum at coupling portion 33 again increases on the side of outer edge portion 23, and a cross-sectional shape of blade surface 28 cut along the direction of radius is raised and lowered along the direction of radius. If blade surface 28 is bent too extremely at coupling portion 33, a shape of blade surface 28 and coupling portion 33 will affect a secondary flow which is not a mainstream generated over blade surface 28 and an effect of effective suppression of generation of noise tends to be lower. Therefore, even when maximum use of a space which can be occupied is made, a degree of curving, a degree of bending, and a shape of coupling portion 33 are desirably determined in consideration of a flow of air such as a mainstream and a horseshoe vortex in the vicinity of coupling portion 33.

[Fifth Verification Experiment]

A fifth verification experiment carried out in connection with coupling portion 33 commonly provided in the propeller fans in the embodiments above will be described with reference to FIGS. 64 to 68. In the fifth verification experiment, a quantity of wind, noise, and power consumption obtained during rotation of a propeller fan 200 shown in FIGS. 64 and 65 and propeller fan 190 used in the fourth verification experiment described above (see FIGS. 58 and 59) were measured.

Figure 64:
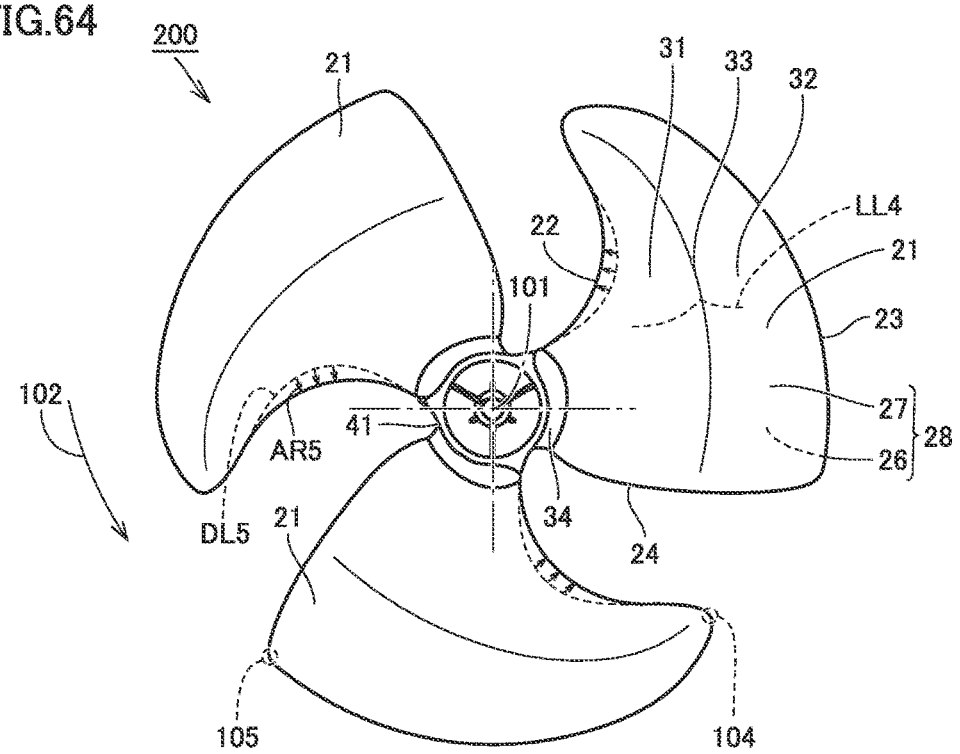
FIG. 64 is a plan view of a propeller fan used in a fifth verification experiment viewed from the suction side.
Figure 65:
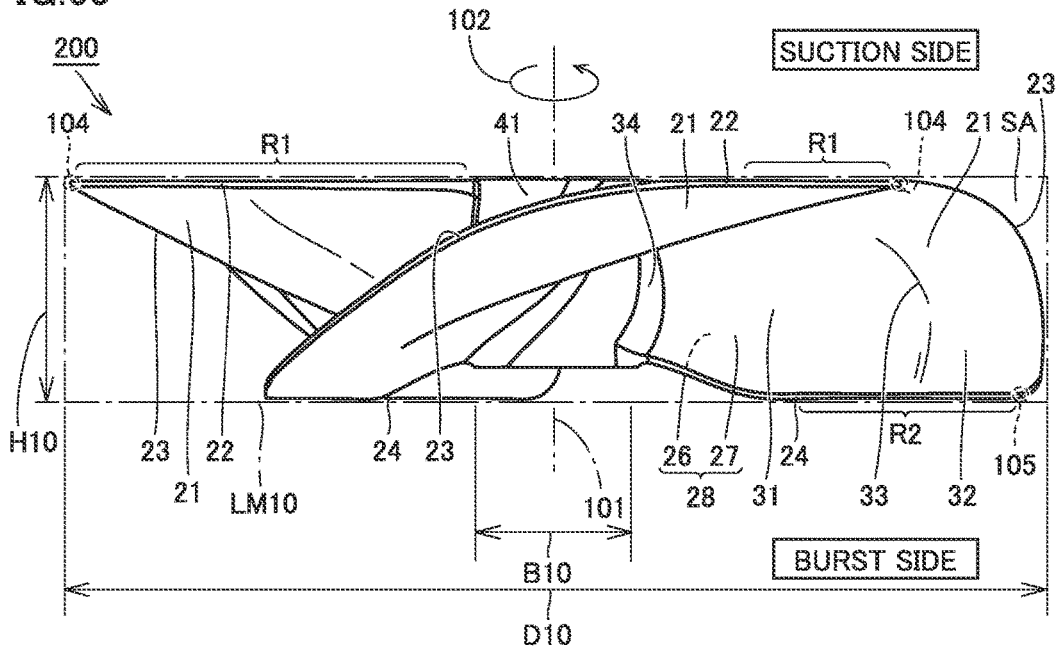
FIG. 65 is a side view showing the propeller fan used in the fifth verification experiment.

As shown in FIGS. 64 and 65, propeller fan 200 is substantially the same in basic shape as propeller fan 190 (see FIGS. 58 and 59) used in the fourth verification experiment described above. As shown with a dotted line LL4, blade 21 of propeller fan 200 is bent gently around the center in the direction of rotation of coupling portion 33. An interior angle formed on the side of negative pressure surface 27 of coupling portion 33 is formed to be greater in propeller fan 200 than in propeller fan 190.

Front edge portion 22 of propeller fan 200 extends forward (see an arrow AR5) in the direction of rotation as compared with front edge portion 22 of propeller fan 190. A dotted line DL54 in FIG. 64 corresponds to a position where front edge portion 22 of propeller fan 190 is formed. A stagger angle in a portion on the inner side in the direction of radius relative to coupling portion 33 is smaller in propeller fan 200 than in propeller fan 190. A stagger angle in the portion on the inner side in the direction of radius relative to coupling portion 33 is closer to a stagger angle in the portion on the outer side in the direction of radius relative to coupling portion 33 in propeller fan 200 than in propeller fan 190.

Figure 66:
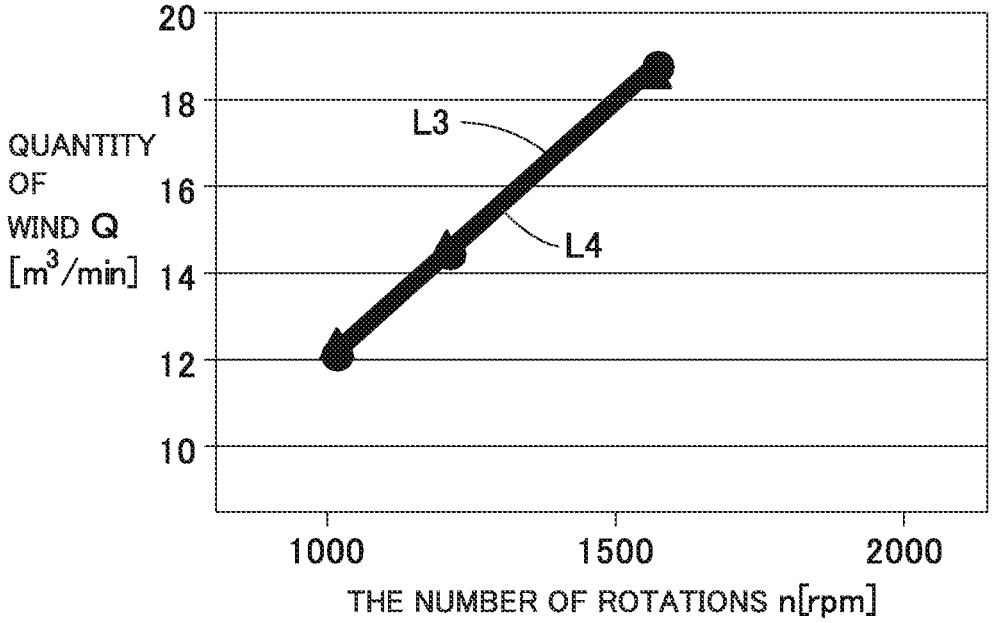
FIG. 66 is a graph showing relation between the number of rotations and a quantity of wind of the propeller fan obtained in a fifth verification test.

FIG. 66 is a graph showing relation between the number of rotations n (rpm) of propeller fans 200 and 190 and quantity of wind Q (m3/min.) obtained from each of propeller fans 200 and 190. Relation between the number of rotations n and quantity of wind Q of propeller fan 200 is shown with a line L4. Relation between the number of rotations n and quantity of wind Q of propeller fan 190 is shown with line L3. Based on comparison between line L3 and line L4, it can be seen that substantially no difference is observed.

Figure 67:
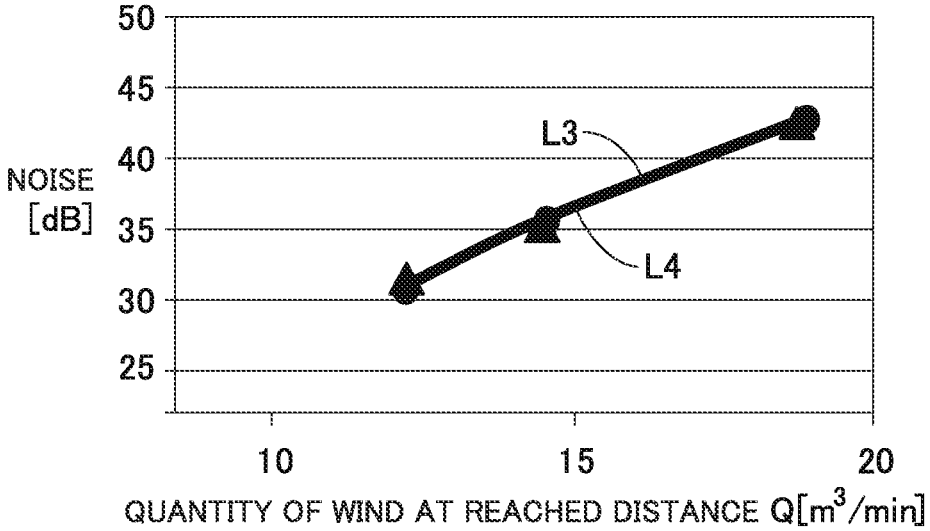
FIG. 67 is a graph showing relation between a quantity of wind at a reached distance and noise of the propeller fan obtained in the fifth verification test.

FIG. 67 is a graph showing relation between quantity of wind Q at a reached distance (m3/min.) of propeller fans 200 and 190 and noise (dB) generated from each of propeller fans 200 and 190. Relation between quantity of wind Q at a reached distance and noise of propeller fan 200 is shown with line L4. Relation between quantity of wind Q at a reached distance and noise of propeller fan 190 is shown with line L3. Based on comparison between line L3 and line L4, it can be seen that substantially no difference is observed.

Figure 68:
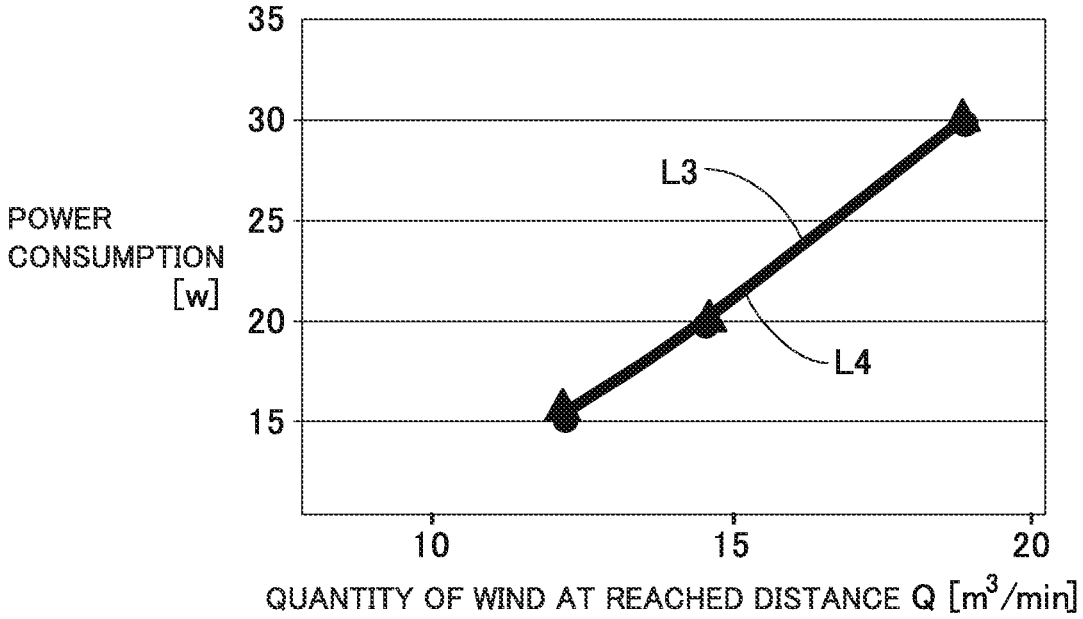
FIG. 68 is a graph showing relation between a quantity of wind at a reached distance and power consumption of the propeller fan obtained in the fifth verification test.

FIG. 68 is a graph showing relation between quantity of wind Q at a reached distance (m3/min.) of propeller fans 200 and 190 and power consumption (W) in each of propeller fans 200 and 190. Relation between quantity of wind Q at a reached distance and power consumption of propeller fan 200 is shown with line L4. Relation between quantity of wind Q at a reached distance and power consumption of propeller fan 190 is shown with line L3. Based on comparison between line L3 and line L4, it can be seen that substantially no difference is observed.

[Sixth Verification Experiment]

A sixth verification experiment carried out in connection with coupling portion 33 commonly provided in the propeller fans in the embodiments above will be described with reference to FIGS. 69 to 73. In the sixth verification experiment, a quantity of wind, noise, and power consumption obtained during rotation of a propeller fan 210 shown in FIGS. 69 and 70 and propeller fan 190 used in the fourth verification experiment described above (see FIGS. 58 and 59) were measured.

Figure 69:
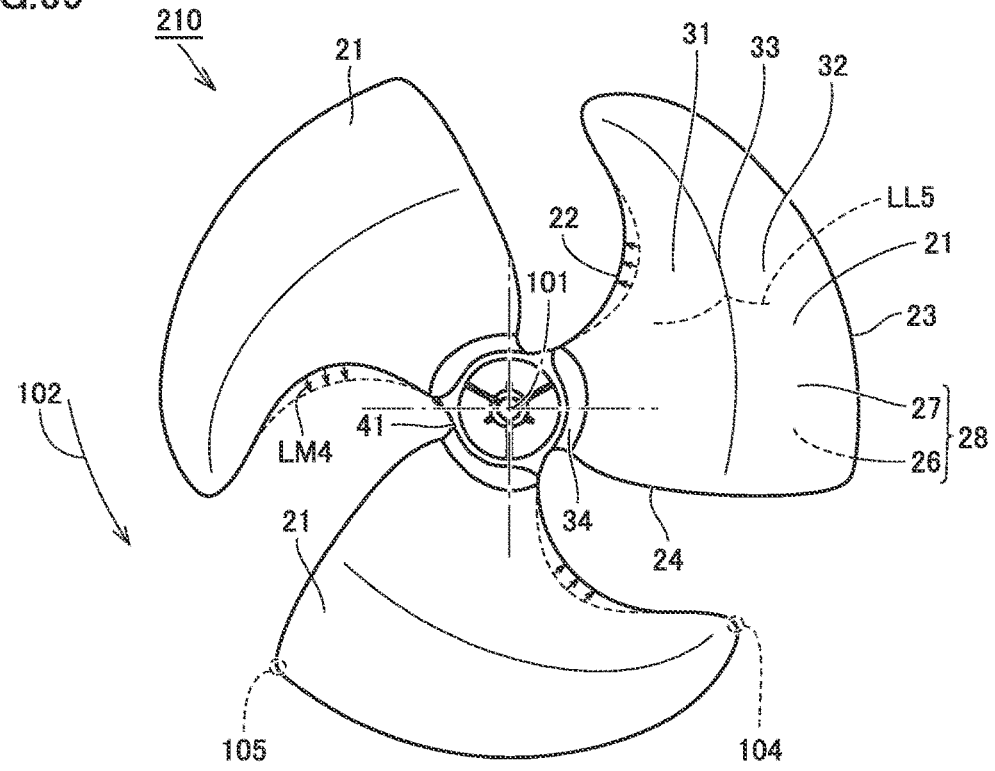
FIG. 69 is a plan view of a propeller fan used in a sixth verification experiment viewed from the suction side.
Figure 70:
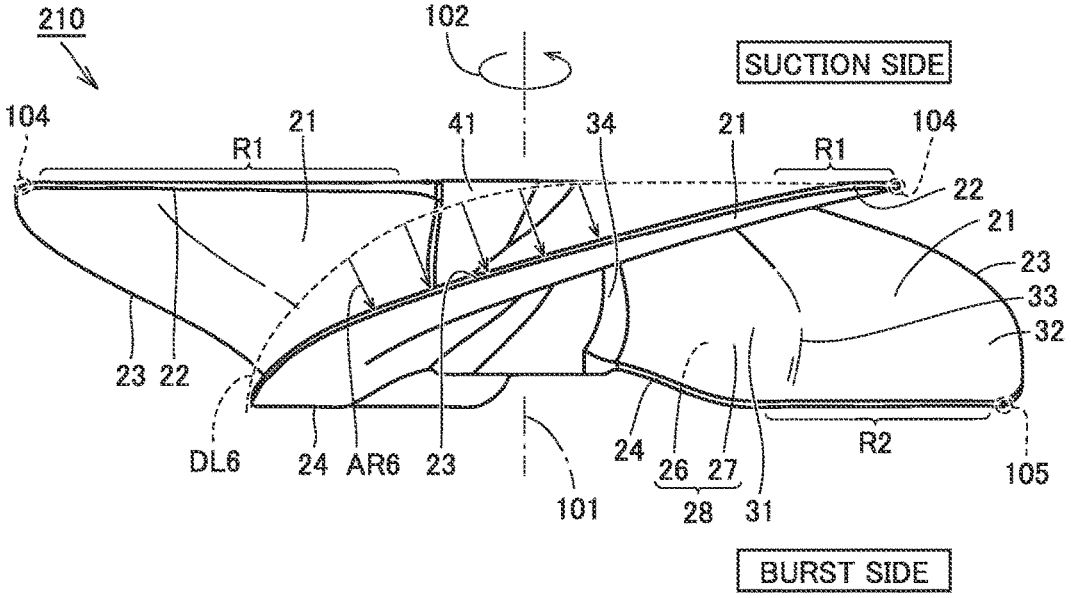
FIG. 70 is a side view showing the propeller fan used in the sixth verification experiment.

As shown in FIGS. 69 and 70, propeller fan 210 is substantially the same in basic shape as propeller fan 190 (see FIGS. 58 and 59) used in the fourth verification experiment described above. As shown with a dotted line LL5, blade 21 of propeller fan 210 is bent gently around the center in the direction of rotation of coupling portion 33. An interior angle formed on the side of negative pressure surface 27 of coupling portion 33 is formed to be greater in propeller fan 210 than in propeller fan 190.

As shown with an arrow AR6 in FIG. 70, in propeller fan 210, outer edge portion 23 on the outer side of coupling portion 33 is located toward the burst side (see arrow AR6)

as compared with that in propeller fan 190. A dotted line DL6 in FIG. 70 corresponds to a position where outer edge portion 23 on the outer side relative to coupling portion 33 in propeller fan 190 is formed. A stagger angle in the portion on the outer side in the direction of radius relative to coupling portion 33 is smaller in propeller fan 210 than in propeller fan 190.

Figure 71:
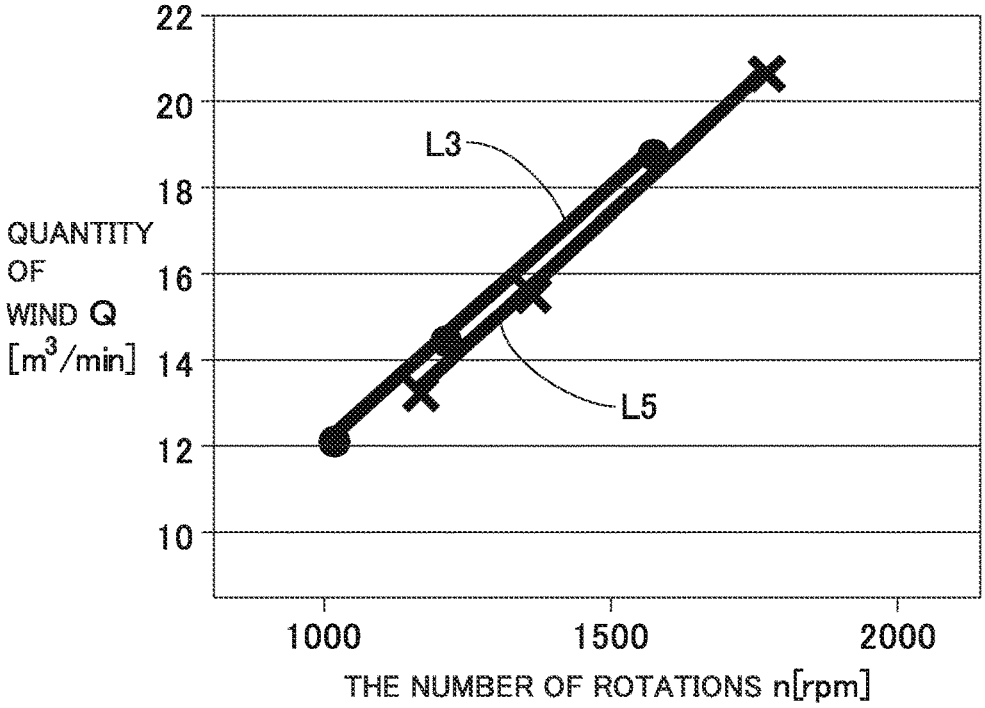
FIG. 71 is a graph showing relation between the number of rotations and a quantity of wind of the propeller fan obtained in a sixth verification test.

FIG. 71 is a graph showing relation between the number of rotations n (rpm) of propeller fans 210 and 190 and quantity of wind Q (m3/min.) obtained from each of propeller fans 210 and 190. Relation between the number of rotations n and quantity of wind Q of propeller fan 210 is shown with a line L5. Relation between the number of rotations n and quantity of wind Q of propeller fan 190 is shown with line L3.

Based on comparison between line L3 and line L5, with the number of rotations n being the same, it can be seen that propeller fan 210 obtains a quantity of wind slightly smaller than but substantially the same as that of propeller fan 190. Therefore, with the number of rotations n being the same, propeller fan 190 obtains a quantity of wind increased by 40% as compared with propeller fan 910 (see FIGS. 53 and 54) used in the third verification experiment described above.

Figure 72:
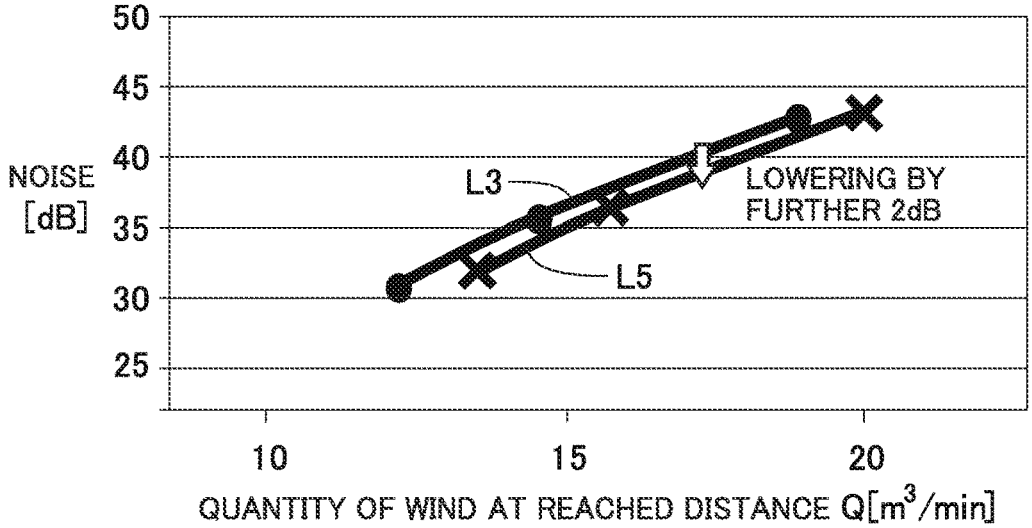
FIG. 72 is a graph showing relation between a quantity of wind at a reached distance and noise of the propeller fan obtained in the sixth verification test.

FIG. 72 is a graph showing relation between quantity of wind Q at a reached distance (m3/min.) of propeller fans 210 and 190 and noise (dB) generated from each of propeller fans 210 and 190. Relation between quantity of wind Q at a reached distance and noise of propeller fan 210 is shown with line L5. Relation between quantity of wind Q at a reached distance and noise of propeller fan 190 is shown with line L3.

Based on comparison between line L5 and line L3, with quantity of wind Q at a reached distance being the same, noise generated from propeller fan 210 is lower by further 2 dB than noise generated from propeller fan 190. Therefore, it can be seen that propeller fan 210 can achieve further lower noise than propeller fan 190 identical in diameter of the propeller fan, height of the occupied space formed as a result of rotation of the propeller fan, and diameter of the boss hub portion.

Figure 73:
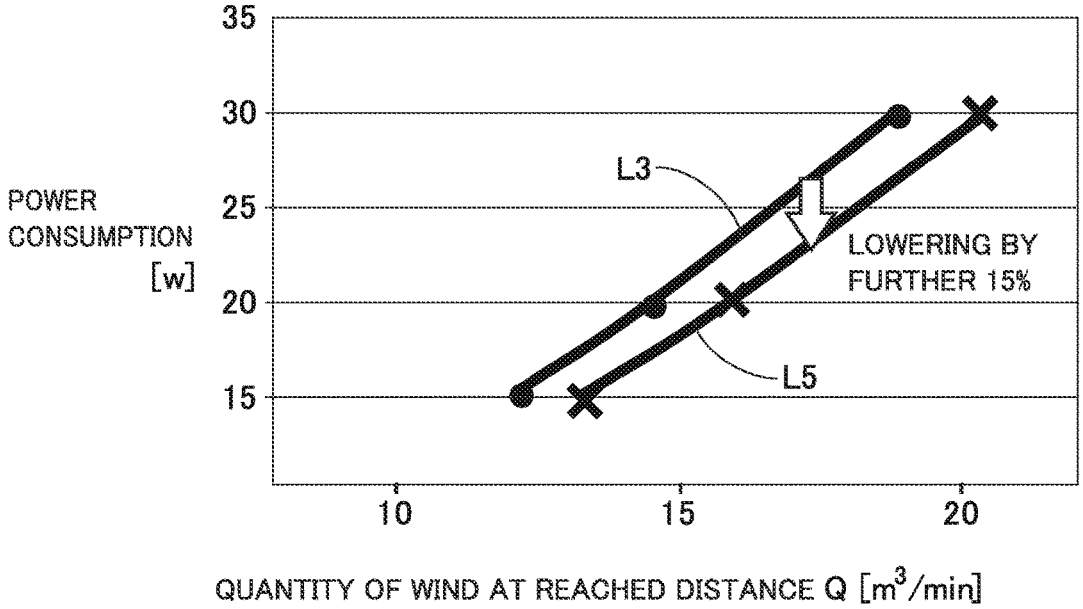
FIG. 73 is a graph showing relation between a quantity of wind at a reached distance and power consumption of the propeller fan obtained in the sixth verification test.

FIG. 73 is a graph showing relation between quantity of wind Q at a reached distance (m3/min.) of propeller fans 210 and 190 and power consumption (W) in each of propeller fans 210 and 190. Relation between quantity of wind Q at a reached distance and power consumption of propeller fan 210 is shown with line L5. Relation between quantity of wind Q at a reached distance and power consumption of propeller fan 190 is shown with line L3.

Based on comparison between line L5 and line L3, with quantity of wind Q at a reached distance being the same, power consumption in propeller fan 210 is lower by further 15% than power consumption in propeller fan 190. Therefore, it can be seen that propeller fan 210 can be further lower in power consumption than propeller fan 190 identical in diameter of the propeller fan, height of the occupied space formed as a result of rotation of the propeller fan, and diameter of the boss hub portion.

Considering the sixth verification experiment, in propeller fan 210, a maximum use of a space which can be occupied in the propeller fan is made on the inner side relative to coupling portion 33 and a stagger angle is made greater on the outer side relative to coupling portion 33. It can be seen that, by lowering a height on the outer side in the direction of radius of outer edge portion 23 and having such a smooth curved surface that a stagger angle monotonously increases on the outer side in the direction of radius, a secondary flow flows appropriately with low resistance, turbulence and noise are lowered, and power consumption (flow loss) can also be lowered.

[Seventh Verification Experiment]

A seventh verification experiment carried out in connection with a reverse camber structure commonly provided in the propeller fans in the embodiments above will be described with reference to FIGS. 74 to 80. In the seventh verification experiment, a quantity of wind, noise, and power consumption obtained during rotation of a propeller fan 220 shown in FIGS. 74 to 77 and propeller fan 210 used in the sixth verification experiment described above (see FIGS. 69 and 70) were measured.

Figure 74:
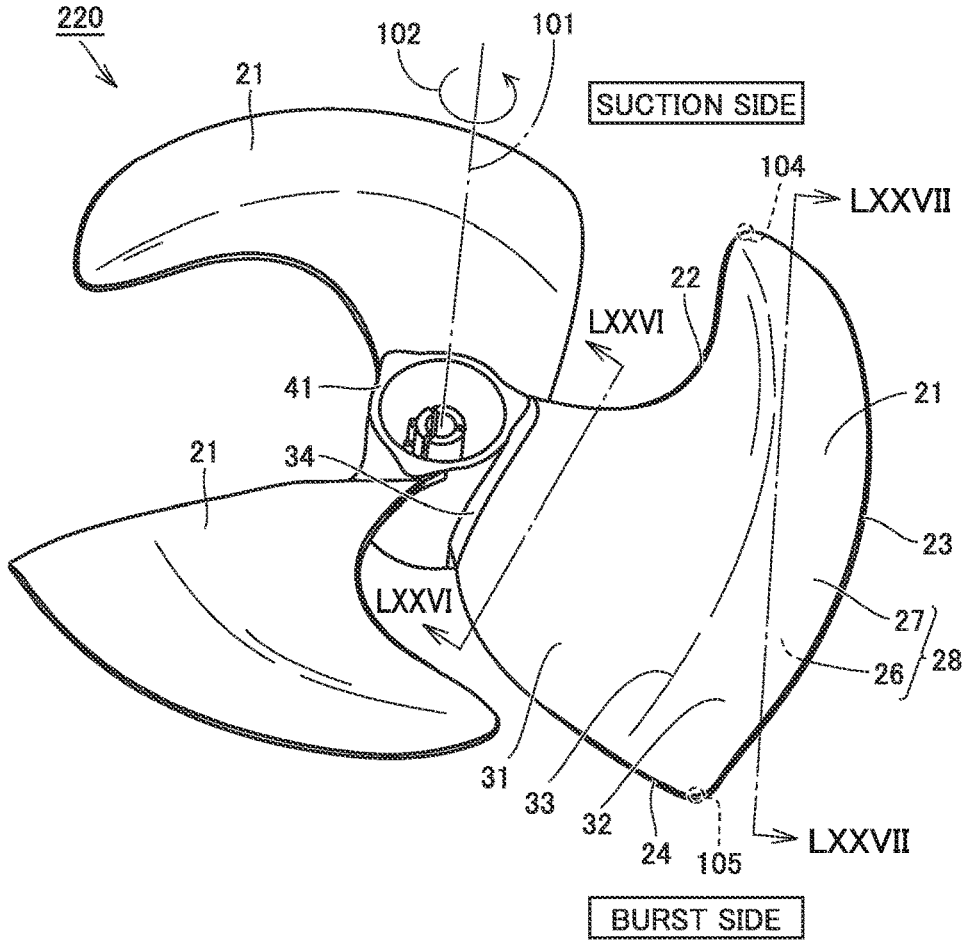
FIG. 74 is a perspective view of a propeller fan used in a seventh verification experiment viewed from the suction side.
Figure 75:
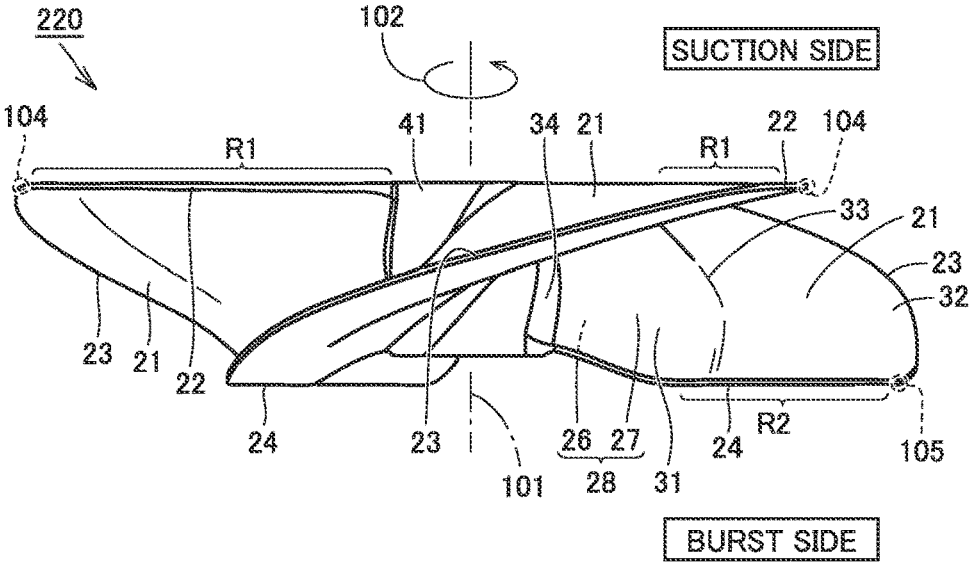
FIG. 75 is a side view showing the propeller fan used in the seventh verification experiment.
Figure 76:
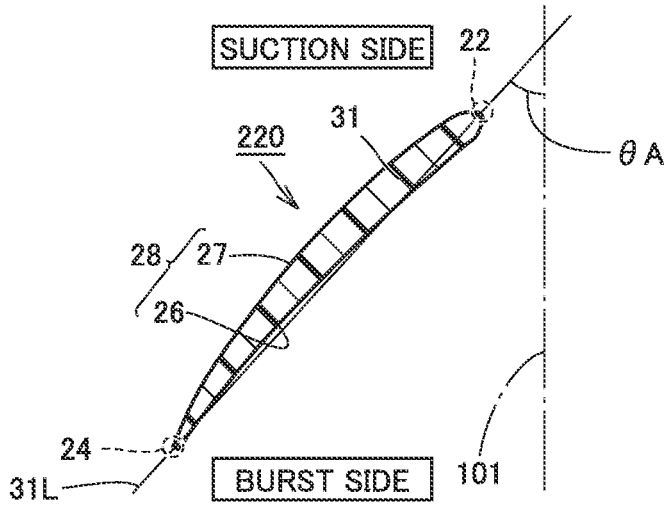
FIG. 76 is a cross-sectional view in a direction of an arrow along the line LXXVI-LXXVI in FIG. 74.
Figure 77:
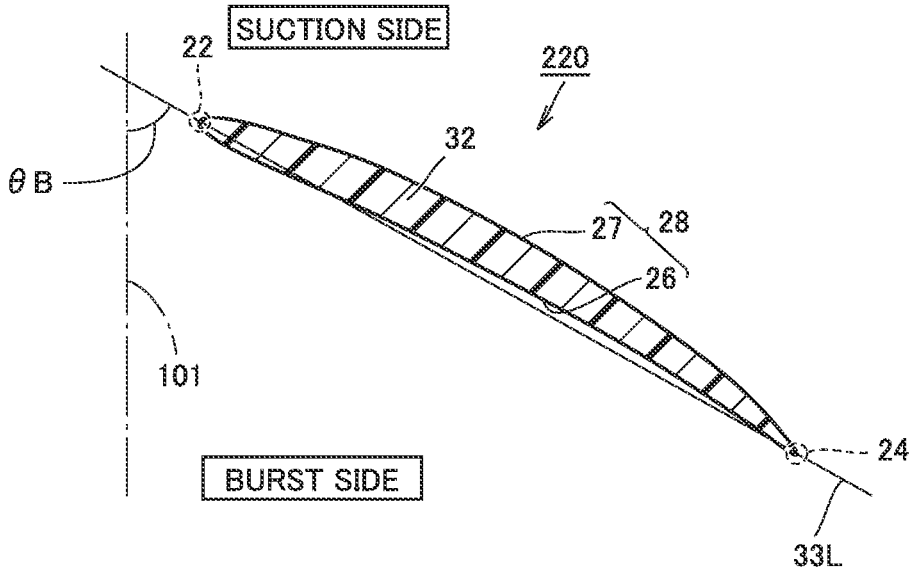
FIG. 77 is a cross-sectional view in a direction of an arrow along the line LXXVII-LXXVII in FIG. 74.

FIG. 74 is a perspective view of propeller fan 220 viewed from the suction side. FIG. 75 is a side view of propeller fan 220. FIG. 76 is a cross-sectional view in a direction of an arrow along the line LXXVI-LXXVI in FIG. 74. FIG. 77 is a cross-sectional view in a direction of an arrow along the line LXXVII-LXXVII in FIG. 74.

As shown in FIGS. 74 and 75, propeller fan 220 is substantially the same in basic shape as propeller fan 210 (see FIGS. 69 and 70) used in the sixth verification experiment described above. Propeller fan 210 has the reverse camber structure. Propeller fan 220 does not have the reverse camber structure but has what is called a forward camber structure.

As shown in FIGS. 74 to 76, inner region 31 of blade 21 in propeller fan 220 is curved such that a bulge portion of inner region 31 is distant from virtual straight line 31L toward the suction side with front edge portion 22 and rear edge portion 24 being defined as opposing ends and has a warped shape such that the side of positive pressure surface 26 of blade surface 28 (inner region 31) is recessed and the side of negative pressure surface 27 of blade surface 28 (inner region 31) is projecting.

As shown in FIGS. 74, 75, and 77, outer region 32 of blade 21 in propeller fan 220 is curved such that a bulge portion of outer region 32 is distant from virtual straight line 33L toward the suction side with front edge portion 22 and rear edge portion 24 being defined as opposing ends and has a warped shape such that the side of positive pressure surface 26 of blade surface 28 (outer region 32) is recessed and the side of negative pressure surface 27 of blade surface 28 (outer region 32) is projecting.

Referring to FIGS. 76 and 77, blade 21 in propeller fan 220 has a warped shape in blade root portion 34 and inner region 31 such that the side of positive pressure surface 26 is recessed and the side of negative pressure surface 27 is projecting and has a warped shape also in outer region 32 and outer edge portion 23 such that the side of positive pressure surface 26 is recessed and the side of negative pressure surface 27 is projecting (the forward camber structure).

Figure 78:
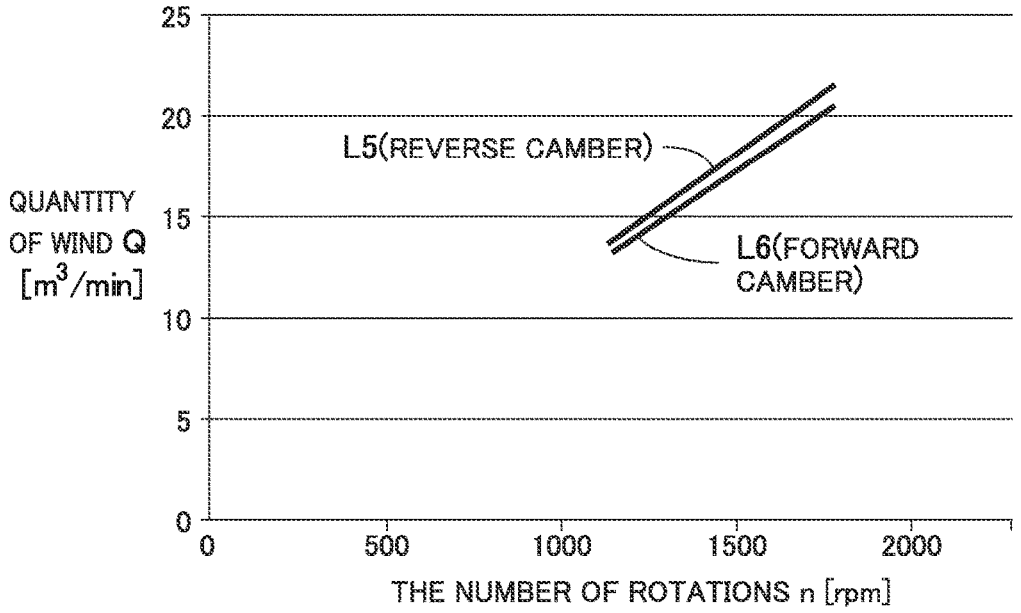
FIG. 78 is a graph showing relation between the number of rotations and a quantity of wind of the propeller fan obtained in a seventh verification test.

FIG. 78 is a graph showing relation between the number of rotations n (rpm) of propeller fans 220 and 210 and quantity of wind Q (m3/min.) obtained from each of propeller fans 220 and 210. Relation between the number of rotations n and quantity of wind Q of propeller fan 220 is shown with a line L6. Relation between the number of rotations n and quantity of wind Q of propeller fan 210 is shown with line L5.

Based on comparison between line L5 and line L6, it can be seen that, with the number of rotations n being the same, propeller fan 220 obtains a quantity of wind slightly smaller than but substantially the same as that of propeller fan 210. With the number of rotations n being the same, even propeller fan 220 having the forward camber structure can obtain a quantity of wind increased by 40% as compared with propeller fan 910 (see FIGS. 53 and 54) used in the third verification experiment described above.

Figure 79:
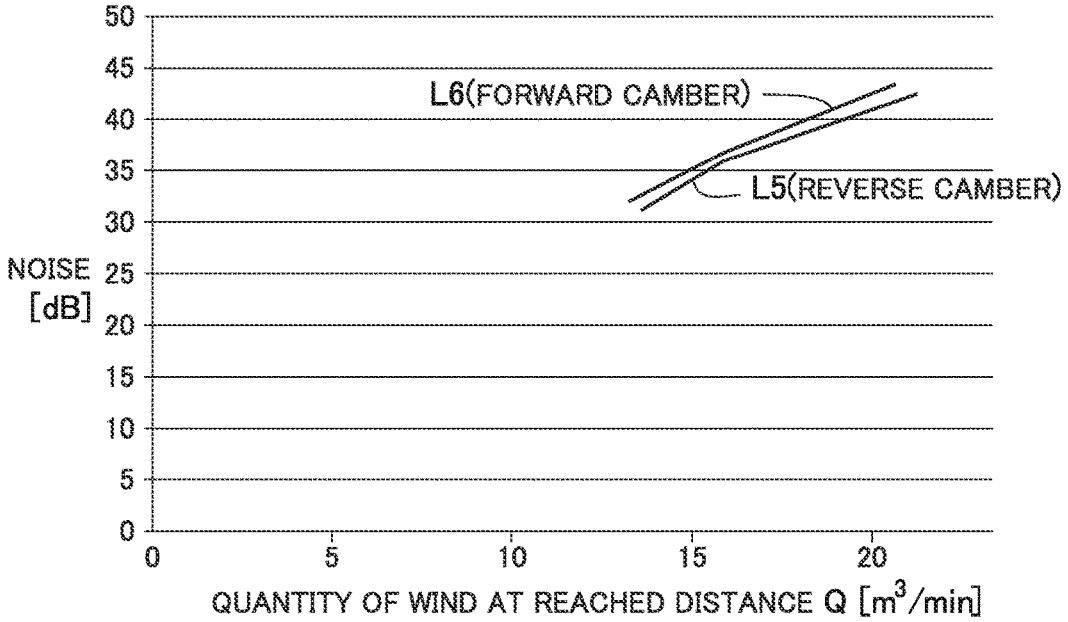
FIG. 79 is a graph showing relation between a quantity of wind at a reached distance and noise of the propeller fan obtained in the seventh verification test.

FIG. 79 is a graph showing relation between quantity of wind Q at a reached distance (m3/min.) of propeller fans 220 and 210 and noise (dB) generated from each of propeller fans 220 and 210. Relation between quantity of wind Q at a reached distance and noise of propeller fan 220 is shown with line L6. Relation between quantity of wind Q at a reached distance and noise of propeller fan 210 is shown with line L5.

Based on comparison between line L5 and line L6, it can be seen that, with quantity of wind Q at a reached distance being the same, noise generated from propeller fan 220 is slightly higher than noise generated from propeller fan 210. With quantity of wind Q at a reached distance being the same, even propeller fan 220 having the forward camber structure can achieve lower noise than propeller fan 910 (see FIGS. 53 and 54) used in the third verification experiment described above.

Figure 80:
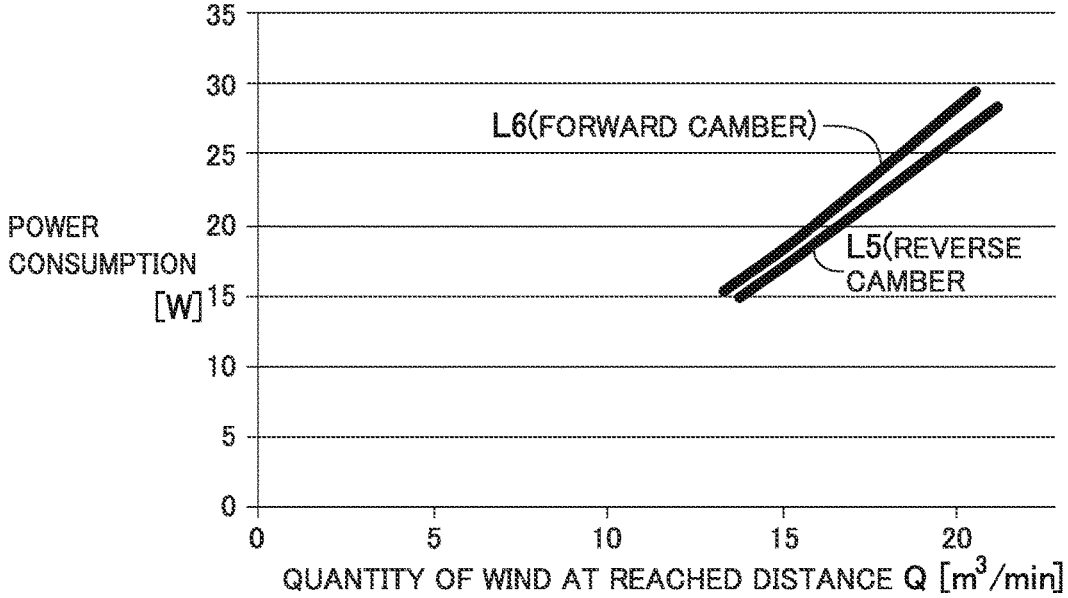
FIG. 80 is a graph showing relation between a quantity of wind at a reached distance and power consumption of the propeller fan obtained in the seventh verification test.

FIG. 80 is a graph showing relation between quantity of wind Q at a reached distance (m3/min.) of propeller fans 220 and 210 and power consumption (W) in each of propeller fans 220 and 210. Relation between quantity of wind Q at a reached distance and power consumption of propeller fan 220 is shown with line L6. Relation between quantity of wind Q at a reached distance and power consumption of propeller fan 210 is shown with line L5.

Based on comparison between line L5 and line L6, with quantity of wind Q at a reached distance being the same, power consumption in propeller fan 220 slightly increases as compared with power consumption in propeller fan 210. With quantity of wind Q at a reached distance being the same, even propeller fan 220 having the forward camber structure can be lower in power consumption than propeller fan 910 (see FIGS. 53 and 54) used in the third verification experiment described above.

Considering the seventh verification experiment, it can be seen that the reverse camber structure is superior to the forward camber structure in terms of a quantity of wind, noise, and power consumption. Depending on relation between a height and a cord length dimension of blade surface 28, wind may not satisfactorily be sent in blade root portion 34. In such a case, it can be seen that the reverse camber structure is desirably adopted. It has been found that, when a propeller fan has a diameter of 180 mm, boss hub portion 41 has a diameter of 30 mm, and an occupied space formed as a result of rotation of the propeller fan has a height in the direction of central axis 101 of 40 mm, the reverse camber structure obtains an effect noticeably better than the forward camber structure.

Figure 81:
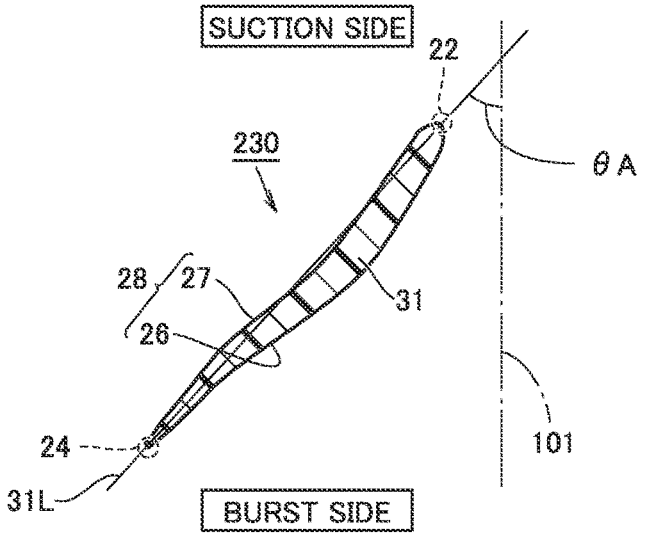
FIG. 81 is a cross-sectional view showing a variation of a propeller fan in connection with the seventh verification experiment.

FIG. 81 is a cross-sectional view showing a variation of the propeller fan used in the seventh verification experiment, which is a diagram obtained at the time when the propeller fan in the variation is cut along the cut surface the same as in FIG. 76. It has been found that a cross-sectional view along the circumferential direction around central axis 101 may also desirably be formed to exhibit an S shape as in blade root portion 34 of blade 21 in a propeller fan 230 shown in FIG. 81. In this case as well, stagger angle θA in blade root portion 34 is smaller than stagger angle θB in outer edge portion 23.

Inner region 31 of propeller fan 230 is formed such that a warped shape curved as being distant from virtual straight line 31L toward the burst side and a warped shape curved as being distant from virtual straight line 31L toward the suction side continue in an S shape as a whole from front edge portion 22 toward rear edge portion 24. Depending on relation between a height and a cord length dimension of blade surface 28, wind may not satisfactorily be sent in blade root portion 34. In such a case, with blade root portion 34 being formed in an S shape in a cross-sectional view, wind can satisfactorily be sent. Such a construction (an S-shaped camber structure) can be enabled independently of the technical concept of provision of coupling portion 33 in blade surface 28.

Fifth Embodiment (Fluid Feeder 610)

Figure 82:
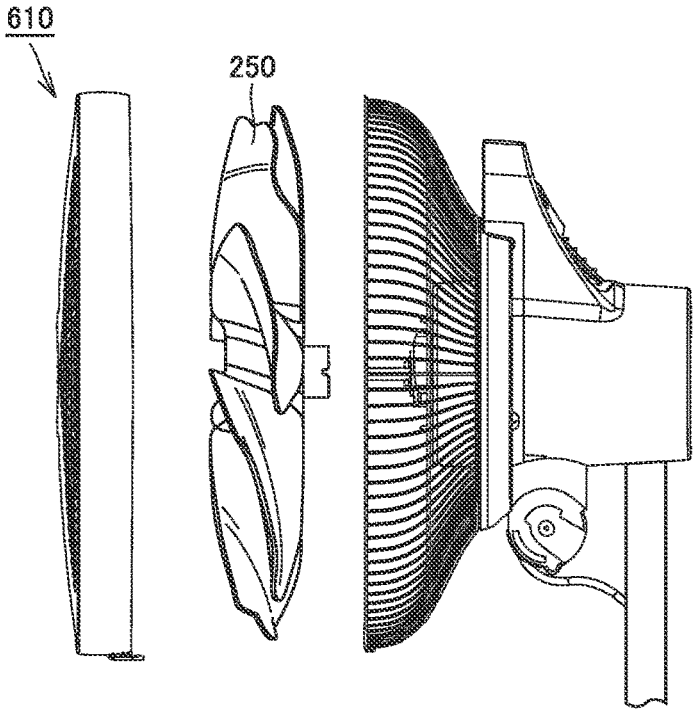
FIG. 82 is a side view showing in an exploded manner, a fluid feeder in a fifth embodiment.

A fluid feeder 610 in the present embodiment will be described with reference to FIG. 82. Fluid feeder 610 in the present embodiment can be used, for example, as an electric fan. Fluid feeder 610 has a propeller fan 250 and a drive motor (not shown).

(Propeller Fan 250)

Figure 83:
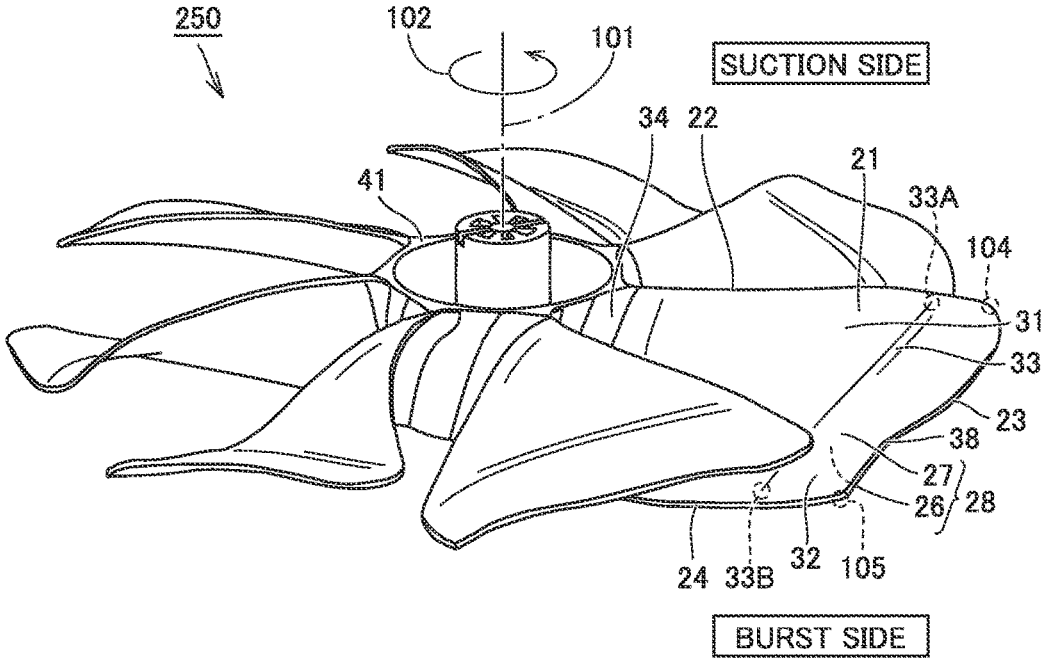
FIG. 83 is a perspective view of a propeller fan in the fifth embodiment viewed from the suction side.
Figure 84:
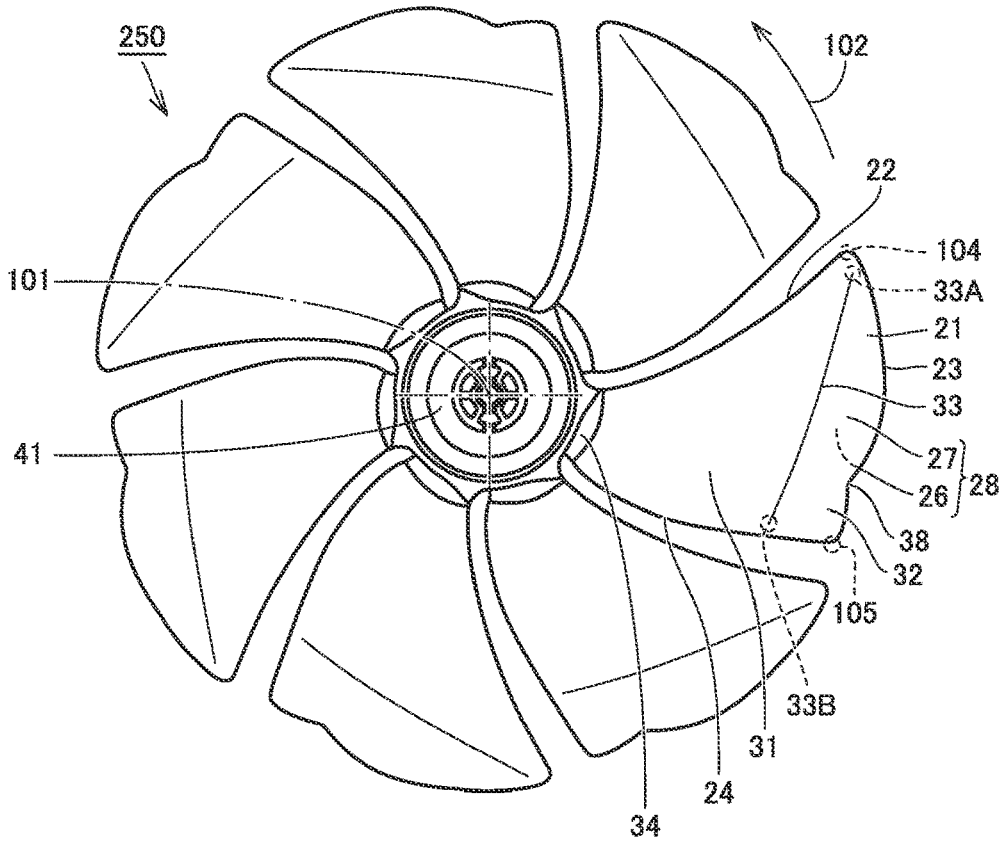
FIG. 84 is a plan view of the propeller fan in the fifth embodiment viewed from the suction side.
Figure 85:
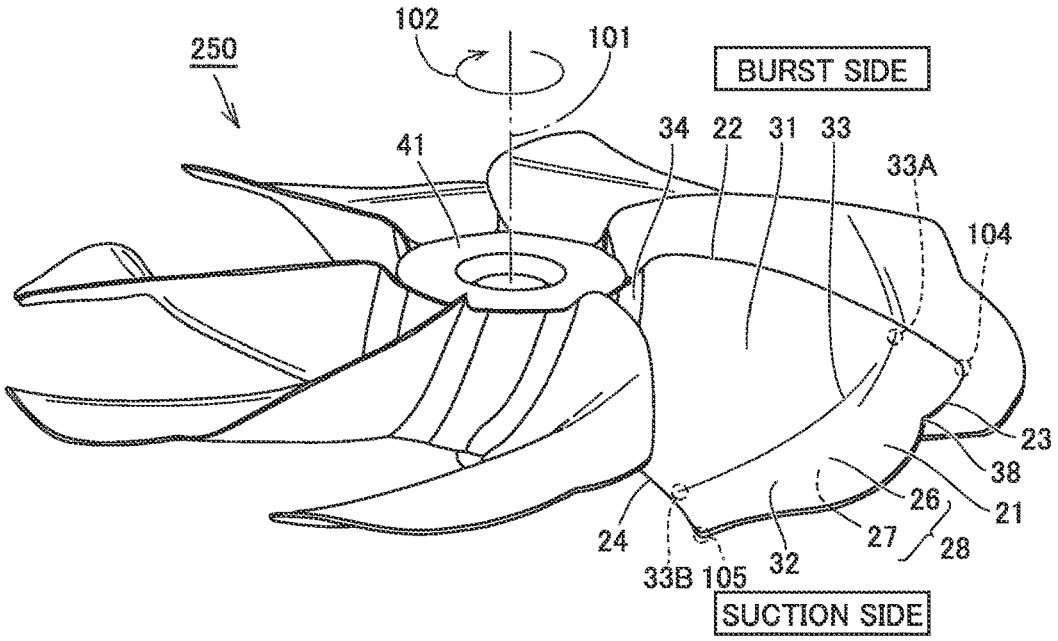
FIG. 85 is a perspective view of the propeller fan in the fifth embodiment viewed from the burst side.
Figure 86:
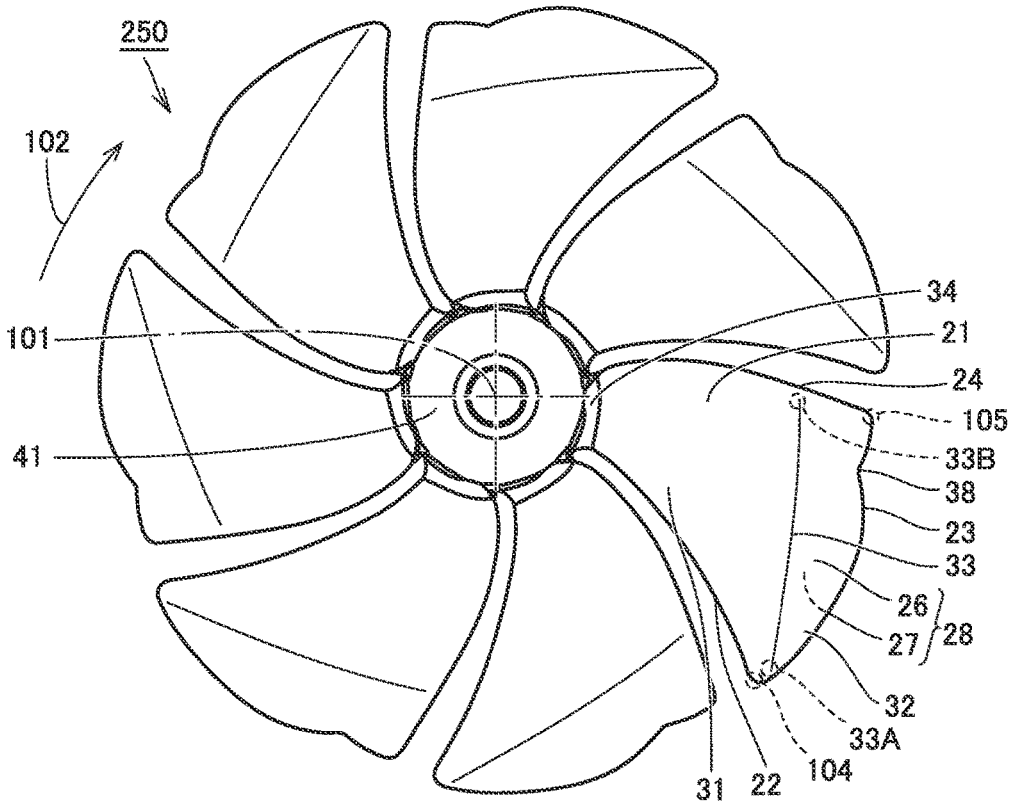
FIG. 86 is a plan view of the propeller fan in the fifth embodiment viewed from the burst side.
Figure 87:
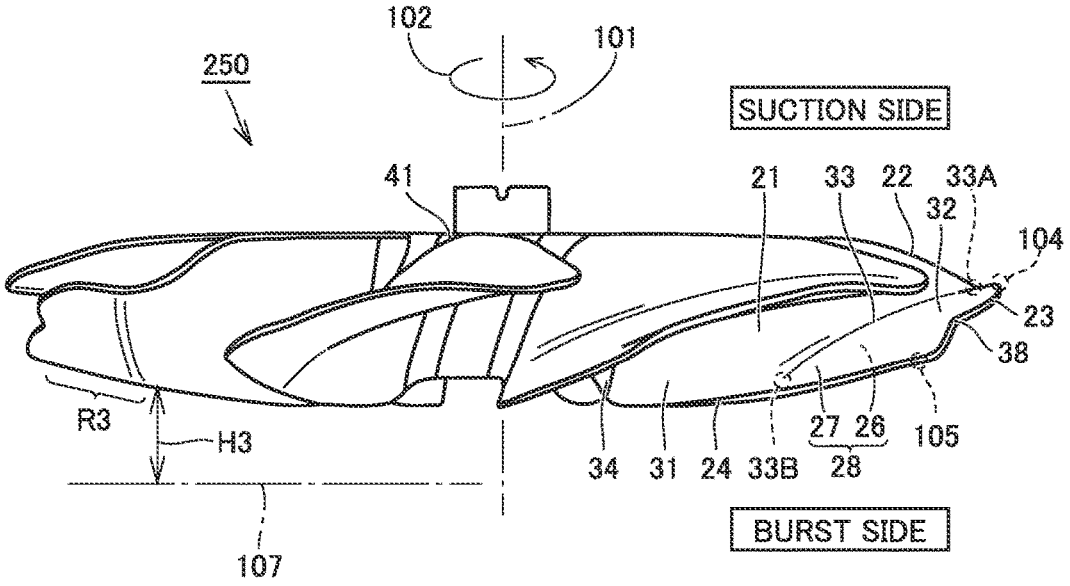
FIG. 87 is a first side view showing the propeller fan in the fifth embodiment.
Figure 88:
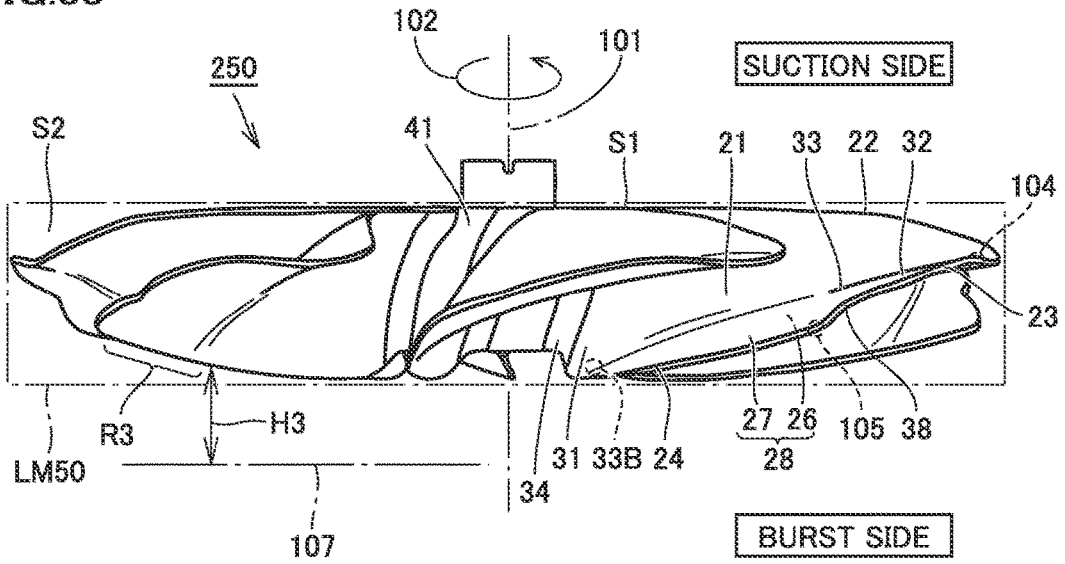
FIG. 88 is a second side view showing the propeller fan in the fifth embodiment.

FIG. 83 is a perspective view of propeller fan 250 viewed from the suction side. FIG. 84 is a plan view of propeller fan 250 viewed from the suction side. FIG. 85 is a perspective view of propeller fan 250 viewed from the burst side. FIG. 86 is a plan view of propeller fan 250 viewed from the burst side. FIG. 87 is a first side view showing propeller fan 250. FIG. 88 is a second side view showing propeller fan 250.

Propeller fan 250 rotates in the direction shown with arrow 102 around central axis 101 as it is driven by the drive motor (not shown). Rotation of blade 21 generates wind so that fluid feeder 610 (see FIG. 82) can send wind.

Propeller fan 250 in the present embodiment has boss hub portion 41 serving as a rotation shaft portion and seven blades 21. Propeller fan 250 may have a plurality of blades 21 other than seven or may have only a single blade 21. Propeller fan 250 is not limited to fluid feeder 610 serving as the electric fan, and it may be employed in various fluid feeders such as a circulator, an air-conditioner, an air cleaner, a humidifier, a dehumidifier, a fan heater, a cooling apparatus, or a ventilator.

Boss hub portion 41 is a portion connecting propeller fan 250 to an output shaft of a drive motor (not shown) which is a drive source. Blade 21 is formed to extend outward from the outer surface of boss hub portion 41 in the direction of radius of central axis 101. Seven blades 21 are arranged at regular intervals in the circumferential direction around the axis of rotation (central axis 101) of propeller fan 250. In the present embodiment, seven blades 21 are identical in shape. When any blade 21 is rotated around central axis 101, that blade 21 and another blade 21 match in shape.

(Blade 21)

Blade 21 has blade root portion 34 and blade surface 28 extending like a plate from blade root portion 34. Blade root portion 34 is arranged between blade 21 and the outer surface of boss hub portion 41 (a boundary). Blade surface 28 is constituted of positive pressure surface 26 and negative pressure surface 27 arranged on the back of positive pressure surface 26. Positive pressure surface 26 is located on the burst side of blade surface 28 in the axial direction of central axis 101. Negative pressure surface 27 is located on the suction side of blade surface 28 in the axial direction of central axis 101. A surface of each of positive pressure surface 26 and negative pressure surface 27 is smoothly formed as a whole.

Blade surface 28 sends wind with rotation of propeller fan 250 and sends air from the suction side to the burst side. With generation of a flow of air over blade surface 28 during rotation of propeller fan 250, such pressure distribution that a pressure is relatively high over positive pressure surface 26 and a pressure is relatively low over negative pressure surface 27 is created.

On a periphery of blade surface 28, front edge portion 22, blade tip end portion 104, outer edge portion 23, blade rear end portion 105, and rear edge portion 24 are annularly arranged in this order from a portion on the side of the direction of rotation in blade root portion 34 toward a portion opposite in the direction of rotation in blade root portion 34.

In a plan view of blade 21, blade 21 has a shape pointed like a sickle, with blade tip end portion 104 where front edge portion 22 intersects with outer edge portion 23 being defined as the tip end. In a portion of front edge portion 22 and rear edge portion 24 on the radially inner side, a width thereof along the direction of rotation gradually decreases, and in a portion of front edge portion 22 and rear edge portion 24 on the radially outer side, a width thereof along the direction of rotation gradually increases.

Specifically, front edge portion 22 is arranged upstream in the direction of rotation (the direction shown with arrow 102) of blade 21. When propeller fan 250 is viewed in the axial direction of central axis 101 (in other words, propeller fan 250 is two-dimensionally viewed), front edge portion 22 extends from a portion on the side of the direction of rotation in blade root portion 34 outward in the direction of radius from the inner side in the direction of radius around central axis 101. Front edge portion 22 extends in the direction of rotation of propeller fan 250, as being curved from the inner side in the direction of radius outward in the direction of radius around central axis 101.

Blade tip end portion 104 is arranged on the outer side in the direction of radius in front edge portion 22 when viewed form central axis 101. Blade tip end portion 104 is a portion where front edge portion 22 and outer edge portion 23 which will be described next are connected to each other. Blade tip end portion 104 in the present embodiment is located most on the side of direction of rotation in blade 21.

Rear edge portion 24 is arranged downstream in the direction of rotation (the direction shown with arrow 102) of blade 21. When propeller fan 250 is viewed in the axial direction of central axis 101 (in other words, propeller fan 250 is two-dimensionally viewed), rear edge portion 24 extends from a portion opposite in the direction of rotation in blade root portion 34, outward in the direction of radius from the inner side in the direction of radius around central axis 101. Rear edge portion 24 is arranged as opposed to front edge portion 22 in the circumferential direction around central axis 101. Rear edge portion 24 extends in the direction of rotation of propeller fan 250, as being gently curved from the inner side in the direction of radius outward in the direction of radius around central axis 101.

Blade rear end portion 105 is arranged on the outer side in the direction of radius in rear edge portion 24 when viewed form central axis 101. Blade rear end portion 105 is a portion where rear edge portion 24 and outer edge portion 23 which will be described next are connected to each other. Blade tip end portion 104 in propeller fan 250 of the present embodiment is arranged on the inner circumferential side around central axis 101, relative to blade rear end portion 105.

Outer edge portion 23 extends along the circumferential direction around central axis 101 and is provided to connect blade tip end portion 104 and blade rear end portion 105 to each other. Outer edge portion 23 intersects with front edge portion 22 at blade tip end portion 104 located most on the side of the direction of rotation of propeller fan 250 on the line extending in the circumferential direction of outer edge portion 23 and intersects with rear edge portion 24 at blade rear end portion 105 located most opposite in the direction of rotation of propeller fan 250 on the line extending in the circumferential direction of outer edge portion 23. Outer edge portion 23 as a whole extends in an arc shape between blade tip end portion 104 and blade rear end portion 105.

Front edge portion 22, blade tip end portion 104, outer edge portion 23, blade rear end portion 105, and rear edge portion 24 constitute, together with blade root portion 34, a peripheral portion forming a periphery of blade 21. This peripheral portion (front edge portion 22, blade tip end portion 104, outer edge portion 23, blade rear end portion 105, and rear edge portion 24) are in a smooth shape not having a corner, as they are all formed to have a substantially arc shape. Blade surface 28 is formed over the entire region inside the region surrounded by blade root portion 34 and this peripheral portion (front edge portion 22, blade tip end portion 104, outer edge portion 23, blade rear end portion 105, and rear edge portion 24).

Blade surface 28 is formed as being smoothly curved as a whole from the suction side to the burst side in the circumferential direction from front edge portion 22 toward rear edge portion 24. Blade 21 in propeller fan 250 in the present embodiment is formed in such a blade shape that a thickness of a cross-sectional shape in the circumferential direction connecting front edge portion 22 and rear edge portion 24 to each other increases from front edge portion 22 and rear edge portion 24 toward a portion around a center of the blade and is greatest at a position close to front edge portion 22 relative to the center of the blade.

Blade surface 28 of propeller fan 250 has inner region 31, outer region 32, and coupling portion 33. Inner region 31, outer region 32, and coupling portion 33 are formed in both of positive pressure surface 26 and negative pressure surface 27.

Inner region 31 includes blade root portion 34 in a part thereof and it is located on the inner side in the direction of radius of central axis 101, relative to coupling portion 33 and outer region 32. Outer region 32 includes blade rear end portion 105 in a part thereof and it is located on the outer side in the direction of radius of central axis 101, relative to coupling portion 33 and inner region 31. Positive pressure surface 26 in inner region 31 and positive pressure surface 26 in outer region 32 are formed to be different in surface shape from each other. Negative pressure surface 27 in inner region 31 and negative pressure surface 27 in outer region 32 are also formed to be different in surface shape from each other.

Coupling portion 33 couples inner region 31 and outer region 32 to each other such that a side of positive pressure surface 26 of blade surface 28 is projecting and a side of negative pressure surface 27 of blade surface 28 is recessed. Coupling portion 33 is provided to extend substantially along the direction of rotation, and extends from front end portion 33A located most upstream in the direction of rotation in coupling portion 33 to rear end portion 33B located most downstream in the direction of rotation in coupling portion 33.

Coupling portion 33 is formed such that blade surface 28 is curved with slightly sharp variation in curvature from inner region 31 toward outer region 32, and couples in a curved manner, inner region 31 and outer region 32 different from each other in surface shape to each other at a boundary therebetween. Coupling portion 33 may couple them in a bent manner.

Coupling portion 33 is provided such that a curvature in a cross-sectional view along the direction of radius of blade surface 28 attains to relative maximum around the same, and appears as a curved protruding projecting portion on positive pressure surface 26 as extending like a streak from front end portion 33A toward rear end portion 33B and appears as a curved recessed groove portion on negative pressure surface 27 as extending like a streak from front end portion 33A toward rear end portion 33B. Coupling portion 33 in the present embodiment is provided from a portion in outer edge portion 23 located in midway between blade tip end portion 104 and blade rear end portion 105 to rear edge portion 24.

Blade 21 in the present embodiment has what is called a forward camber structure. Blade 21 has, in both of inner region 31 and outer region 32, a warped shape such that the side of positive pressure surface 26 is recessed and the side of negative pressure surface 27 is projecting. Blade 21 is formed such that a stagger angle (θA) in the portion on the inner side in the direction of radius (the side of inner region 31) relative to coupling portion 33 in blade surface 28 is smaller than a stagger angle (θB) in the portion on the outer side in the direction of radius (the side of outer region 32) relative to coupling portion 33 in blade surface 28. Recessed connection portion 38 is provided in outer edge portion 23 of blade 21. Recessed connection portion 38 in the present embodiment is formed to be recessed toward central axis 101 from the portion in outer edge portion 23 close to blade rear end portion 105.

FIGS. 87 and 88 show virtual plane 107 orthogonal to central axis 101 which is the rotation axis of propeller fan 250 on the burst side of propeller fan 250, that is, on the side facing positive pressure surface 26 of blade 21. With this virtual plane 107 being defined as the reference, rear edge portion 24 of blade 21 has a height H3 increasing toward outer edge portion 23 (blade rear end portion 105) in a region R3 on the outer circumferential side around central axis 101.

Height H3 of rear edge portion 24 is smaller on the inner circumferential side around central axis 101 as a distance from boss hub portion 41 is greater, and it is greater on the outer circumferential side around central axis 101, toward outer edge portion 23 (blade rear end portion 105). In other words, rear edge portion 24 extends as being curved to project on the burst side in the axial direction of central axis 101 between boss hub portion 41 and outer edge portion 23. A position where height H3 of rear edge portion 24 starts to increase toward outer edge portion 23 is preferably within a range from 0.4R to 0.7R (R representing a maximum radius of blade 21 in the plan view of propeller fan 250) around central axis 101.

(Function and Effect)

According to fluid feeder 610 (see FIG. 1) and propeller fan 250 in the present embodiment as well, a blade tip end vortex which is generated in the vicinity of blade tip end portion 104 and flows as being held by coupling portion 33 and a horseshoe vortex which is generated in the vicinity of coupling portion 33 and flows as being held by coupling portion 33 provide kinetic energy to a mainstream. The mainstream provided with kinetic energy is less likely to separate from blade surface 28 on the downstream side over blade surface 28. Consequently, a separation region can be made smaller or eliminated. Propeller fan 250 can achieve lowering in noise generated during rotation owing to suppression of separation, and increase in quantity of wind as compared with a case not provided with coupling portion 33 and resulting higher efficiency.

As recessed connection portion 38 is provided in outer edge portion 23, wind velocity distribution in the direction of radius can be more uniform, variation in wind velocity can be suppressed, comfortably impinging wind can be obtained, pressure fluctuation included in wind generated in the portion close to the outer side in the direction of radius is lessened, and comfortably impinging wind can be generated. During rotation at a low speed, comfortably impinging wind diffusing over a wide range can be obtained, and during rotation at a high speed, wind high in straightness and reaching farther can be obtained.

As height H3 of rear edge portion 24 increases toward outer edge portion 23 (blade rear end portion 105), capability to send wind is suppressed on the outer circumferential side around central axis 101, so that a propeller fan achieving less uncomfortableness of blowing from the fan can be realized.

[Eighth Verification Experiment]

An eighth verification experiment carried out in connection with propeller fan 250 (see FIG. 88) in the fifth embodiment described above will be described with reference to FIGS. 89 to 93. In the eighth verification experiment, a quantity of wind, noise, power consumption, and wind velocity distribution obtained during rotation of propeller fan 250 in the fifth embodiment described above and a propeller fan 950 shown in FIG. 89 were measured.

Blade 21 of propeller fan 250 used in the eighth verification experiment is substantially the same in shape as propeller fan 160 (see FIGS. 40 and 41) used in the first verification experiment described above. A value for dimensionless position η of front end portion 33A of coupling portion 33 is approximately 0.1. A value for dimensionless position ξ of rear end portion 33B of coupling portion 33 is approximately 0.6. Propeller fan 250 has a diameter of 320 mm. An occupied space LM 50 (see FIG. 88) formed as a result of rotation of propeller fan 250 has a height in the direction of central axis 101 of 55 mm. Boss hub portion 41 has a diameter of 70 mm. Gaps S1 and S2 (see FIG. 88) having a prescribed volume are formed between propeller fan 250 and occupied space LM50. A volume of gap S1 on the inner circumferential side is extremely small and a volume of gap S2 on the outer circumferential side is large.

Figure 89:
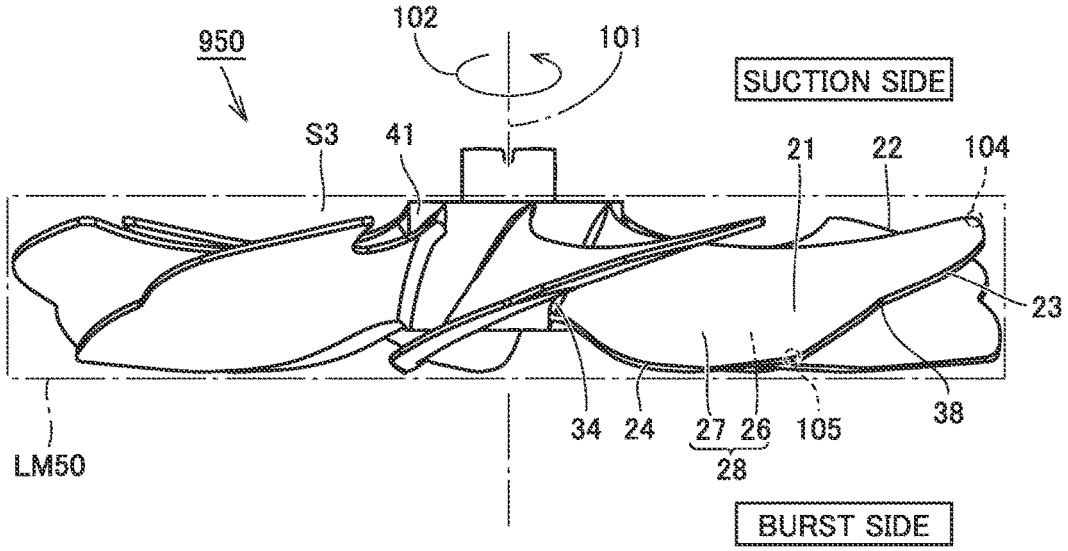
FIG. 89 is a side view showing a propeller fan used in an eighth verification experiment.

Referring to FIG. 89, as compared with propeller fan 250, propeller fan 950 does not have coupling portion 33 and it is not formed such that a height of rear edge portion 24 increases toward outer edge portion 23 (blade rear end portion 105). A gap S3 having a prescribed volume is formed between propeller fan 950 and occupied space LM50. A volume of gap S3 is greater than the total sum of gap S1 and gap S2. Propeller fan 950 is otherwise substantially the same as propeller fan 250.

Figure 90:
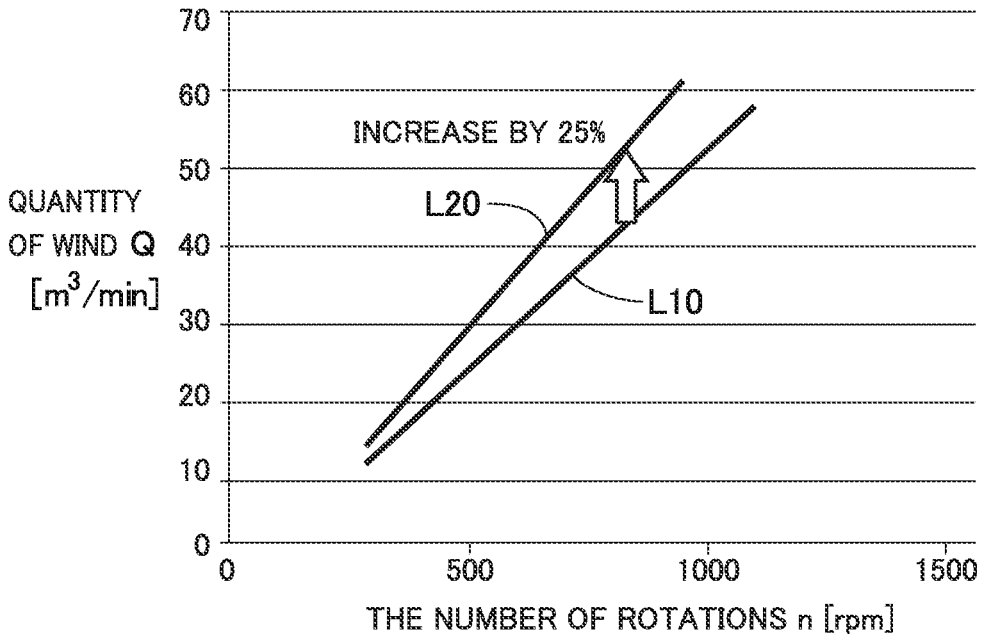
FIG. 90 is a graph showing relation between the number of rotations and a quantity of wind of the propeller fan obtained in an eighth verification test.

FIG. 90 is a graph showing relation between the number of rotations n (rpm) of propeller fans 950 and 250 and quantity of wind Q (m3/min.) obtained from each of propeller fans 950 and 250. Relation between the number of rotations n and quantity of wind Q of propeller fan 950 is shown with a line L10. Relation between the number of rotations n and quantity of wind Q of propeller fan 250 is shown with a line L20.

Based on comparison between line L10 and line L20, with the number of rotations n being the same, propeller fan 250 obtains a quantity of wind increased by 25% as compared with propeller fan 950. Therefore, it can be seen that propeller fan 250 can obtain a larger quantity of wind than propeller fan 950 identical in diameter of the propeller fan, height of the occupied space formed as a result of rotation of the propeller fan, and diameter of the boss hub portion.

Figure 91:
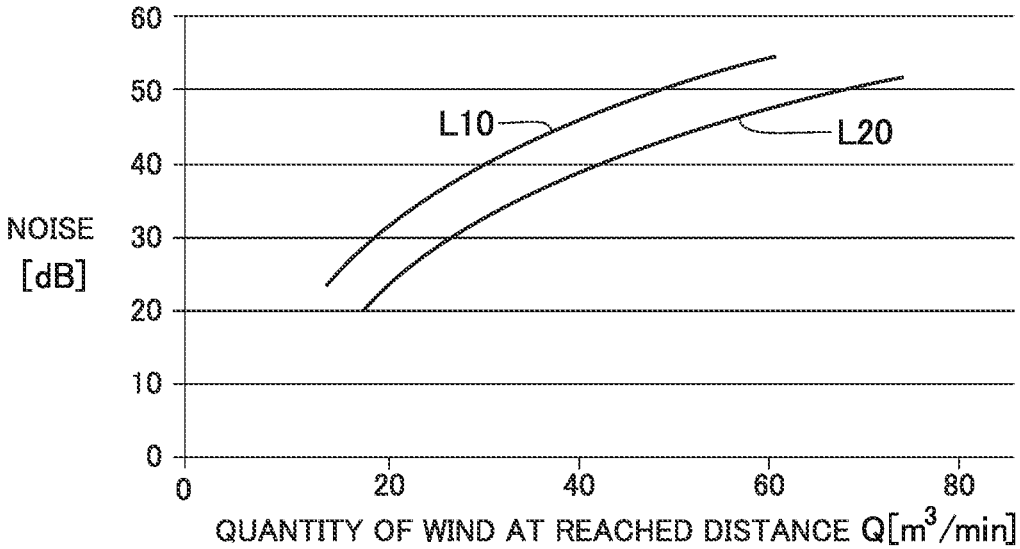
FIG. 91 is a graph showing relation between a quantity of wind at a reached distance and noise of the propeller fan obtained in the eighth verification test.

FIG. 91 is a graph showing relation between quantity of wind Q at a reached distance (m3/min.) of propeller fans 950 and 250 and noise (dB) generated from each of propeller fans 950 and 250. Relation between quantity of wind Q at a reached distance and noise of propeller fan 950 is shown with line L10. Relation between quantity of wind Q at a reached distance and noise of propeller fan 250 is shown with line L20.

Based on comparison between line L10 and line L20, with quantity of wind Q at a reached distance being the same, noise generated from propeller fan 250 is lower by 8 dB than noise generated from propeller fan 950. Therefore, it can be seen that propeller fan 250 can achieve lower noise than propeller fan 950 identical in diameter of the propeller fan, height of the occupied space formed as a result of rotation of the propeller fan, and diameter of the boss hub portion.

Figure 92:
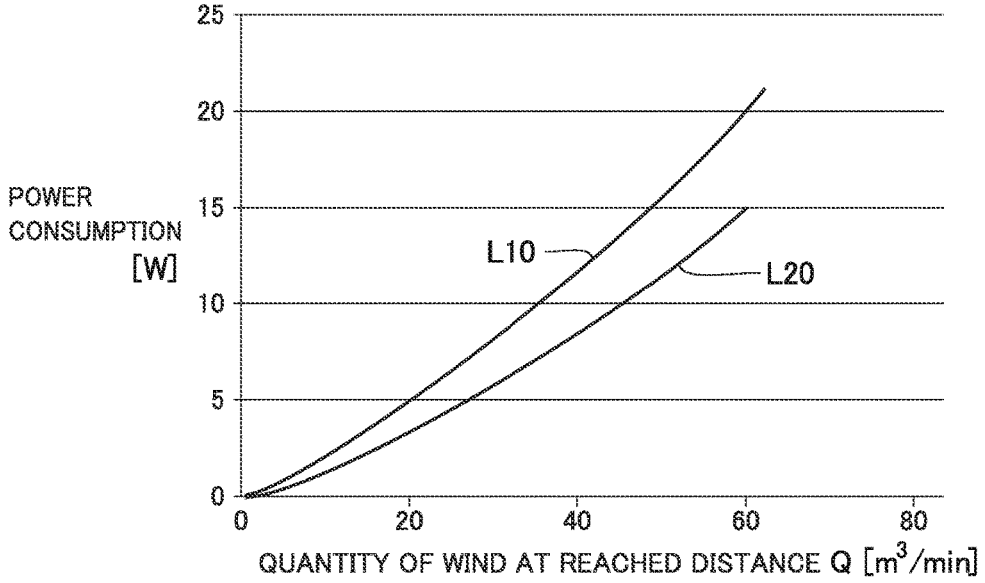
FIG. 92 is a graph showing relation between a quantity of wind at a reached distance and power consumption of the propeller fan obtained in the eighth verification test.

FIG. 92 is a graph showing relation between quantity of wind Q at a reached distance (m3/min.) of propeller fans 950 and 250 and power consumption (W) in each of propeller fans 950 and 250. Relation between quantity of wind Q at a reached distance and power consumption of propeller fan 950 is shown with line L10. Relation between quantity of wind Q at a reached distance and power consumption of propeller fan 250 is shown with line L20.

Based on comparison between line L10 and line L20, with quantity of wind Q at a reached distance being the same, power consumption in propeller fan 250 is lower than power consumption in propeller fan 950. For example, when quantity of wind Q at a reached distance is approximately 50 m3/min., power consumption in propeller fan 250 is lower by 30% than power consumption in propeller fan 950. Therefore, it can be seen that propeller fan 250 can be lower in power consumption than propeller fan 950 identical in diameter of the propeller fan, height of the occupied space formed as a result of rotation of the propeller fan, and diameter of the boss hub portion.

Figure 93:
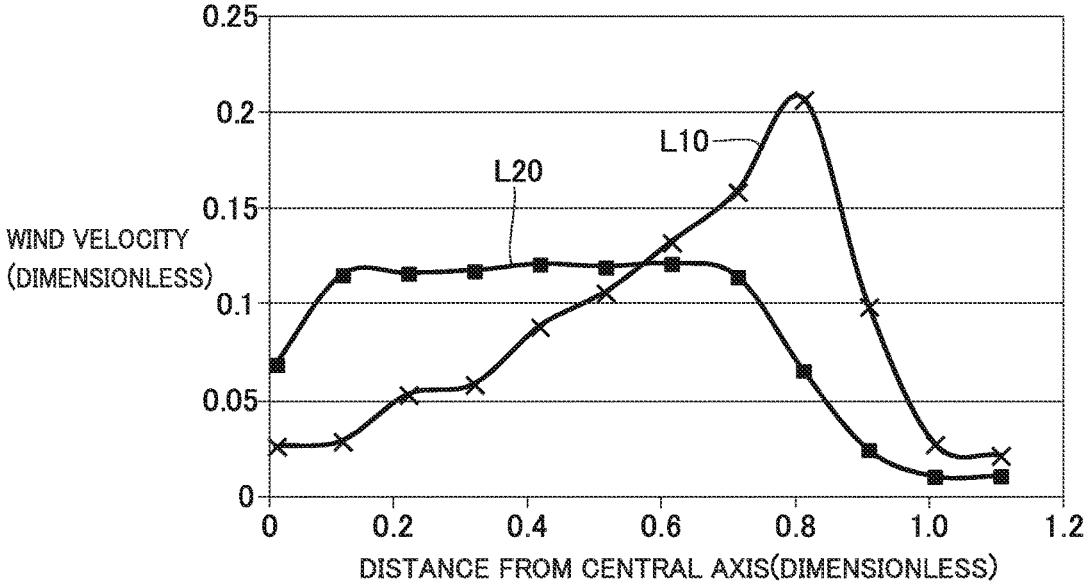
FIG. 93 is a graph showing relation between a distance (dimensionless) from a central axis in a direction of radius and a wind velocity (dimensionless) of the propeller fan obtained in the eighth verification test.

FIG. 93 is a graph showing relation between a distance (dimensionless) from central axis 101 in the direction of radius and a wind velocity (dimensionless) in each of propeller fans 950 and 250. Relation between the distance (dimensionless) from central axis 101 in the direction of radius and the wind velocity (dimensionless) in propeller fan 950 is shown with line L10. Relation between the distance (dimensionless) from central axis 101 in the direction of radius and the wind velocity (dimensionless) in propeller fan 250 is shown with line L20.

Based on comparison between line L10 and line L20, it can be seen that, in propeller fan 250, a peak of a wind velocity has significantly been eliminated as compared with propeller fan 910 and a wind velocity is substantially fully uniform within a range of a distance (dimensionless) from central axis 101 in the direction of radius being from 0.1 to 0.7.

Considering the eighth verification experiment, it can be seen that a quantity of wind can be uniform and noise and power consumption can be lowered by providing coupling portion 33 on blade surface 28, making a stagger angle on the inner side of blade surface 28 relatively small, making a stagger angle on the outer side of blade surface 28 relatively great, providing recessed connection portion 38 in outer edge portion 23, and having rear edge portion 24 have height H3 increasing toward outer edge portion 23 (blade rear end portion 105) in region R3 on the outer circumferential side.

Figure 94:
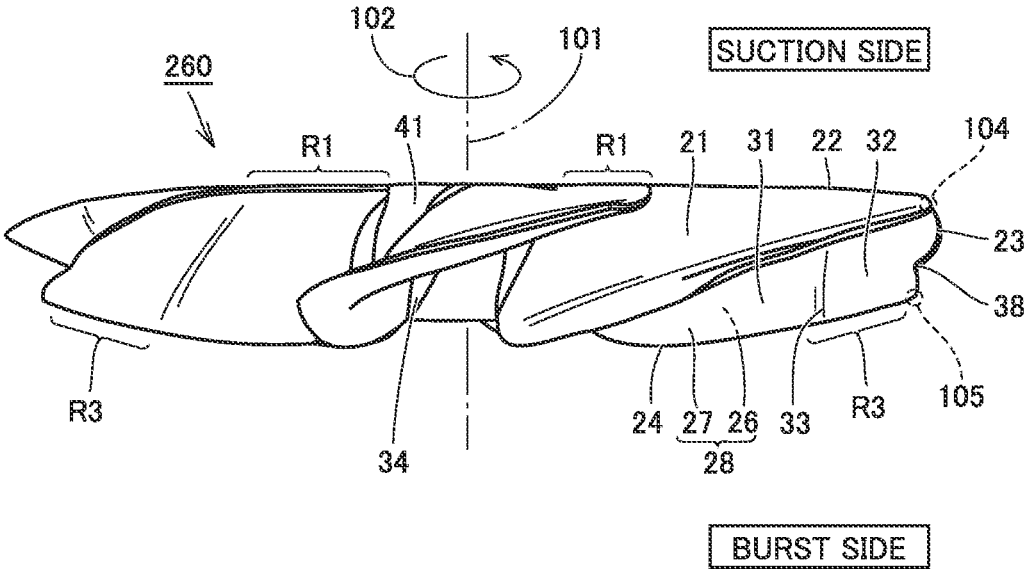
FIG. 94 is a side view showing a first variation of the propeller fan in connection with the eighth verification experiment.
Figure 95:
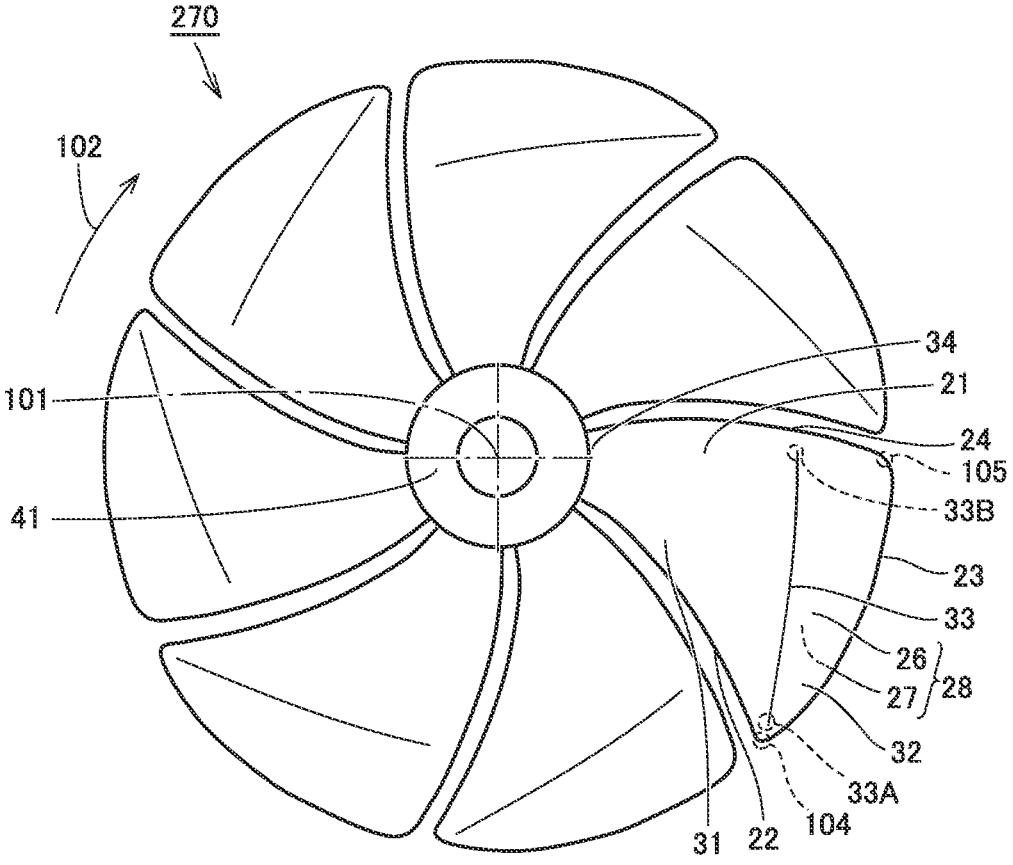
FIG. 95 is a plan view showing a second variation of the propeller fan in connection with the eighth verification experiment.
Figure 96:
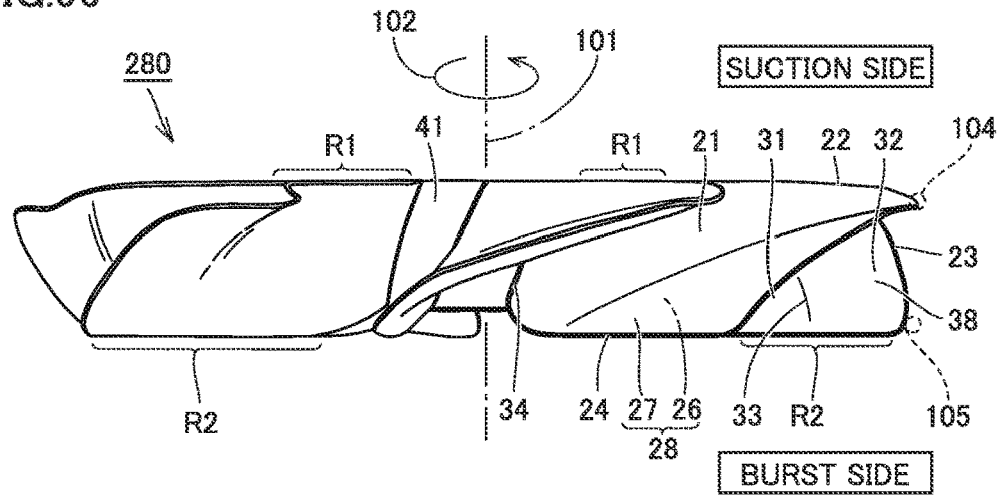
FIG. 96 is a side view shoring a third variation of the propeller fan in connection with the eighth verification experiment.

Referring to FIG. 94, in order to further enhance capability to send wind on the inner circumferential side, as in a propeller fan 260, in region R1 from front edge portion 22 to the portion of outer edge portion 23 close to blade tip end portion 104, these may maintain a constant height in the axial direction of central axis 101 (see the second embodiment described above). Referring to FIG. 95, in order to enhance capability to send wind on the outer circumferential side, as in a propeller fan 270, no recessed connection portion 38 may be provided in outer edge portion 23. Referring to FIG. 96, in order to enhance capability to send wind on the outer circumferential side, as in a propeller fan 280, rear edge portion 24 may have a constant height in the axial direction of central axis 101 in region R2 on the outer circumferential side around central axis 101 (see the third embodiment described above).

Sixth Embodiment (Molding Die)

In the present embodiment, a molding die 61 for molding various propeller fans in each embodiment and each verification experiment described above with a resin will be described.

Figure 97:
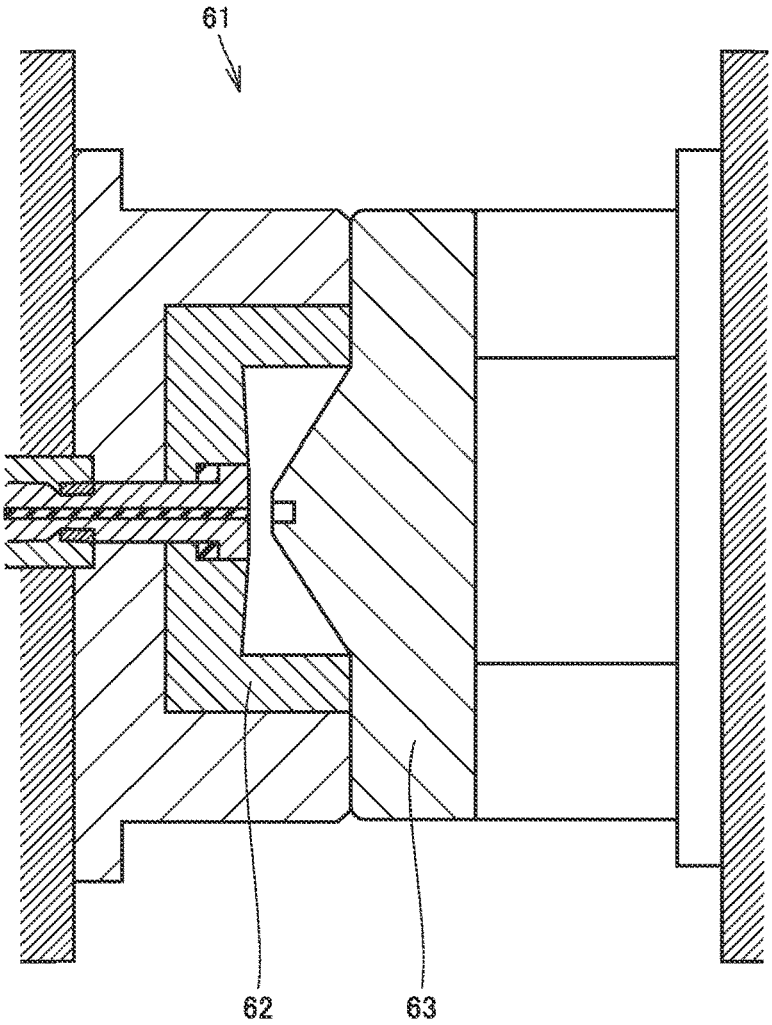
FIG. 97 is a cross-sectional view showing a molding die in a sixth embodiment.

FIG. 97 is a cross-sectional view showing a molding die used for manufacturing of a propeller fan. Molding die 61 has a fixed die 62 and a movable die 63. Fixed die 62 and movable die 63 define a cavity substantially the same in shape as a propeller fan, into which a fluid resin is injected.

Molding die 61 may be provided with a not-shown heater for enhancing fluidity of the resin injected into the cavity. Such provision of a heater is particularly effective in using a synthetic resin having increased strength such as an AS resin filled with glass fibers.

With regard to molding die 61 shown in FIG. 97, it is assumed that the surface on the side of the positive pressure surface in the propeller fan is formed with fixed die 62 and the surface on the side of the negative pressure surface is formed with movable die 63, however, the surface on the side of the negative pressure surface of the propeller fan may be formed with fixed die 62 and the surface on the side of the positive pressure surface of the propeller fan may be formed with movable die 63.

Some propeller fans are integrally formed by using a metal as a material and through drawing by pressing. For such molding, a thin metal plate is generally employed, because a thick metal plate is difficult to draw and a mass thereof is also great. In this case, it is difficult to maintain strength (rigidity) in a large propeller fan. In contrast, some propeller fans include a part called a spider formed from a metal plate greater in thickness than a blade portion and have the blade portion fixed to a rotation shaft, however, it is great in mass and fan balance is also is poor. Generally, since a metal plate which is thin and has a constant thickness is employed, a cross-sectional shape of a blade portion cannot be in a blade shape.

In contrast, by forming the propeller fan with a resin, such problems can collectively be solved.

As above, each embodiment and each verification experiment based on the present invention have been described, however, each embodiment and each verification experiment disclosed herein are illustrative and non-restrictive in every respect. The technical scope of the present invention is shown by the terms of the claims, and includes any modifications within the scope and meaning equivalent to the terms of the claims.

INDUSTRIAL APPLICABILITY

This invention is applied, for example, to such home electric appliances as an electric fan, a circulator, an air-conditioner, an air cleaner, a humidifier, a dehumidifier, a fan heater, a cooling apparatus, or a ventilator.

REFERENCE SIGNS LIST

21, 21A, 21B, 21C blade; 22 front edge portion; 23 outer edge portion; 24 rear edge portion; 26 positive pressure surface; 27 negative pressure surface; 28 blade surface; 31 inner region; 31L, 33L virtual straight line; 32 outer region; 33 coupling portion; 33A front end portion; 33B rear end portion; 34 blade root portion; 38 connection portion; 41 boss hub portion (rotation shaft portion); 41S outer surface; 52 separation region; 61 molding die; 62 fixed die; 63 movable die; 101 central axis; 102, AR5, AR6 arrow; 104 blade tip end portion; 105 blade rear end portion; 107 virtual plane; 109 circumscribed circle; 110, 120, 120A, 130, 140, 150, 160, 170, 180, 190, 200, 210, 220, 230, 250, 260, 270, 280, 910, 950 propeller fan; 111 maximum diameter end portion; 310 mainstream; 320, 350 horseshoe vortex; 330 secondary flow; 340 blade tip end vortex; 510, 520, 610 fluid feeder, 800, 900 wind; C cord length dimension; D10, D20 diameter; DL5, DL6, L1, L2, L3, L4, L5, L6, L10, L20, LL2, LL3, LL4, LL5 line; H2, H3, H10, H20 height; LM1, LM10, LM20, LM50 space; P1 central position; R radius (maximum radius); R1, R2, R3 region; S1, S2, S3, SA, SB gap; TT thickness; and Z1 concentric circle.

The invention claimed is:

1. A propeller fan, comprising:

a rotation shaft portion rotatable around a virtual central axis in a prescribed direction of rotation; and a blade extending outward from an outer surface of said rotation shaft portion in a direction of radius of said central axis, said blade including a blade root portion arranged between said blade and said outer surface of said rotation shaft portion, a peripheral portion continuing to said blade root portion and forming a periphery of said blade together with said blade root portion, and a blade surface formed in a region surrounded by said blade root portion and said peripheral portion, said peripheral portion having a front edge portion arranged upstream in said direction of rotation, a blade tip end portion arranged on an outer side in said direction of radius, in said front edge portion, a rear edge portion arranged downstream in said direction of rotation, a blade rear end portion arranged on the outer side in said direction of radius, in said rear edge portion, and an outer edge portion extending in a circumferential direction around said central axis and connecting said blade tip end portion and said blade rear end portion to each other, said blade surface having an inner region including said blade root portion and located on an inner side in said direction of radius, an outer region including said blade rear end portion and located on the outer side in said direction of radius, and a coupling portion extending from a front end portion located close to said front edge portion, said blade tip end portion, or said outer edge portion to a rear end portion located close to said rear edge portion and coupling said inner region and said outer region to each other such that a side of a positive pressure surface of said blade surface is projecting and a side of a negative pressure surface of said blade surface is recessed, and said blade surface being formed such that a stagger angle in a portion on the inner side in said direction of radius relative to said coupling portion in said blade surface is smaller than a stagger angle in a portion on the outer side in said direction of radius relative to said coupling portion in said blade surface.

2. The propeller fan according to claim 1, wherein when a virtual concentric circle passing through a central position in said coupling portion in said direction of rotation and centered around said central axis is drawn, said front end portion of said coupling portion is located on an outer side in said direction of radius of said concentric circle and said rear end portion of said coupling portion is located on an inner side in said direction of radius of said concentric circle.

3. The propeller fan according to claim 1, wherein said coupling portion is formed such that an interior angle formed on the side of said negative pressure surface of said coupling portion is smallest around a center of said coupling portion in said direction of rotation, and said blade surface located around each of said front end portion and said rear end portion is formed at 180° in a cross-sectional view along said direction of radius, which passes through each of said front end portion and said rear end portion.

4. The propeller fan according to claim 1, wherein said coupling portion is formed along a flow of a blade tip end vortex generated over said blade surface with rotation of said blade.

5. The propeller fan according to claim 1, wherein said blade surface is formed such that a stagger angle in a portion on the inner side in said direction of radius relative to said coupling portion in said blade surface is smaller toward said rotation shaft portion.

6. The propeller fan according to claim 1, wherein said blade surface is formed such that an area of the blade in a portion on the inner side in said direction of radius relative to said coupling portion in said blade surface is equal to or greater than an area of the blade in a portion on the outer side in said direction of radius relative to said coupling portion in said blade surface.

7. The propeller fan according to claim 1, wherein said coupling portion is provided from a portion located in midway between said blade tip end portion and said blade rear end portion to said rear edge portion.

8. The propeller fan according to claim 7, wherein said coupling portion is provided from a side downstream in said direction of rotation, of a portion where a thickness of said blade surface is greatest.

9. The propeller fan according to claim 1, wherein said coupling portion is provided as being curved from said inner region toward said outer region.

10. The propeller fan according to claim 1, wherein said coupling portion is provided as being bent from said inner region toward said outer region.

11. The propeller fan according to claim 1, wherein a dimensionless position $\eta$ obtained from an equation Ra/r1 satisfies a condition of $0.4 \leq \eta \leq 1$, where Ra represents a length dimension along said direction of radius from said outer surface of said rotation shaft portion to said front end portion of said coupling portion and r1 represents a length dimension along said direction of radius from said outer surface of said rotation shaft portion to said outer edge portion.

12. The propeller fan according to claim 1, wherein a dimensionless position $\xi$ obtained from an equation Rb/r1 satisfies a condition of $0.3 \leq \xi \leq 0.7$, where Rb represents a length dimension along said direction of radius from said outer surface of said rotation shaft portion to said rear end portion of said coupling portion and r1 represents a length dimension along said direction of radius from said outer surface of said rotation shaft portion to said outer edge portion.

13. The propeller fan according to claim 1, wherein said front end portion of said coupling portion is located close to said outer edge portion, and a dimensionless position $\kappa$ obtained from an equation Rc/C satisfies a condition of $0 \leq \kappa$—0.5, where C represents a cord length dimension of said outer edge portion and Rc represents a length dimension from said blade tip end portion to said front end portion of said coupling portion.

14. The propeller fan according to claim 1, wherein a dimensionless position $\eta$ is obtained from an equation Ra/r1, where Ra represents a length dimension along said direction of radius from said outer surface of said rotation shaft portion to said front end portion of said coupling portion and r1 represents a length dimension along said direction of radius from said outer surface of said rotation shaft portion to said outer edge portion, a dimensionless position $\xi$ is obtained from an equation Rb/r1, where Rb represents a length dimension along said direction of radius from said outer surface of said rotation shaft portion to said rear end portion of said coupling portion and r1 represents a length dimension along said direction of radius from said outer surface of said rotation shaft portion to said outer edge portion, and relation of $0.80 \leq \eta \leq 1.0$ is satisfied and relation of $0.4 \leq \xi \leq 0.65$ is satisfied.

15. The propeller fan according to claim 1, wherein said front end portion of said coupling portion is located close to said outer edge portion, a dimensionless position $\xi$ is obtained from an equation Rb/r1, where Rb represents a length dimension along said direction of radius from said outer surface of said rotation shaft portion to said rear end portion of said coupling portion and r1 represents a length dimension along said direction of radius from said outer surface of said rotation shaft portion to said outer edge portion, a dimensionless position $\kappa$ is obtained from an equation Rc/C, where C represents a cord length dimension of said outer edge portion and Rc represents a length dimension from said blade tip end portion to said front end portion of said coupling portion, and a condition of $0.40 \leq \xi \leq 0.70$ is satisfied and a condition of $0 \leq \kappa \leq 0.3$ is satisfied.

16. The propeller fan according to claim 1, wherein a region lying from said front edge portion to a portion of said outer edge portion close to said blade tip end portion has a constant height in an axial direction of said central axis.

17. The propeller fan according to claim 1, wherein said front edge portion has a constant height in an axial direction of said central axis between said rotation shaft portion and a position distant from said rotation shaft portion outward in said direction of radius.

18. The propeller fan according to claim 1, wherein said blade root portion of said blade surface has a warped shape such that the side of said positive pressure surface of said blade surface is projecting and the side of said negative pressure surface of said blade surface is recessed, and said blade is formed such that a direction of warpage of said blade root portion and a direction of warpage of said outer edge portion are opposite to each other.

19. The propeller fan according to claim 1, wherein said outer edge portion has a front outer edge portion located on a side of said front edge portion, a rear outer edge portion located on a side of said rear edge portion, and a connection portion connecting said front outer edge portion and said rear outer edge portion to each other.

* * * * *